US012781629B2

(12) United States Patent
Bretschneider et al.

(10) Patent No.: US 12,781,629 B2
(45) Date of Patent: Nov. 3, 2026

(54) MACHINE PICK, HOLDING DEVICE, EXCAVATION SYSTEM, AND METHOD

(71) Applicant: ROCKFEEL GMBH, Freiberg (DE)

(72) Inventors: Joerg Bretschneider, Freiberg (DE); Taras Shepel, Freiberg (DE); Serdar Yasar, Freiberg (DE)

(73) Assignee: Rockfeel GmbH, Freiberg (DE)

( * ) Notice: Subject to any disclaimer, the term of this patent is extended or adjusted under 35 U.S.C. 154(b) by 73 days.

(21) Appl. No.: 18/699,900

(22) PCT Filed: Oct. 10, 2022

(86) PCT No.: PCT/EP2022/078073
§ 371 (c)(1),
(2) Date: Apr. 10, 2024

(87) PCT Pub. No.: WO2023/061924
PCT Pub. Date: Apr. 20, 2023

(65) Prior Publication Data

US 2024/0410278 A1 Dec. 12, 2024

(30) Foreign Application Priority Data

Oct. 11, 2021 (DE) ..... 102021126279.8

(51) Int. Cl.
*E21C 39/00* (2006.01)
*E21C 35/18* (2006.01)

(52) U.S. Cl.
CPC ..... *E21C 39/00* (2013.01); *E21C 35/18* (2013.01)

(58) Field of Classification Search
CPC ..... E21C 39/00; E21C 35/18
See application file for complete search history.

(56) References Cited

U.S. PATENT DOCUMENTS 2,752,591 A * 6/1956 Felbeck ..... E21C 39/00 299/1.1
3,550,959 A * 12/1970 Alford ..... E21C 39/00 340/331

(Continued)

FOREIGN PATENT DOCUMENTS

CN 113431573 A 9/2021
CN 114876457 A 8/2022

(Continued)

OTHER PUBLICATIONS

Search Report of the German application No. 102021126279, Apr. 13, 2023, 45 pages.

(Continued)

*Primary Examiner* — Janine M Kreck
(74) *Attorney, Agent, or Firm* — Natalie Albrecht

(57) ABSTRACT

A machine pick may include a pick tip, a shaft extending away from the pick tip along a longitudinal axis of the machine pick, and a reference element comprising at least one sensor-sensible scale having a magnetizable material. The reference element, the shaft, and the pick tip are rigidly connected to each other. The holding device may include a pick holder having an opening for receiving a machine pick, a locking device configured to form a form-fit with the machine pick received in the opening to limit movement of the machine pick, a receptacle area for receiving a portion of the machine pick where the receptacle area may be exposed to the opening, and at least one sensor. The sensor(s) may be disposed at the receptacle area and sense the portion extending into the receptacle area without contact, and/or the reference element is form-fittingly connected to the shaft.

18 Claims, 42 Drawing Sheets

(56) References Cited

U.S. PATENT DOCUMENTS

| | | | | |
|---|---|---|---|---|
| 3,746,396 | A * | 7/1973 | Radd | E21C 35/19 299/10 |
| 4,001,798 | A * | 1/1977 | Robinson | G01L 1/16 340/870.18 |
| 4,143,552 | A | 3/1979 | Godfrey | |
| 4,655,082 | A | 4/1987 | Peterson | |
| 4,668,018 | A * | 5/1987 | Demoulin | E21C 35/23 299/81.3 |
| 4,733,915 | A | 3/1988 | Hedlund | |
| 4,968,098 | A | 11/1990 | Hirsch | |
| 8,690,260 | B1 | 4/2014 | Stolarczyk | |
| 8,820,845 | B2 * | 9/2014 | Hall | E21C 35/183 299/1.05 |
| 2013/0270890 | A1 | 10/2013 | Hall | |
| 2014/0327295 | A1 | 11/2014 | Hall | |
| 2016/0194951 | A1 | 7/2016 | Hay | |
| 2017/0159432 | A1 | 6/2017 | Lavely et al. | |
| 2021/0040844 | A1 | 2/2021 | Wisinger, Jr. | |

FOREIGN PATENT DOCUMENTS

| | | | |
|---|---|---|---|
| DE | 2349827 | A | 4/1974 |
| DE | 2919499 | C2 | 11/1980 |
| DE | 102010043447 | A1 | 6/2011 |
| DE | 102016123755 | A1 | 6/2017 |
| EP | 3591121 | A1 | 1/2020 |
| LU | 101496 | B1 | 5/2021 |
| PL | 228215 | B1 | 2/2018 |
| PL | 232553 | B1 | 6/2019 |
| WO | 2020205460 | A1 | 10/2020 |

OTHER PUBLICATIONS

Search Report of the International Application No. PCT/EP2022/078073, Feb. 8, 2023, 6 pages.

* cited by examiner

MACHINE PICK, HOLDING DEVICE, EXCAVATION SYSTEM, AND METHOD

CROSS-REFERENCE TO RELATED APPLICATIONS

The present application is a national stage entry according to 35 U.S.C. § 371 of PCT application No.: PCT/EP2022/078073 filed on Oct. 10, 2022; which claims priority to German Patent Application Serial No.: 10 2021 126 279.8 filed on Oct. 11, 2021; all of which are incorporated herein by reference in their entirety and for all purposes.

TECHNICAL FIELD

Various exemplary embodiments relate to a machine pick, a holding device, an excavation system and a method, e.g. a method relating to a machine pick.

BACKGROUND

In the context of raw material production in mining, the importance of smaller deposits for numerous valuable minerals has increased, as comparatively large deposits are exhausted and/or more difficult to find. Selective mining of the respective mineral may be desired, i.e. processes that aim to minimize the dilution of the mineral by accessory minerals (e.g. gangue minerals, inclusions and/or waste rock). This reduces the effort involved in the subsequent processing of the raw minerals (e.g. during transport, crushing, mechanical and chemical separation of valuable materials) and in the stockpiling of wastes. At the same time, selective mining itself may be more elaborate than conventional excavation methods such as drilling and blasting. If selective mining reduces the overall balance of material flows and energy expenditure, it leads to both more sustainable and more economical mining and reduces environmental damage.

Selective mining of minerals may be realized manually by an operator of a rock cutting machine, wherein the operator conventionally relies on visual information regarding the mined rocks and possibly on previously collected information from drilling data (also referred to as exploratory drilling), face inspections and/or face mapping. However, water, excavated material (also known as debris) or the dust generated during rock excavation often restrict the operator's view, so that changes in the course or structure of the valuable mineral-bearing ore bodies may not be continuously traced.

The cutting process must therefore be interrupted regularly to visually inspect the face, for example as soon as the dust has settled. This leads to a significant expenditure of time, lower cutting performance and therefore higher mineral excavation costs. Since there is no up to date information available during rock cutting, it is not possible to directly control the selective cutting process between the face inspections. This leads to an increased portion of accessory minerals in the mined raw ore and correspondingly high costs for subsequent processing, as described above. The mentioned exploratory drillings, face inspections and/or face mappings also require an interruption of the rock excavation and thus increase the time required. If valuable minerals and waste rock are visually similar, visual inspection (e.g. underground) may only provide limited information. Furthermore, the gain from a visual inspection of the face is highly dependent on the skills and experience of the operator and therefore requires experienced personnel.

SUMMARY

According to different embodiments, it was recognized that selective excavation of material (e.g. rock cutting) may be significantly improved if information about the material excavated or to be excavated is provided during the ongoing process, even if the operator's view of the face is restricted. In this connection, it was recognized that such information may be better obtained by directly sensing the parameters of the machine pick, which is used by the cutting machine (e.g. rock cutting machines) to excavate the material, using sensors.

According to different embodiments, movements of the machine pick relative to the pick holder may be sensed by sensors during excavation and, based on this, information relating to the material excavated or to be excavated (e.g. a type and/or physical properties of the material, such as a hardness) may be determined. This improves data availability and thus the control of the material excavation machine (e.g. rock cutting machine) in such a way that selective material excavation (e.g. rock cutting) is improved and therefore does not require any interruptions of the excavation for the purpose of visual monitoring. Clearly, selective material excavation with low dilution may be achieved regardless of the development of dust or concealment by material (heap) that has already been excavated, if the shape or consistency of the ore body changes spatially. The above-mentioned information relating to the material excavated or to be excavated may also be determined by means of the embodiments described herein independently of the skills and experience of the operator and also completely without a direct operator (e.g. in the case of an autonomously operating cutting machine).

According to different embodiments, a machine pick, a holding device, an excavation system and a method are provided which improve selective material excavation (e.g. in rock cutting, underground construction, surface construction, tunnelling, demolition, etc.) and thereby make it possible, for example, to increase the efficiency of an excavation system or an excavation process and thus reduce operating costs. In rock cutting, for example, improved selective rock cutting also leads to reduced effort (and therefore costs) for processing the cut rock.

It was clearly recognized that a machine pick with a sensor-sensible scale makes it possible to sense a mechanical excitation of the machine pick (e.g. movements of the entire machine pick or at least part of it) and that this is directly dependent on the material to be excavated and thus allows conclusions to be drawn about the properties of the material to be excavated. This excitation of the machine pick may be caused by the counterforce generated during material excavation, but also separately for the purpose of maintenance and testing.

According to a first exemplary implementation, the machine pick (e.g. a conical pick) may be mounted with clearance in a holding device, wherein the movement of the entire machine pick in the holding device is sensed within clearance, for example in order to determine information relating to the material excavated on this basis. According to this or an alternative second exemplary implementation, the deformation of the machine pick (e.g. a movement of the pick head caused thereby) may be sensed, preferably when the machine pick (e.g. a radial pick) is rigidly fixed to the holding device, for example in order to determine information regarding the excavated material based thereon.

Figure 1A:
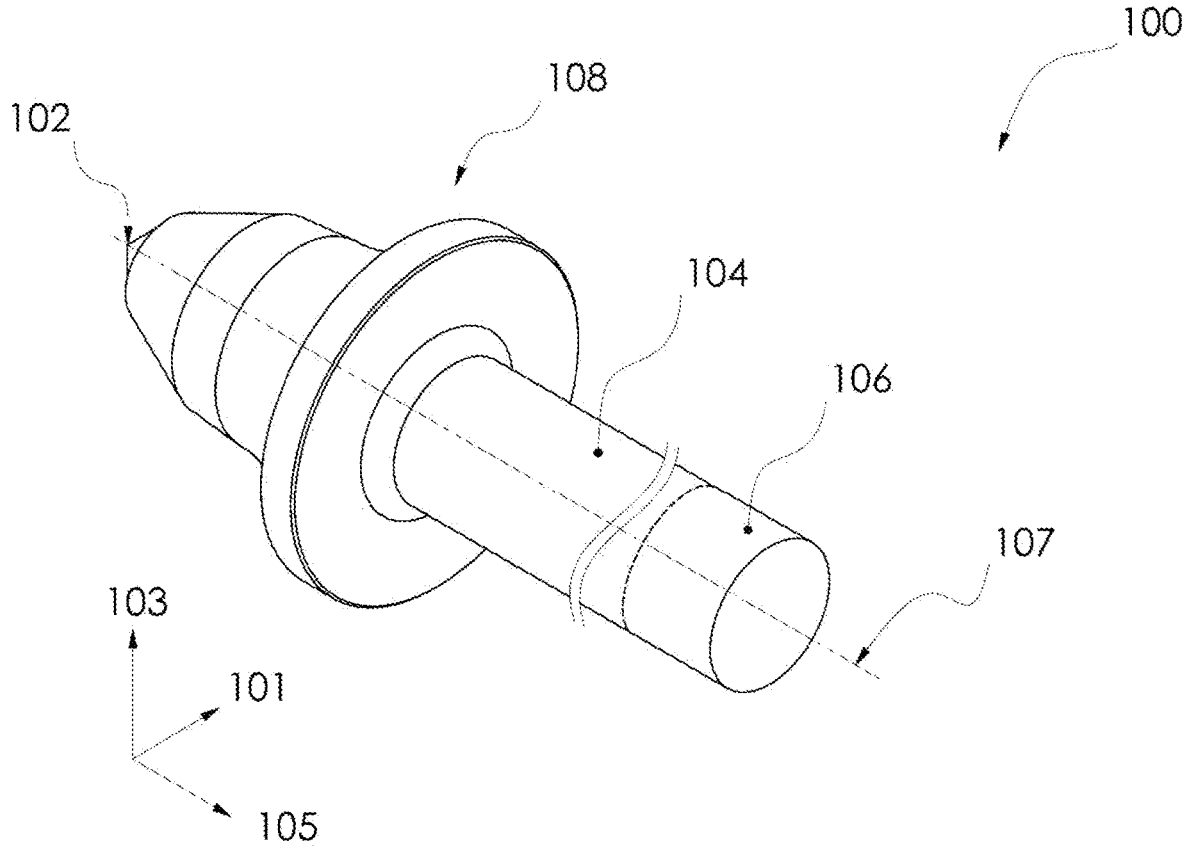
FIGS. 1A to 1H each show a machine pick 100 according to different embodiments.

Elements that are identical, similar or have the same effect are given the same reference signs in the Figures. The Figures and the proportions of the elements shown in the Figures are not to be regarded as true to scale. Rather, individual elements can be shown exaggeratedly large for better representability and/or for better comprehensibility.

DETAILED DESCRIPTION

In the following detailed description, reference is made to the accompanying drawings which form part thereof and in which specific embodiments are shown for illustrative purposes in which the invention may be practiced. In this regard, directional terminology such as "top", "down", "forward", "rearward", "front", "rear", etc. is used with reference to the orientation of the figure(s) being described. Since components of embodiments may be positioned in a number of different orientations, the directional terminology is for illustrative purposes and is not limiting in any way. It is to be understood that other embodiments may be used and structural or logical changes may be made without departing from the scope of protection of the present invention. It is to be understood that the features of the various exemplary embodiments described herein may be combined with each other, unless specifically stated otherwise. The following detailed description is therefore not to be understood in a limiting sense, and the scope of protection of the present invention is defined by the appended claims.

Various embodiments relate to a machine pick. A machine pick, as used herein, may be understood as a tool which may consist of components rigidly connected to each other (e.g. by material bonding, force-fit and/or form-fit). The machine pick may be elongated along a longitudinal axis (e.g. from its rear side to its front side). The machine pick may comprise a pick tip (illustrated on the front side) through which, for example, the longitudinal axis of the machine pick may extend. The pick tip, for example, forms the front edge of the pick and may comprise a shape that tapers towards the front (e.g. conical).

In various embodiments, directional terminology is used, such as "along", "parallel", "across", etc. It is understood that these terms refer to preferred directions, such as a longitudinal extension or a contour of a structure or body. For example, a structure (e.g. a recess) may extend along a path with the longitudinal extension of the path as the preferred direction. The direction terminology may indicate how the preferred direction (e.g. along the path) is aligned with respect to the preferred direction of another structure or with respect to an axis (e.g. the longitudinal axis). Consequently, the direction terminology describes a positional relationship. A spatial position may describe both a location (e.g. in the coordinate system 101, 103, 105) and an orientation.

Two or more of the components of the machine pick may optionally be part of a monolithic body, e.g. made from one piece. Examples of the components of the machine pick include: a shaft (also known as a pick shaft) and a pick head. The pick head and/or the pick shaft may, for example, be rotary bodies.

The pick head may comprise a pick tip (illustrated on the front of the machine pick) and may be connected to the shaft (which extends towards the rear) on the side opposite the pick tip or the side facing the rear of the machine pick, e.g. by materially-bonding. The pick head may alternatively or additionally comprise a collar (also known as a pick collar) that protrudes from the pick tip and/or the pick shaft.

Optionally, the pick head may comprise a pick pin, which comprises the pick tip. The pick pin preferably has a greater hardness than the pick collar and/or than the pick shaft. The pick pin may, for example, be embedded in the pick collar, e.g. pressed in.

The pick pin may be conical, parabolic or graded.

The pick pin may, for example, be made of ceramics or have at least a ceramic (e.g. a carbide, such as tungsten carbide, and/or nitride) or be made of it. The pick collar and/or the pick shaft may be metallic or comprise at least one metal, e.g. steel, or be made of it.

A rigid connection, as used herein, may be understood as a joint-free connection, e.g. blocking all degrees of freedom. Two rigidly connected geometric objects (e.g. bodies or portions) may be set up relative to each other and completely exchange all forces acting on them. A rigid connection is a connection with which the geometric objects remain fixed and stationary relative to each other during their movement. For example, a rigid connection may comprise: a material-bonding connection, a force-fit connection (e.g. produced by press-fitting or shrink-fitting), and/or (e.g. blocking all degrees of freedom) a form-fit connection (e.g. produced by screwing and/or snapping).

A magnetizable material (also referred to as magnetic material) may be understood herein as a material that has a magnetic permeability number of significantly more than 1, e.g. ferrites with 4 to 15,000, cobalt with 80 to 200 or iron with 300 to 10,000. The magnetic material may, for example, be ferromagnetic, antiferromagnetic or ferrimagnetic. The magnetic material may, for example, comprise hard magnetic material and/or soft magnetic material or be formed therefrom. The magnetic material may comprise a magnetic polarization, e.g. a magnetization, so that a dipole is provided by means of the magnetic material. As used herein, a non-magnetic material (also referred to as a non-magnetizable material) may be understood to be a material that has a magnetic permeability of around 1 (e.g. a paramagnetic or even a slightly diamagnetic material such as copper), e.g. in a range from around 0.9 to around 5, e.g. in a range from around 0.9 to around 1.1.

The hard magnetic material may have a coercive field strength greater than about 500 kiloamperes per meter (kA/m), e.g. greater than about 1000 kA/m.

The hard magnetic material (also known as permanent magnetic material) may, for example, comprise one or more than one permanent magnet or be formed therefrom. A permanent magnet (also referred to as a permanent magnetic pole piece) may be understood as a body made of a hard magnetic material. The hard magnetic material may, for example, be a chemical compound and/or an alloy.

The hard magnetic magnet material may comprise iron, cobalt and/or nickel (e.g. a ferrite). The hard magnetic magnet material may comprise a rare earth metal (such as neodymium, samarium, praseodymium, dysprosium, terbium and/or gadolinium), iron, cobalt and/or nickel or be formed therefrom. For example, the hard magnetic material may comprise at least neodymium, iron and/or boron or be formed therefrom, e.g. a chemical compound thereof. Alternatively or additionally, the hard magnetic magnet material may comprise at least aluminum, nickel and/or cobalt or be formed therefrom, e.g. a chemical compound thereof. Alternatively or additionally, the hard magnetic magnet material may comprise at least samarium and/or cobalt or be formed therefrom, e.g. a chemical compound thereof.

The hard magnetic material may, for example, comprise neodymium-iron-boron ($Nd_2Fe_{14}B$) or samarium-cobalt ($SmCo_5$ and $Sm_2Co_{17}$) or be formed therefrom. More generally, the hard magnetic material (e.g., the or each permanent magnet) may comprise a rare earth magnet material (such as neodymium-iron-boron (NdFeB) or samarium-cobalt (SmCo)), a ferrite magnet material (e.g., a hard ferrite magnet material), a bismanol magnet material, and/or an aluminum-nickel-cobalt magnet material or be formed therefrom.

The soft magnetic material may have a coercivity of less than about 500 kA/m, e.g., less than about 100 kA/m, e.g., less than about 10 kA/m, e.g., less than about 1 kA/m. The soft magnetic material may comprise an alloy consisting of iron, nickel, and/or cobalt, steel, a powder material, and/or a soft ferrite (such as nickel tin and/or manganese tin) or be formed therefrom.

Reference is made here to a sensor-sensible scale. The scale may comprise a sensor-sensible (e.g. geometric and/or magnetic) pattern which has several structures (also referred to as a scale element in this context). In this context, structure may be understood as a geometric (e.g. in the case of a profile) and/or magnetic (e.g. in the case of a magnetic pole) variation that may be sensed by sensors. In some embodiments, each scale element may have a geometric profile and/or be formed from a magnetic material. A profiled magnetic material, for example, improves the sensory sensibility of the scale. The geometric extension of each scale element spans a dimension of the scale (also known as the scale dimension) and may be converted into a geometric specification using the sensor, e.g. a distance or an angle. In some embodiments, the sensor-sensible scale has one or more than one edge, e.g. an edge adjacent to an end face of the pick shaft and/or an edge extending along a closed path (in which, for example, the pick axis is disposed).

As sensor (also referred to as a detector) may be understood as a transducer that is set up to sense a property of its environment (e.g. qualitative or quantitative) corresponding to the sensor type as a measured variable, e.g. a physical property, a chemical property and/or a material property. The measured quantity is the specific physical quantity (also known as the controlled variable) to which the measurement by the sensor refers. An example of a quantitatively sensed variable is magnetic field strength, the actual state of which may be converted into a measured value using the sensor.

Each sensor may be part of a measuring chain which comprises a corresponding infrastructure (e.g. processor, storage medium and/or bus system and the like). The measuring chain may be set up to control the corresponding sensor, process its sensed measured variable as an input variable and, based on this, provide an electrical signal as an output variable that represents the sensed input variable. For example, the output variable may specify the measured value. The measuring chain may be implemented, for example, by means of a so-called control device.

In various embodiments, the sensor itself may already comprise a part of the measuring chain which pre-processes the sensed sensor data and outputs the pre-processed sensor data. It is therefore understood that a so-called intelligent sensor, which pre-processes sensed sensor data and outputs this pre-processed sensor data, for example as a digital time series, and a sensor module, which may comprise a sensor coupled to electronics (e.g. for sensing of an amplitude), may also be understood as a sensor described herein.

FIG. 1A to FIG. 1H each show a machine pick 100 according to different embodiments in different schematic views.

The machine pick 100 may comprise a pick tip 102. The machine pick 100 may further comprise a shaft 104 (also referred to as a pick shaft). The shaft 104 may extend away from the pick tip 102 along a longitudinal axis 107 (also referred to as the pick longitudinal axis or pick axis) of the machine pick 100 (e.g., in the direction 105). For example, the shaft 104 may be a body of rotation with respect to the longitudinal axis 107 (e.g. serving as an axis of rotation) and/or cylindrical. The shaft 104 may, for example, be circular cylindrical. According to various embodiments, the shaft 104 may be a round shaft. Clearly, in various preferred embodiments, the machine pick 100 may be a conical pick. Alternatively, the cross-section of the shaft 104 may be non-rotationally symmetric. Non-rotational symmetry, as used herein, may be understood to mean a finite n-number rotational symmetry with respect to the longitudinal axis 107, wherein n may be any natural number greater than or equal to 1. According to various embodiments, the cross-section may comprise a rectangular or trapezoidal cross-section. For example, in this case the machine pick 100 may be a radial pick (see for example FIG. 1H).

According to various embodiments, the machine pick 100 may comprise a pick head 108. The pick head 108 may extend away from the pick tip 102 along the longitudinal axis 107 towards the shaft 104. The pick head 108 and the shaft 104 may be rigidly connected to each other (e.g., by material bonding, force-fit and/or form-fit). For example, the rigid connection (e.g., the form-fit and/or material bonding) may be set up to transmit a force acting on the pick head 108 (e.g., along the longitudinal axis 107) directly to the pick shaft 104, and vice versa. The pick head 108 may be a body of rotation with respect to the longitudinal axis 107 (e.g. serving as an axis of rotation). A rigid connection by means of form-fit between the shaft 104 and the pick head 108 may be achieved, for example, by pressing the shaft 104 into the pick head 108, by shrinking the pick head 108 onto the shaft 104 (e.g. thermally).

A rigid connection by means of a material bond between the shaft 104 and the pick head 108 may be achieved, for example, by manufacturing the shaft 104 and the pick head 108 as a monolithic component (e.g., welded together) or from a common component. The pick head 108 and the shaft 104 may, for example, be made from one piece. According to various embodiments, the shaft 104 and the pick head 108, which comprises the pick tip 102, may be materially bonded to each other and form a body of rotation about the longitudinal axis 107 of the machine pick 100.

Figure 1B:
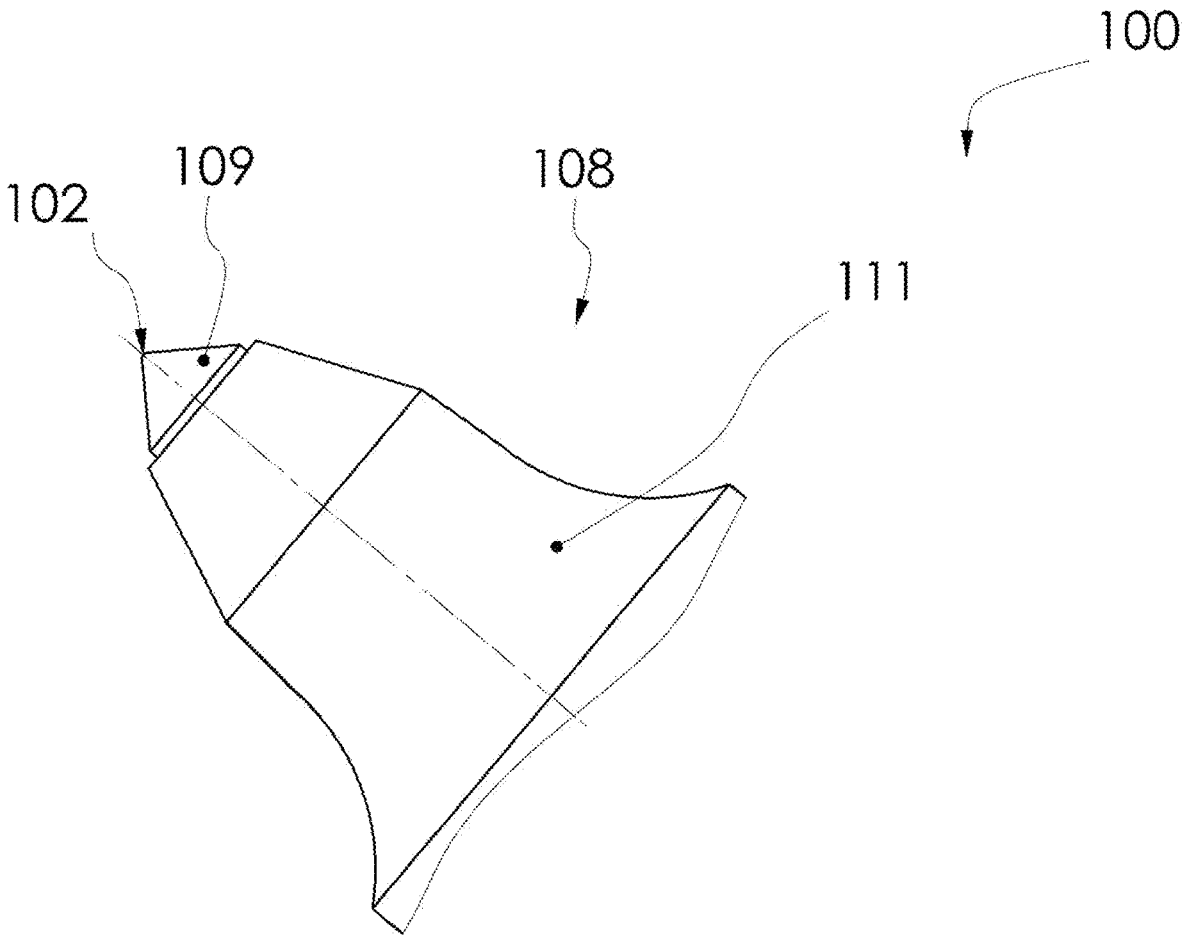

In some preferred embodiments, the pick head 108 may be multi-part, for example comprising a pick pin 109 (see for example FIG. 1B). The pick pin 109 (e.g. comprising or consisting of a ceramic) may comprise the pick tip 102 on the front side of the machine pick 100. The pick pin 109 may comprise a form (e.g. conical and/or tapered) tapering towards the pick tip 102. The pick head 108 may, for example, comprise a head base body (e.g. comprising or consisting of a metal) in which the pick pin 109 is embedded, e.g. pressed in. The head base body may be rigidly connected to the shaft 104.

The head base body may, for example, be designed as a pick collar 111 that protrudes from the shaft 104. The pick pin 109 may, for example, be embedded in the pick collar 111, e.g. pressed in.

Figure 1C:
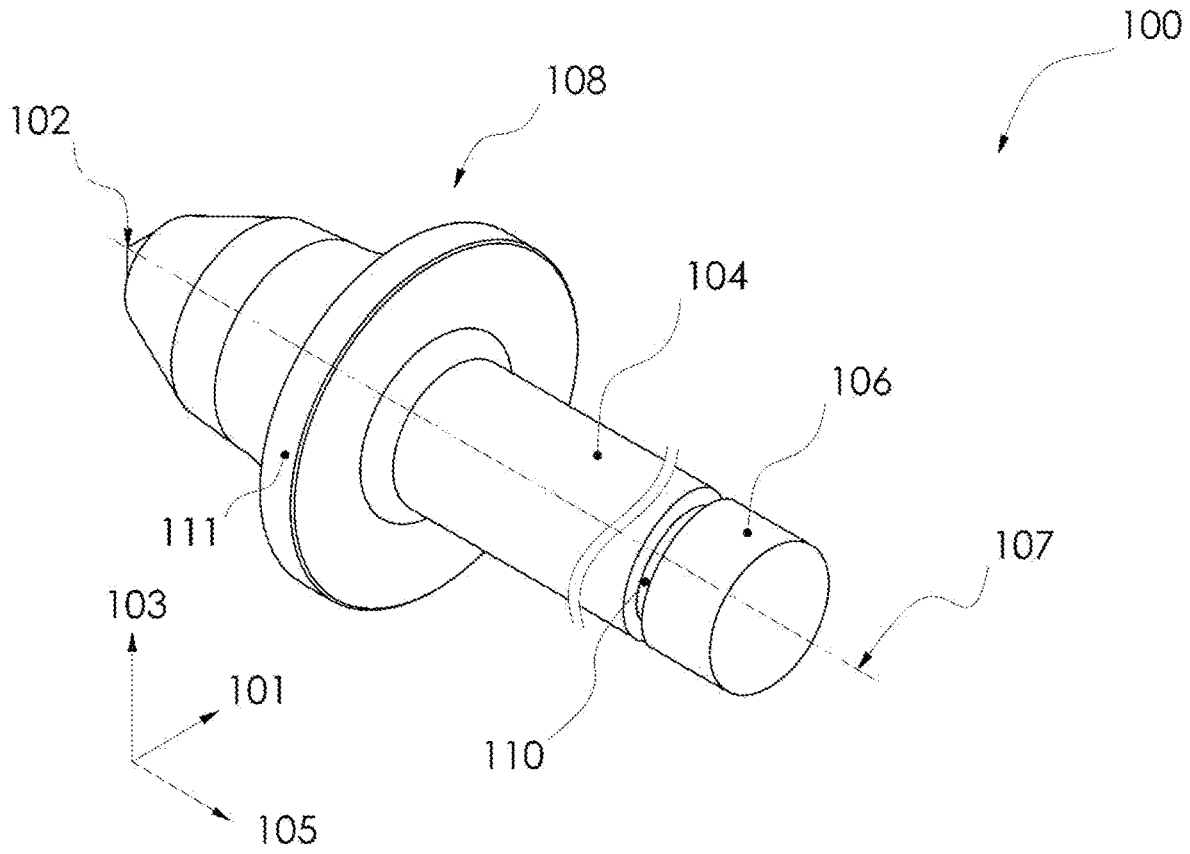
Figure 1C:
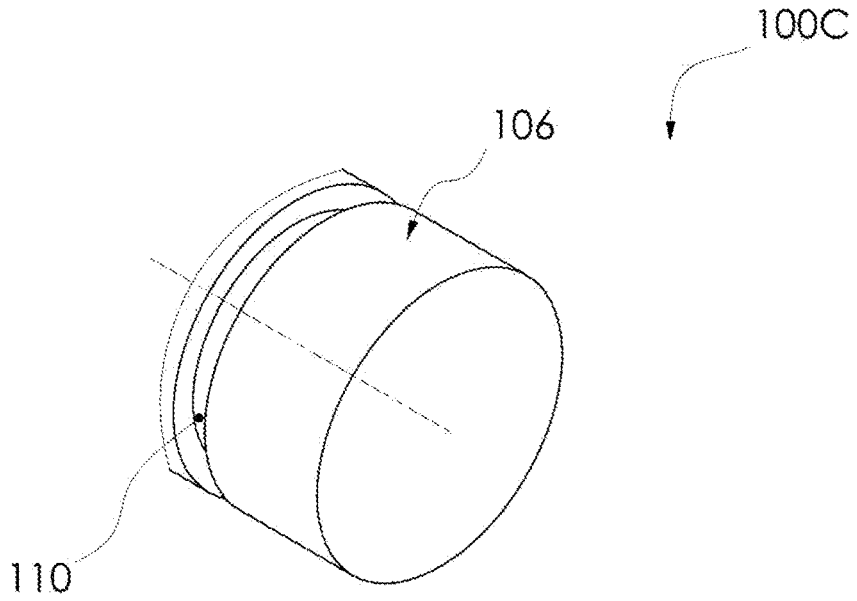

The machine pick 100 may comprise a locking structure 110 (see, for example, FIG. 1C). The locking structure 110 may be set up in such a way that the machine pick 100 may be received form-fittingly in a holding device (e.g. the holding device 300 described herein) by means of a locking device (see, for example, FIG. 2I). The form-fit between the machine pick 100 and the holding device 300 may be set up in such a way that the machine pick 100 is disposed with clearance in the holding device 300 (i.e. their movement relative to one another is limited) or that the machine pick 100 is rigidly connected to the holding device 300.

In the first case, the machine pick 100 may move within the limits of the clearance. For example, a form-fit with clearance may be formed between the shaft 104 of the machine pick 100 and the holding device 300. Clearly, the machine pick 100 may be disposed loose in the holding device 300. The form-fit between the machine pick 100 and the holding device 300 may be formed transverse to the longitudinal axis 107.

In the second case, the machine pick 100, which is rigidly connected to the holding device 300, may not move relative to the holding device 300. Clearly, a movement of the machine pick relative to the holding device 300 may be prevented (i.e. blocked).

The locking structure 110 may comprise one or more than one form-fit profile. Examples of the form-fit profile include: a recess that extends into the shaft 104 (e.g., toward the longitudinal axis), a protrusion that protrudes from the shaft 104 (e.g., away from the longitudinal axis). For example, the locking structure 110 may comprise a circumferential recess (e.g., groove or slot) of the shaft 104 (e.g., extending around the longitudinal axis 107). The locking structure 110 may alternatively or additionally comprise a drilled hole in the shaft 104, or be formed therefrom. The locking structure 110 is described in more detail with reference to the holding device 300 and the excavation device 200. The locking structure 110 may provide the respective form-fit in interaction with a locking device. For example, the interaction of the locking structure 110 with a locking device 202 (see, for example, FIG. 4A) of a first type may enable movement of the machine pick 100 in the holding device 300 within the limits of clearance. In contrast, the interaction of the locking structure 110 with a second type of locking device 402 (see, for example, FIG. 4B) may prevent movement of the machine pick 100 in the holding device 300.

According to various embodiments, the machine pick 100 may comprise a reference element 106 (see, for example, FIG. 1A). The reference element 106 may generally be a body or part of the shaft 104 that is rigidly connected to the shaft 104 (e.g., by material bonding, form-fit and/or force-fit). For example, the reference element 106 may be a reference area (e.g., as a portion) of the shaft 104. For example, the reference element 106 may be a monolithic portion of the shaft 104. Alternatively, the reference element 106 may be embedded in or fixed to the shaft 104, for example screwed, glued or otherwise fixed. For example, the reference element 106 and the shaft 104 may be detachably connected (e.g. screwable or pluggable) or may be brought into a rigidly connected state by means of another form-fit. In some embodiments, the reference element 106 may be an element of rotation with respect to the longitudinal axis 107 (e.g., serving as an axis of rotation). Alternatively, the reference element 106 may be a body or part of the pick head 108 that is rigidly connected to the pick head 108 (e.g. by material bonding, form-fitting and/or force-fitting). For example, the reference element 106 may be an element rigidly connected to the pick head 108, which is embedded in or fixed to the pick head 108, e.g. screwed, glued or otherwise fixed. For example, the reference element 106 and the pick head 108 may be detachably connected to one another (e.g. screwable or pluggable) or may be brought into a rigidly connected state by means of another form-fit.

According to various embodiments, the reference element 106, the shaft 104 and the pick head 108 may be rigidly connected to each other. For example, the pick head 108 may be disposed on a first end face of the shaft 104 and rigidly connected thereto. For example, the reference element 106 may be disposed on a second end face of the shaft 104 opposite the first end face and rigidly connected thereto. According to various embodiments, the reference element 106, the shaft 104 and the pick head 108 may form a body of rotation about the longitudinal axis 107 (e.g. serving as an axis of rotation).

The reference element 106 may comprise at least one (i.e., exactly one or more than one, e.g., two or more, e.g., three or more, etc.) sensor-sensible scale. The sensor-sensible scale is preferably made of at least one magnetizable (e.g. ferromagnetic, antiferromagnetic or ferrimagnetic) material or may at least comprise this. Alternatively or additionally, the sensor-sensible scale may comprise one or more than one optically sensible scale.

The sensor-sensible scale as used herein may, in some embodiments, comprise a magnetic pattern and/or at least one (e.g., exactly one or more than one) magnetic pole. The sensor-sensible scale comprising at least one magnetizable material may comprise one or more permanent magnets and may already form the magnetic pattern and/or may comprise a material that may be magnetized to form the magnetic pattern (e.g. by means of an external permanent magnet, for example as part of the holding device 300 described herein). According to various embodiments, a sensor-sensible scale may comprise a dipole magnet, a diametral magnet, a pole ring and/or a pole rod or be formed therefrom.

A magnetic pattern may be provided, for example, by giving the magnetizable material a structured (e.g. profiled) surface. A structured surface, as used herein, may be understood to be, for example, a regular pattern on the surface of the reference element 106. For example, the reference element 106 may comprise several spatially regularly disposed recesses (e.g. trench, grooves) and/or protrusion (these structures may also be referred to as increments). In this case, the structured surface of the reference element 106 may form the sensor-sensible scale. A sensor-sensible scale provided by a structured surface may also be described as a mechanical material measure. A mechanical material measure may consist of a regular sequence of similar recesses in the material surface. The shape of the recesses may be subordinate in some embodiments, for example, if the spatial mass distribution of the magnetizable material is important. Examples of recesses are grooves with (e.g. rounded) rectangular profiles, v-shaped profiles or round profiles. A recess described herein may also be a (e.g. round) hole. The recesses may optionally be filled (e.g. partially or completely) with non-magnetizable solid material. This may prevent the recesses from filling with other material, such as rubbed-off metallic parts or rock dust, which could lead to incorrect measurements and/or increased wear. According to various embodiments, the sensor-sensible scale or the sensor-sensible scales may be covered by a layer of non-magnetizable material (e.g. thin compared to the diameter of the reference element 106). As a result, the pattern as such may, for example, be barely or not at all recognizable to the (human) eye.

Exemplary implementations of the magnetic pattern are explained below. For example, a magnetizable (e.g. ferromagnetic, ferrimagnetic and/or antiferromagnetic) material and a paramagnetic material may alternate to form the pattern (e.g. in the form of strips). For example, a first magnetizable (e.g. ferromagnetic, ferrimagnetic antiferromagnetic) material and a second magnetizable (e.g. ferromagnetic, ferrimagnetic antiferromagnetic) material may alternate to form the pattern (e.g. in the form of strips). The first magnetizable material and the second magnetizable material may comprise a different remanence and/or saturation magnetization. The magnetic pattern may form a magnetic material measure.

More generally speaking, the (e.g. mechanical and/or magnetic) material measure of a sensor-sensible scale may be characterized by means of a geometry (e.g. a distance) of the scale elements (e.g. the recesses relative to each other or the magnetic pattern) and/or the magnetizable material.

A sensor-sensible scale may be disposed externally or within an internal cavity or within the shaft 104. Various arrangements of external sensor-sensible scales are described with reference to FIG. 1D to FIG. 1H. An illustration of an internal sensor-sensible scale is shown in FIG. 2L and FIG. 2M.

More detailed implementations of the reference element 106 or the sensor-sensible scale are explained below.

Figure 1D:
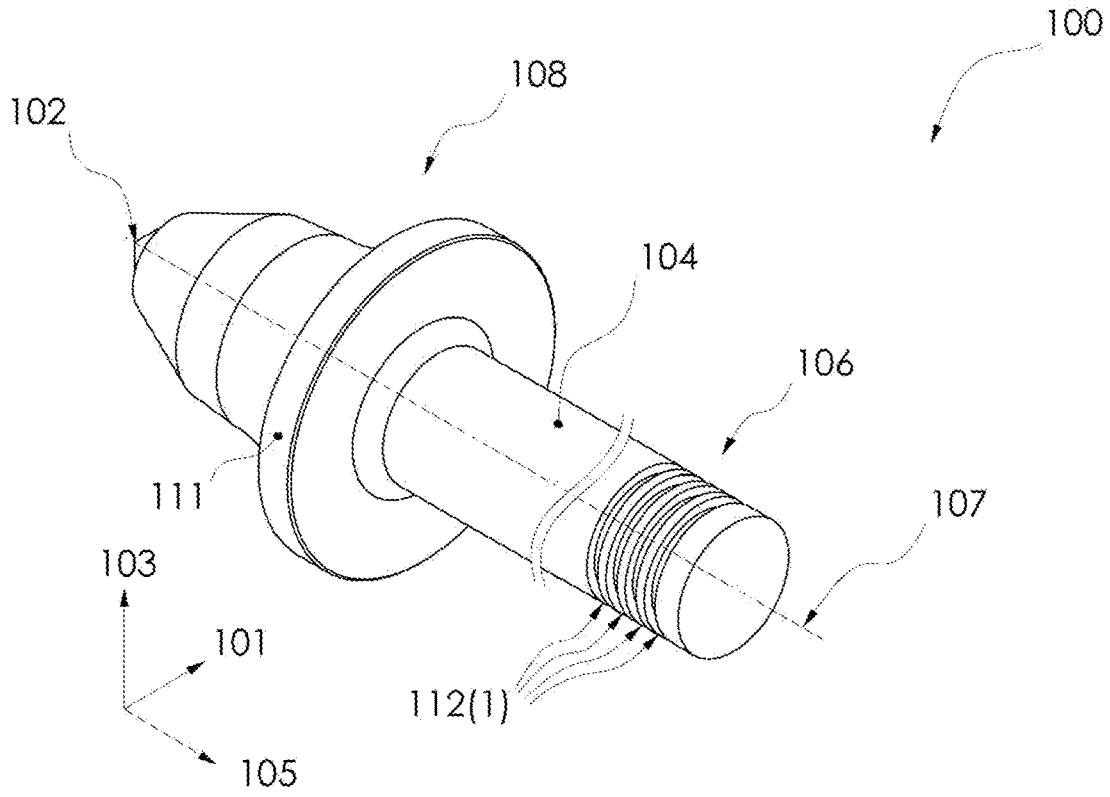
Figure 1D:
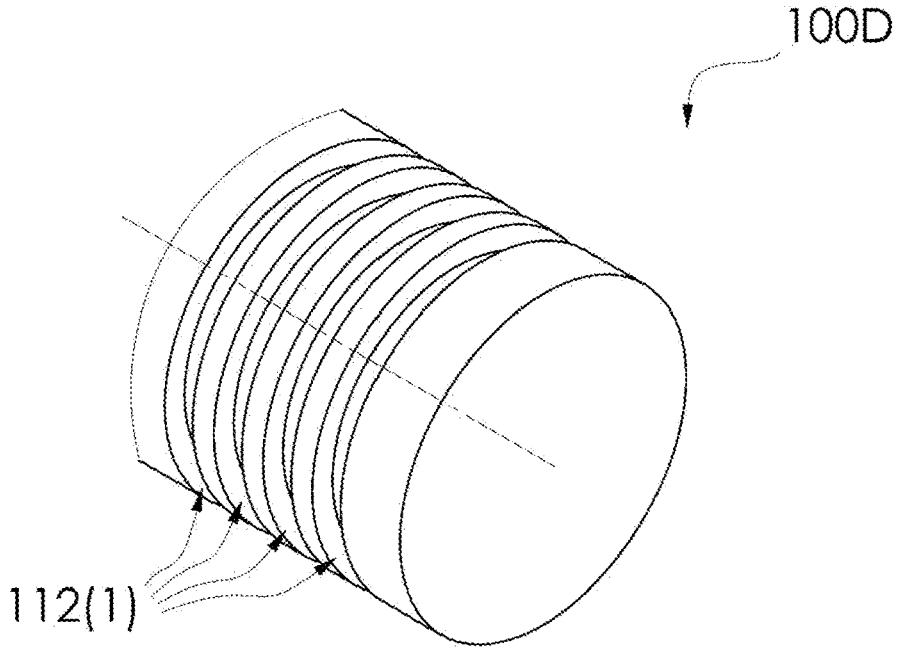

FIG. 1D shows a first sensor-sensible scale 112(1) according to various embodiments. The first sensor-sensible scale 112(1) may comprise elongated structures (e.g., profiles) along a respective closed path. For example, the elongate structures (e.g., protrusions) may comprise a magnetizable material comprising a remanence and/or saturation magnetization different from the regions located between the elongate structures. Optionally, the material disposed between the protrusions may be paramagnetic.

For example, the first sensor-sensible scale 112(1) may comprise a plurality of recesses, each recess being disposed between two elongate protrusions. Each of the plurality of recesses may extend along a closed path around the longitudinal axis 107. The path may extend along a surface (e.g. lateral surface) of the reference element 106. Each recess may, for example, extend towards the longitudinal axis 107 into the reference element 106 (e.g. its lateral surface). Each recess may form a closed and/or circumferential trench around the longitudinal axis 107.

According to various embodiments, each of the plurality of recesses of the first sensor-sensible scale 112(1) may form a trench extending along the closed path. The distance between the recesses (e.g., in the direction 105) and/or the extent (e.g., width or breadth) of a respective recess of the plurality of recesses may form the first sensor-sensible scale 112(1). For example, the distance between the recesses and/or the extent of a respective recess may span a dimension of the sensor-sensible scale. For example, each protrusion may form a magnetic pole of the first sensor-sensible scale 112(1).

Figure 1E:
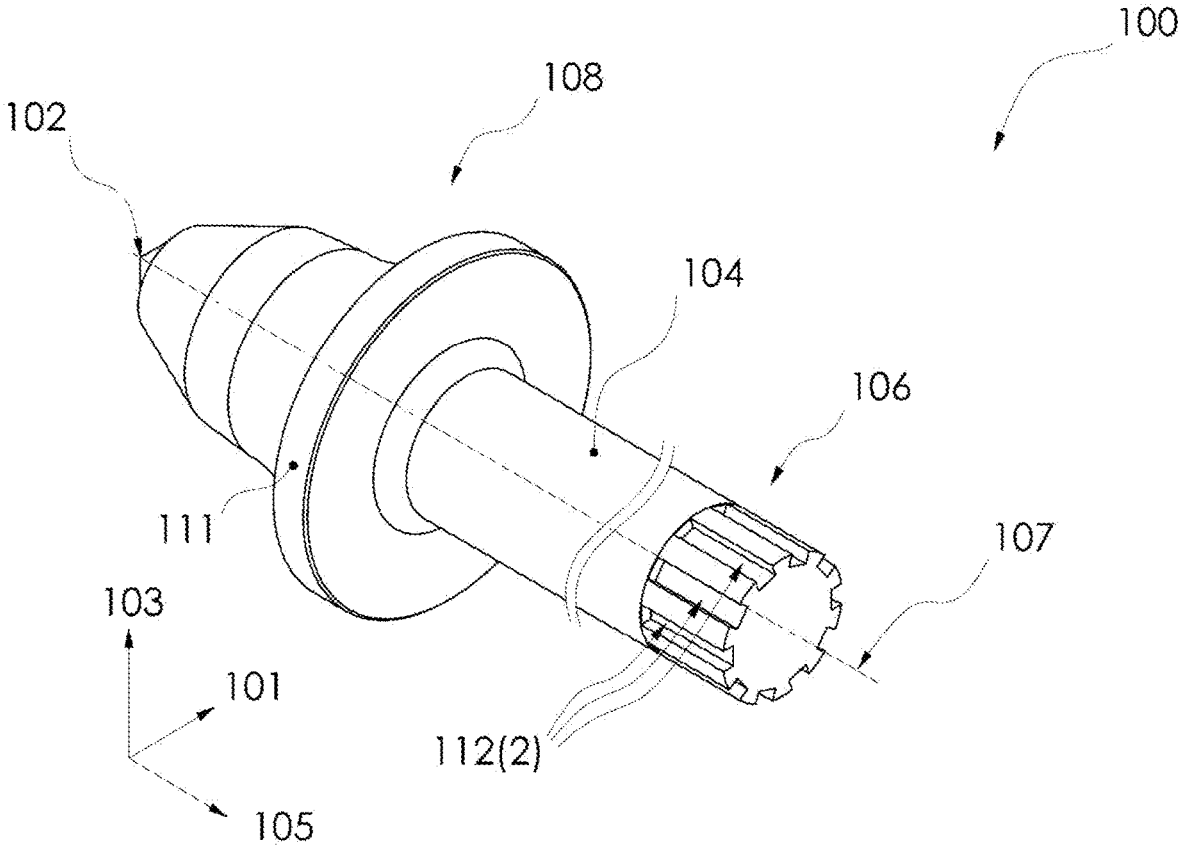
Figure 1E:
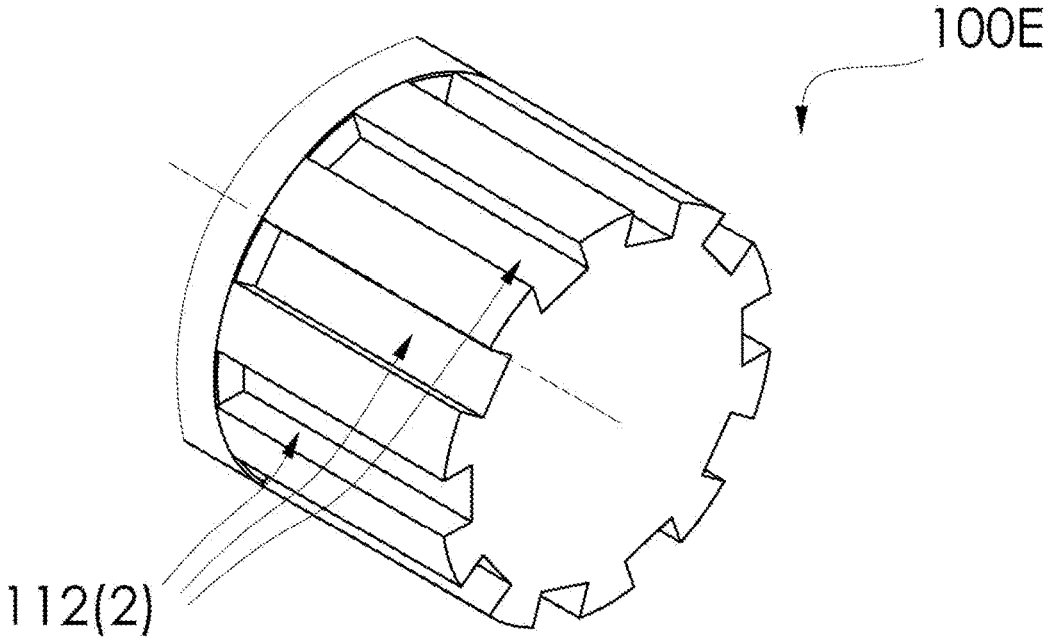

FIG. 1E shows a second sensor-sensible scale 112(2) according to various embodiments. The second sensor-sensible scale 112(2) may comprise elongated structures (e.g., profiles) that extend along a surface (e.g., lateral surface) of the reference element 106 substantially parallel to the longitudinal axis 107 (e.g., in the direction 105). For example, the longitudinal extent of each of the structures may lie substantially in the plane spanned by the directions 103 and 105. Optionally, the elongate structures may be curved along the surface of the reference element. The elongate structures may comprise a magnetizable material having a remanence and/or saturation magnetization different from the regions lying between the elongate structures, or wherein the intervening material is paramagnetic. The second sensor-sensible scale 112(2) may comprise a plurality of recesses. Each of the plurality of recesses of the second sensor-sensible scale 112(2) may extend longitudinally toward the shaft 104 (e.g., in the direction 105). Alternatively or additionally, two adjacent recesses of the plurality of recesses of the second sensor-sensible scale 112(2) may comprise a distance to each other that is transverse to the longitudinal axis 107 of the machine pick 100. According to various embodiments, each of the plurality of recesses of the second sensor-sensible scale 112(2) may form a trench extending along the longitudinal axis 107 (e.g., toward the pick tip 102). The distance between the recesses (e.g., in the circumferential direction of the reference element 106) and/or the extent (e.g., a width) of a respective recess of the plurality of recesses may form the second sensor-sensible scale 112(2). For example, the distance between the recesses of the second sensor-sensible scale 112(2) and/or the extent of a respective recess may span a dimension of the sensor-sensible scale. For example, the protrusions of the second sensor-sensible scale 112(2) may form respective magnetic poles of the second sensor-sensible scale 112(2).

According to various embodiments, the plurality of recesses of the first sensor-sensible scale 112(1) and the plurality of recesses of the second sensor-sensible scale 112(2) may be aligned at an angle (or perpendicular) to each other.

Figure 1F:
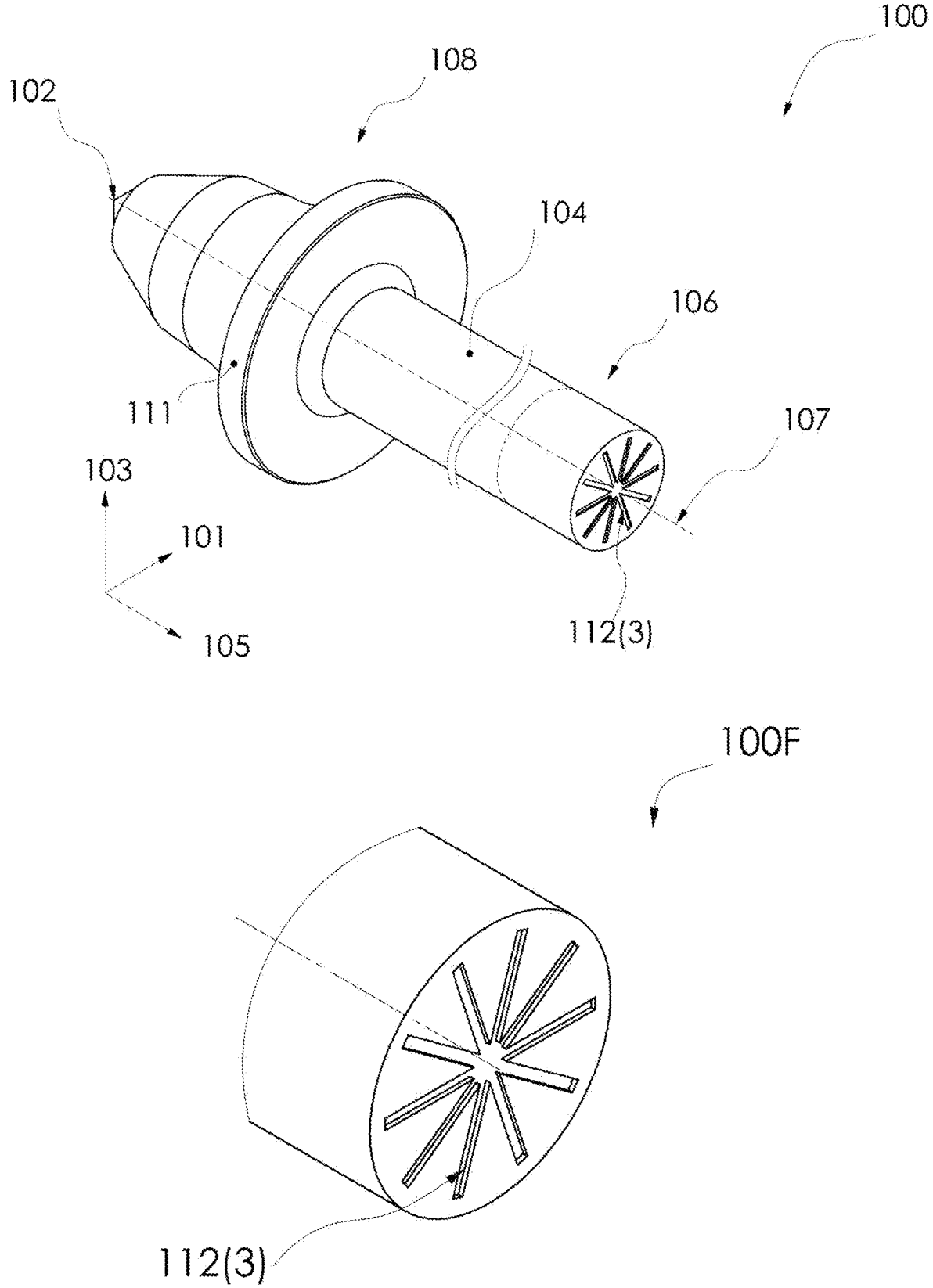
Figure 1G:
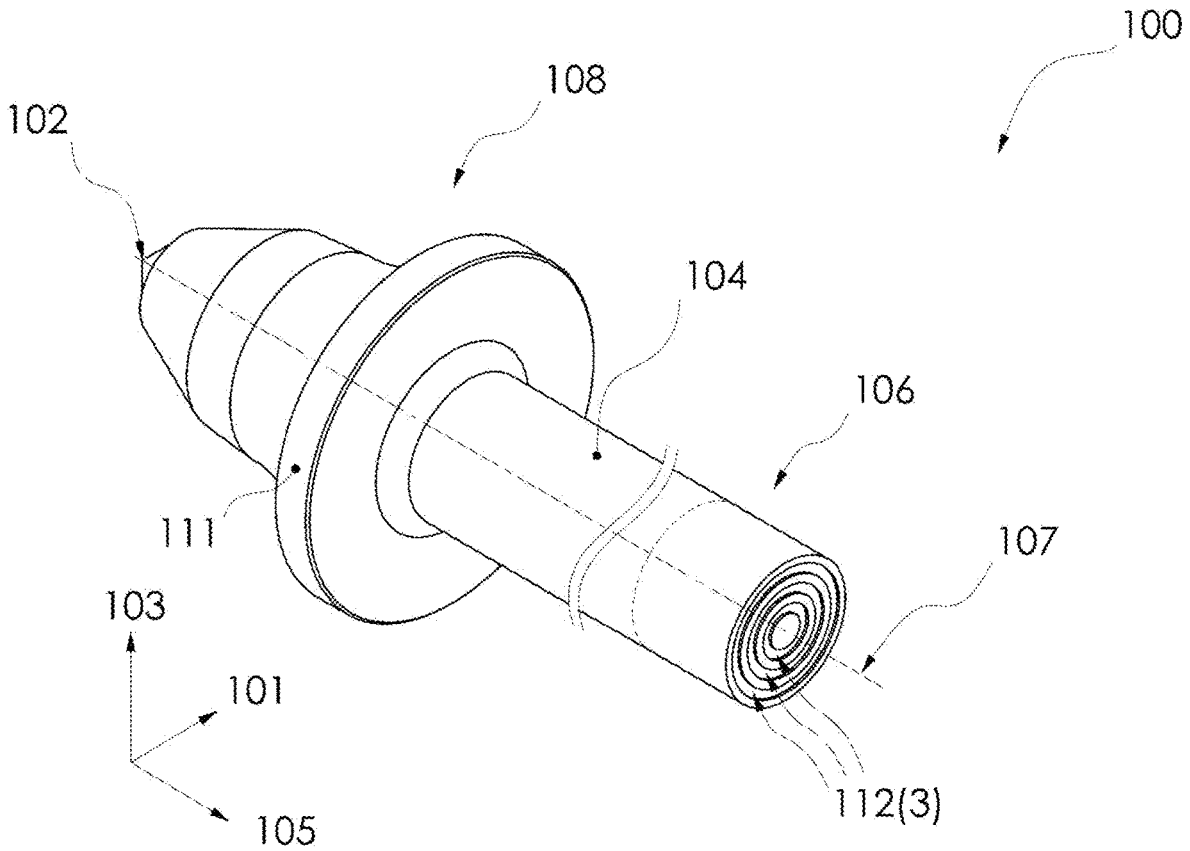
Figure 1G:
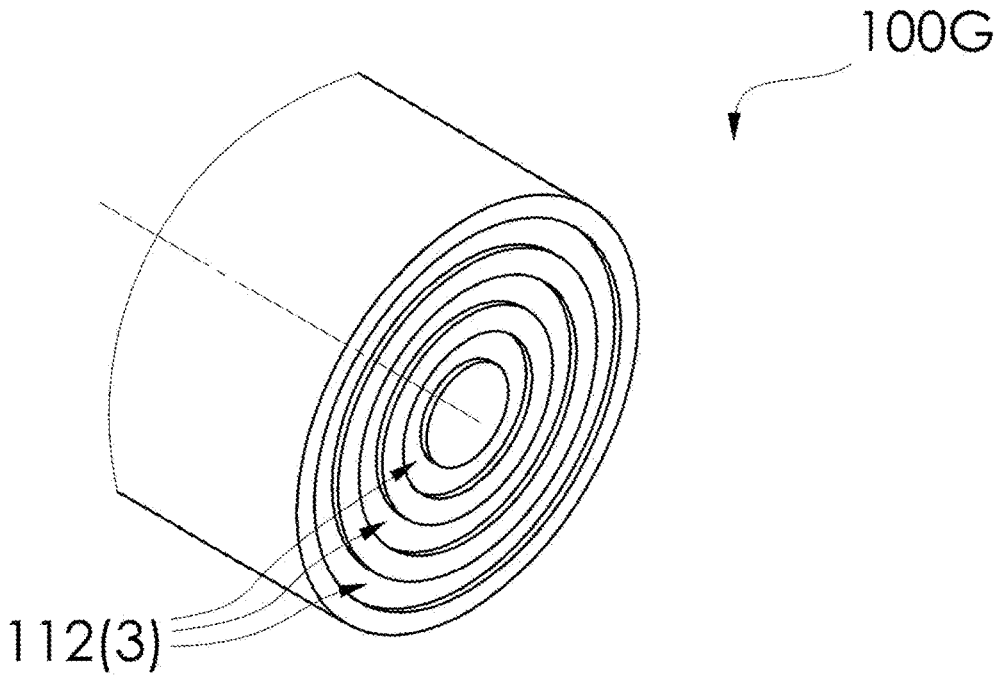

FIG. 1F and FIG. 1G each show an arrangement of a third sensor-sensible scale 112(3) according to different embodiments. The third sensor-sensible scale 112(3) may be disposed on a side of the reference element 106 that faces away from the shaft 104. With reference to FIG. 1F, the third sensor-sensible scale 112(3) may comprise a ray-like pattern. As described above, the ray-like pattern may be formed by means of a magnetizable material of different remanence and/or saturation magnetization or an intermediate paramagnetic material and/or the ray-like pattern may be formed by means of a plurality of recesses. For example, the third sensor-sensible scale may comprise several ray-like recesses (or other profiles). Each of the plurality of ray-shaped recesses may extend toward the longitudinal axis 107. With reference to FIG. 1G, the third sensor-sensible scale 112(3) may comprise a concentric pattern. The concentric pattern may be formed using a magnetizable material of different remanence and/or saturation magnetization and/or an intermediate paramagnetic material, and/or the concentric pattern may be formed using a plurality of recesses. For example, the third sensor-sensible scale 112(3) may comprise a plurality of concentrically aligned recesses (or other profiles). Each of the plurality of concentrically aligned recesses may extend around the longitudinal axis 107.

According to various embodiments, each of the plurality of (ray-shaped or concentric) recesses of the third sensor-sensible scale 112(3) may form a trench. The arrangement of the recesses (e.g., an angle between the rays of the ray-shaped recesses and/or a distance between the concentric recesses) and/or the extent (e.g., a width or breadth) of a respective recess of the plurality of recesses may form the third sensor-sensible scale 112(3). For example, the distance between the recesses of the third sensor-sensible scale 112(3) and/or the extent of a respective recess may span a dimension of the sensor-sensible scale transverse to the longitudinal axis 107.

According to various embodiments, the third sensor-sensible scale 112(3) may comprise both the ray-shaped pattern and the concentric pattern.

Each sensor-sensible scale may be set up in such a way that a translation and/or a turning (e.g. a rotation) of the machine pick 100 may be sensed in connection with a sensor. Axial, rotational and/or lateral movements of the machine pick 100 may be sensed. As described above, the machine pick 100 may move within the limits of the clearance in the holding device 300.

For example, the first sensor-sensible scale 112(1) may enable to sense a translation of the machine pick 100 (e.g., translation of the shaft 104) along the longitudinal axis (e.g., in the direction 105) and/or a rotation of the machine pick 100 (e.g., rotation of the shaft 104) about an axis that is perpendicular to the longitudinal axis 107, e.g., independent of a rotation of the machine pick 100 about the longitudinal axis 107.

For example, the second sensor-sensible scale 112(2) may enable to sense a translation of the machine pick 100 (e.g., translation of the shaft 104) along an axis that is transverse to the longitudinal axis (e.g., in the direction 101) and/or a rotation of the machine pick 100 (e.g., rotation of the shaft 104) about the longitudinal axis 107, e.g., independent of a translation of the machine pick 100 along the longitudinal axis 107.

For example, the third sensor-sensible scale 112(3) may enable to sense a translation of the machine pick 100 (e.g., translation of the shaft 104) transverse and/or parallel to the longitudinal axis. For example, the third sensor-sensible scale 112(3) may enable to sense a rotation of the machine pick 100 about an axis that is perpendicular to the longitudinal axis 107 and/or about the longitudinal axis (e.g., in the case of a ray-shaped pattern).

According to various embodiments, the machine pick 100 may comprise a plurality of sensor-sensible scales. For example, at least one sensor-sensible scale may comprise the first sensor-sensible scale 112(1), the second sensor-sensible scale 112(2), and/or the third sensor-sensible scale 112(3). It will be understood that the sensor-sensible scales described herein are merely exemplary and that other patterns may be used for the sensor-sensible scales, provided that at least one translation and/or at least one rotation (e.g., rotation) of the machine pick 100 may be sensed by means thereof.

Figure 1H:
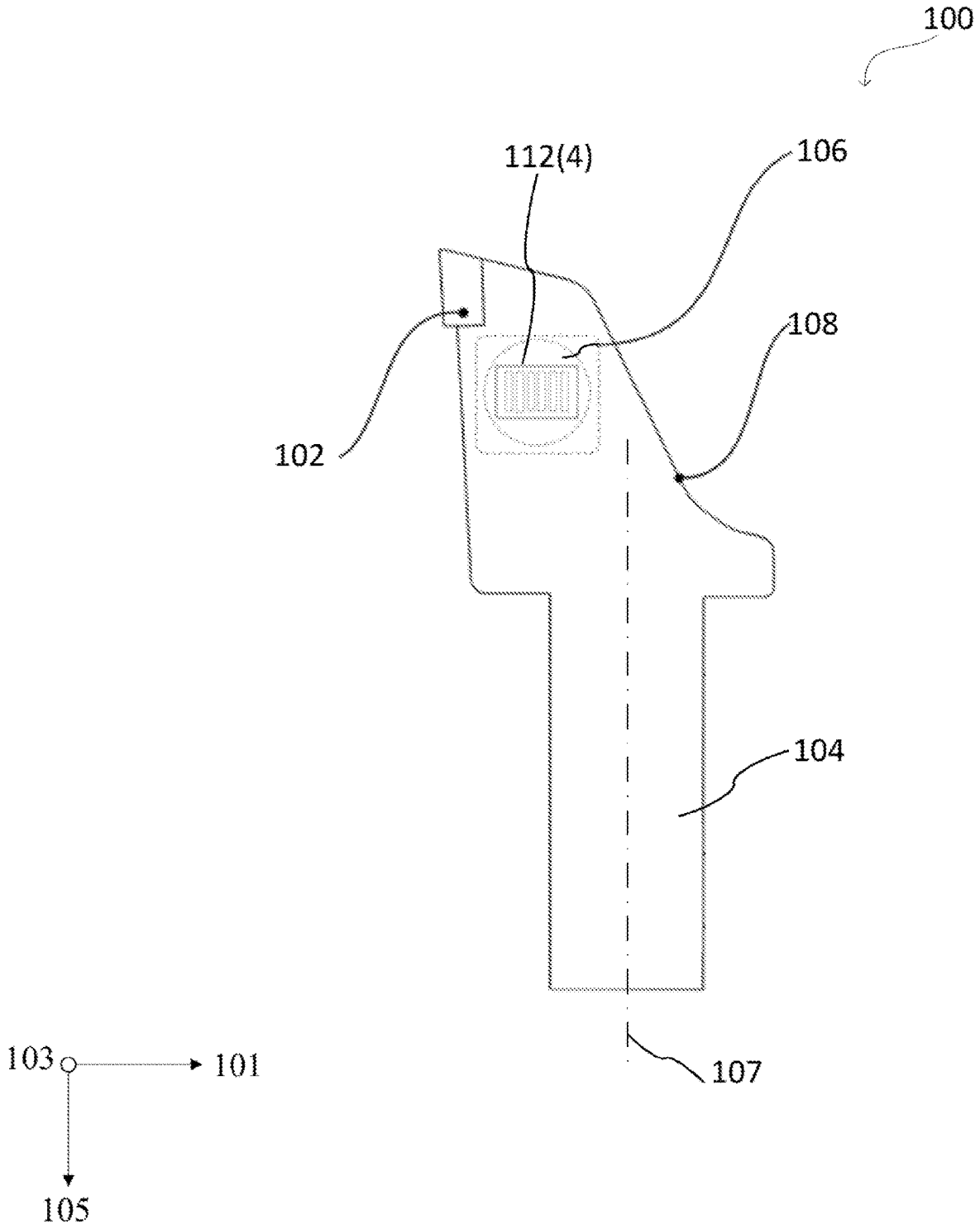

According to various embodiments, the reference element 106 may be an element rigidly connected to the pick head 108 or part of the pick head 108. A machine pick 100 in this regard according to various embodiments is shown in FIG. 1H. In these embodiments, the shaft 104 may preferably have a rectangular or trapezoidal cross-section, for example when the machine pick 100 is a radial pick. The reference element 106 may comprise a fourth sensor-sensible scale 112(4). The fourth sensor-sensible scale 112(4) may comprise elongated structures similar to the second sensor-sensible scale 112(2), which extend along a surface of the reference element 106 (e.g. a surface of the pick head 108). The fourth sensor-sensible scale 112(4) is described in more detail with reference to FIG. 4B.

Figure 2A:
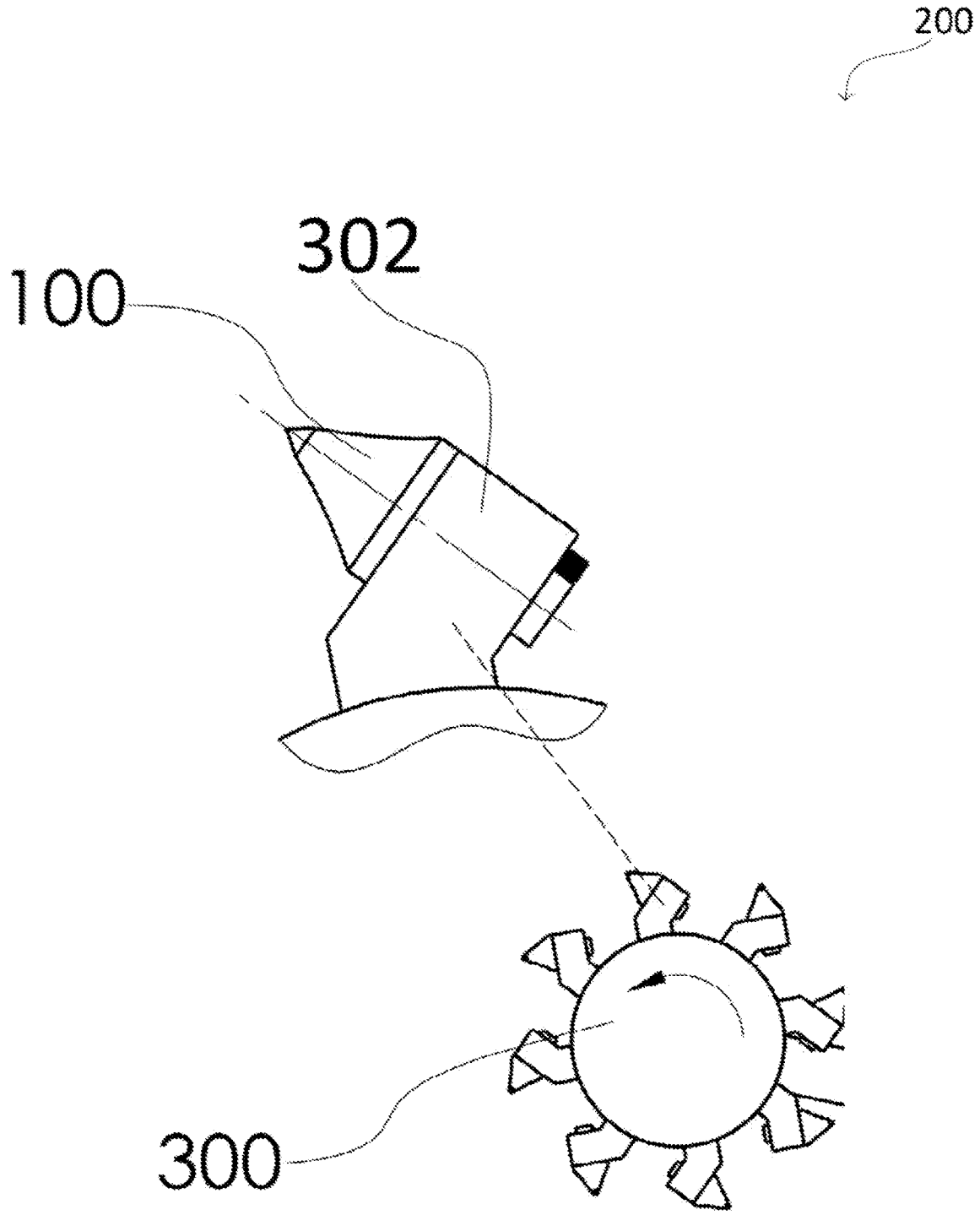
FIG. 2A shows an excavation device 200 consisting of a machine pick 100 and a holding device 300 according to various embodiments.
Figure 2B:
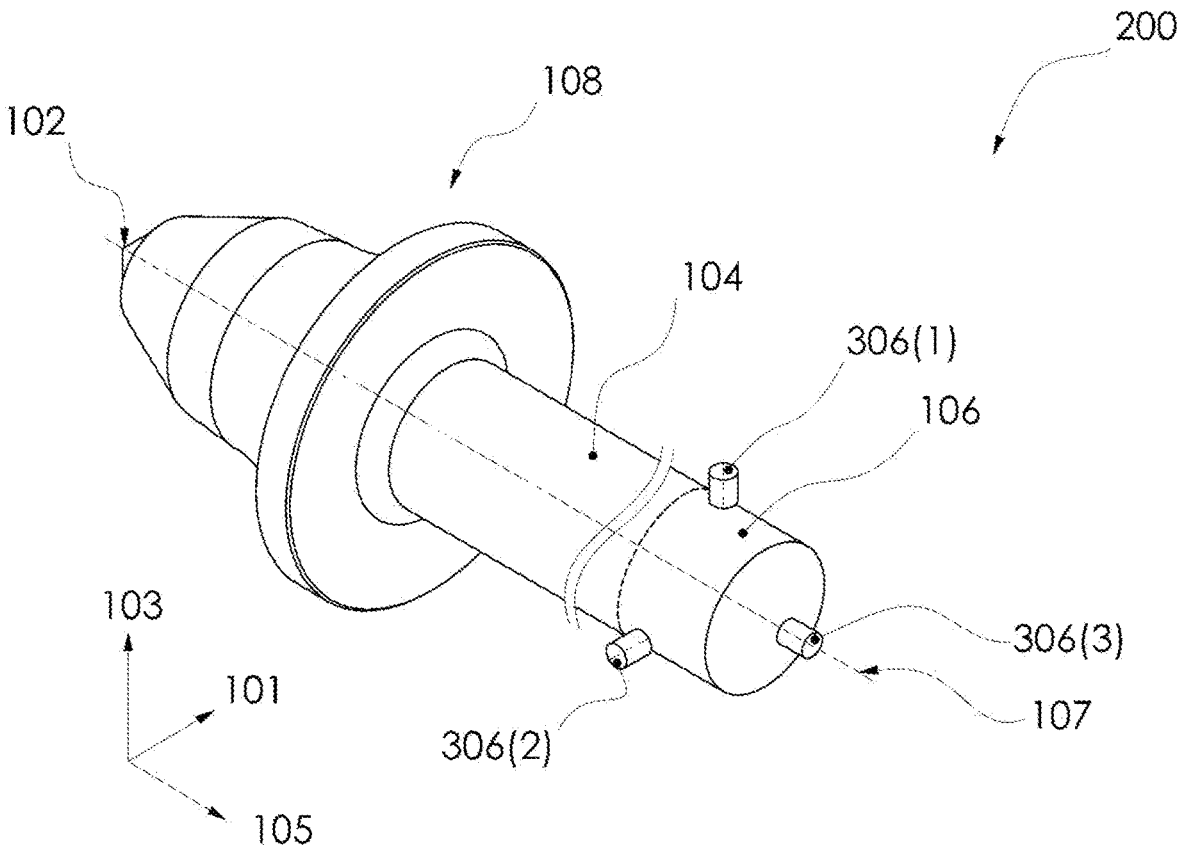
FIGS. 2B to 2U each show different components of the excavation device 200 shown in FIG. 2A according to various embodiments, which naturally may also be provided as an individual assembly separately from the excavation device 200.

FIG. 2A shows an excavation device 200 according to various embodiments, which may comprise the machine pick 100 and the holding device 300. FIG. 2B to FIG. 2U each show at least individual components of an excavation device 200 according to various embodiments. The excavation device 200 may comprise the machine pick 100. The excavation device 200 may further comprise a holding device 300 (see also the description of FIG. 3A to FIG. 3D and FIG. 4A). The holding device 300 may be a conical pick holder, which is set up to receive a conical pick (e.g. with clearance). Here, the machine pick 100 may be, for example, a conical pick as shown in FIG. 1A to FIG. 1G. Alternatively, the holding device 300 may be a radial pick holder that is set up to receive a radial pick (e.g. without clearance, i.e. rigid). In this case, the machine pick 100 may be, for example, a radial pick as shown in FIG. 1H.

The holding device 300 may comprise one or more sensors 306($n$=1 to N) (e.g., exactly one sensor or more than one sensor). A number, N, of sensors may be any integer greater than or equal to "1".

FIG. 2B shows an exemplary arrangement of several sensors. A first sensor 306(1), a second sensor 306(2) and a third sensor 306(3) are shown as examples. Each sensor 306($n$) of one or more sensors 306($n$=1 to N) may be set up to sense a sensor-sensible scale associated with the sensor. Each sensor-sensible scale may be sensed by means of one or more sensors.

According to various embodiments, at least one (e.g., each) sensor 306($n$) of one or more sensors 306($n$=1 to N) may be set up to sense the associated sensor-sensible scale without contact. This may, for example, reduce (e.g. prevent) wear of the sensors and/or improve the quality of the measured values.

According to various embodiments, the reference element 106 may comprise the first sensor-sensible scale 112(1), the second sensor-sensible scale 112(2) and the third sensor-sensible scale 112(3). The holding device 300 may comprise the first sensor 306(1), which may be set up to sense the first sensor-sensible scale 112(1). The holding device 300 may comprise the second sensor 306(2), which may be set up to sense the second sensor-sensible scale 112(2). The holding device 300 may comprise the third sensor 306(3), which may be set up to sense the third sensor-sensible scale 112(3). According to various embodiments, the holding device 300 may comprise a plurality of first sensors set up to sense the first sensor-sensible scale 112(1). For example, the plurality of first sensors may be spaced apart and/or oriented at an angle to each other (e.g., perpendicular to each other). For example, the holding device 300 may comprise four first sensors 306(1) for detecting the first sensor-sensible scale 112(1). According to various embodiments, the holding device 300 may comprise a plurality of second sensors set up to sense the second sensor-sensible scale 112(2). For example, the plurality of second sensors may be disposed at an angle to each other (e.g., perpendicular to each other). For example, the holding device 300 may comprise four second sensors 306(2) for sensing the second sensor-sensible scale 112(2). According to various embodiments, the holding device 300 may comprise a plurality of third sensors set up to sense the third sensor-sensible scale 112(3).

At least one (e.g., each) sensor 306(*n*) of one or more sensors 306(*n*=1 to N) may be set up to sense a field emitted by the reference element 106 (e.g., a magnetic field and/or an electric field) and/or a field influenced by the reference element 106. A sensor described herein may also be a displacement sensor or a distance sensor.

As described herein, one or more sensors 306(*n*=1 to N) may be set up to sense a translation of the machine pick 100 parallel to the longitudinal axis 107, a translation of the machine pick 100 transverse to the longitudinal axis 107, a rotation of the machine pick 100 about the longitudinal axis 107, and/or a rotation of the machine pick 100 perpendicular to the longitudinal axis 107. The sensor-sensible scale or the sensor-sensible scales of the machine pick 100 may be set up in such a way that the respective translation and/or rotation may be sensed by means of one or more sensors 306(*n*=1 to N). Clearly, the sensor-sensible scale of the machine pick 100 and one or more sensors 306(*n*=1 to N) of the holding device 300 may be matched to one another.

According to various embodiments, a sensor 306(*n*) of one or more sensors 306(*n*=1 to N) may be set up to sense a distance of the reference element 106 from the sensor 306(*n*). A sensor 306(*n*) of one or more sensors 306(*n*=1 to N) may be set up to sense a distance (e.g., an amplitude) by which the reference element 106 moves relative to the sensor 306(*n*) (e.g., relative to the holding device 300, e.g., relative to the pick holder 302). A sensor 306(*n*) of one or more sensors 306(*n*=1 to N) may be set up to sense a frequency at which the reference element 106 moves (e.g., a frequency of a translation and/or a frequency of a rotation).

According to various embodiments, the respective sensor may be set up in such a way that the frequency at which the reference element 106 moves during the respective material excavation process may be sensed. For example, the cutting of a rock may lead to vibration frequencies in a range from about 0.5 kHz to about 8 KHz, influenced additionally by the thrust force of the excavation system against the rock and by the relative speed of the excavation system with respect to the rock body during the cutting process. For example, the sensor may have a sampling rate in a range from about 5 kHz to about 10 KHz, from about 15 kHz to about 20 kHz or even greater than about 20 KHz.

A sensor 306(*n*) of one or more sensors 306(*n*=1 to N) may be a magnetoresistive sensor, a Hall sensor, a capacitive sensor or an inductive sensor (e.g. an eddy current sensor). For example, the reference element 106 may be formed from an electrically conductive material that enables detection by means of an eddy current sensor. According to various embodiments, the sensor-sensible scale or scales may be sensed by means of sensors of different sensor types (e.g. one or more magnetoresistive sensors, one or more Hall sensors, one or more capacitive sensors and/or one or more inductive sensors). An example of magnetic sensors (e.g. magnetoresistive sensors and/or Hall sensors) is shown in FIG. 2J. Here, the first sensor-sensible scale 112(1), the second sensor-sensible scale 112(2) and the third sensor-sensible scale 112(3) do not necessarily have to be provided by means of recesses, but these may alternatively or additionally be provided by means of a respective permanent magnetic pole. An example of capacitive and/or inductive sensors (e.g. an eddy current sensor) is shown in FIG. 2K.

Sensing the movement directly on the machine pick 100 (e.g. the reference element) enables a significantly better resolution in contrast to sensing movements or vibrations of the overall system, since in the latter procedure additional vibration influences may be added to those due to material properties. Clearly, the movements that are (almost) exclusively caused by the interaction of the machine pick 100 with the material to be excavated may be sensed directly on the machine pick 100.

Figure 2C:
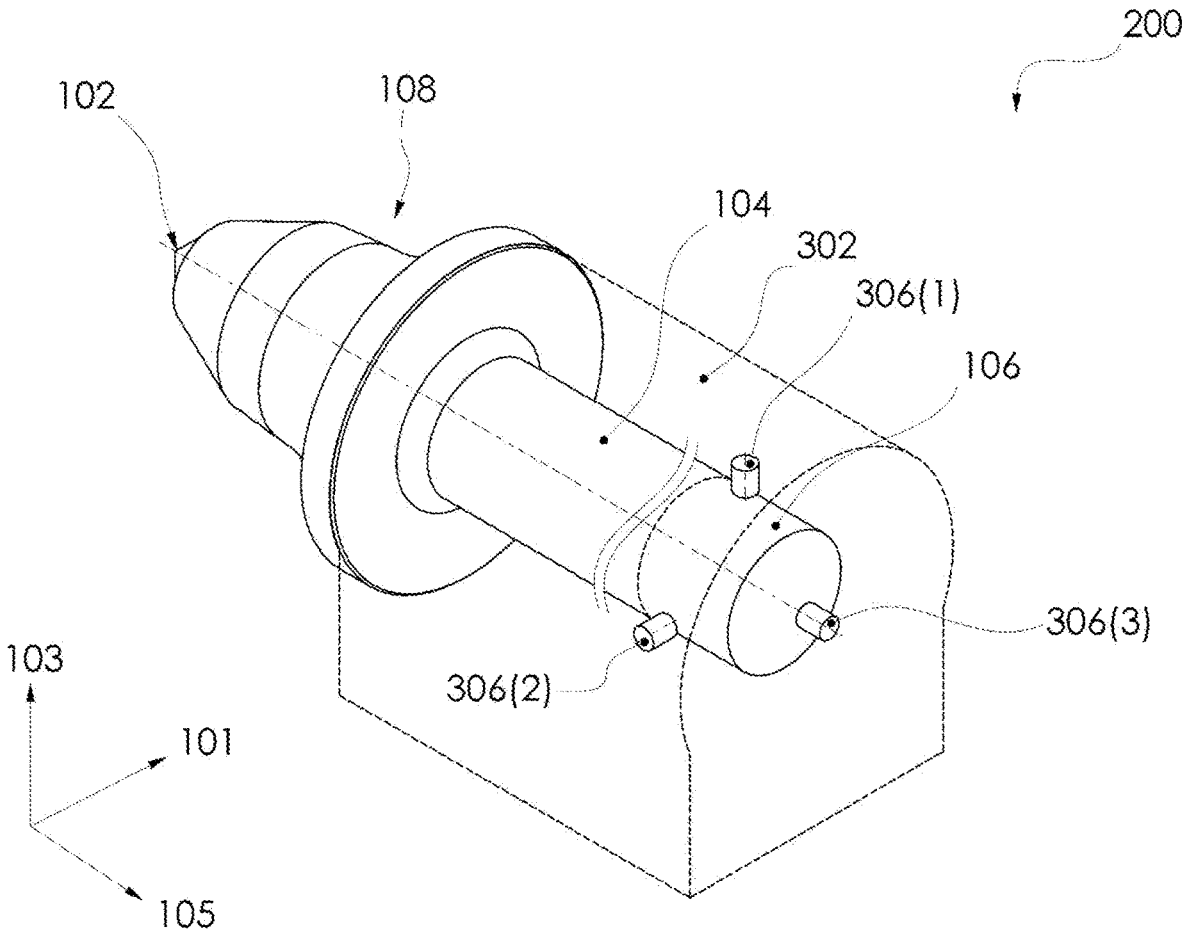

With reference to FIG. 2C, the holding device 300 may comprise a pick holder 302. The pick holder 302 may comprise an opening 316 (see, for example, FIG. 3A through FIG. 3C). The opening 316 may be set up to receive a machine pick, such as the machine pick 100. The holding device 300 may comprise a first receptacle area 320 (e.g., comprising a cavity). The first receptacle area 320 may be exposed towards the opening 316. For example, the first receptacle area 320 may be disposed along the longitudinal axis 107 behind the opening 316. For example, the first receptacle area 320 may be circular cylindrical or cuboidal in shape. The first receptacle area 320 may be set up to receive at least a portion of the reference element 106. The holding device 300 may alternatively or additionally comprise a second receptacle area 324 (e.g. comprising a cavity). The second receptacle area 324 may be exposed towards the opening 316. The second receptacle area 324 may, for example, be disposed along the longitudinal axis 107. The second receptacle area 324 may, for example, be circularly cylindrical. The second receptacle area 324 may be set up to receive at least a portion of the shaft 104 (e.g., substantially the entire shaft 104). The first receptacle area 320 and the second receptacle area 324 may comprise a common cavity (see, for example, FIG. 3A).

One or more sensors 306(*n*=1 to N) may be disposed within (e.g., attached to) the pick holder 302. One or more sensors 306(*n*=1 to N) may be disposed at the first receptacle area 320 of the holding device 300. According to various embodiments, at least one (e.g., each) sensor 306(*n*) of one or more sensors 306(1 (n (N) may be set up to contactlessly sense a (respective) associated sensor-sensible scale. A gap may be disposed between the respective sensor 306(*n*) and the associated sensor-sensible scale. Optionally, it may be detected whether there is clogging within the gap.

Figure 2D:
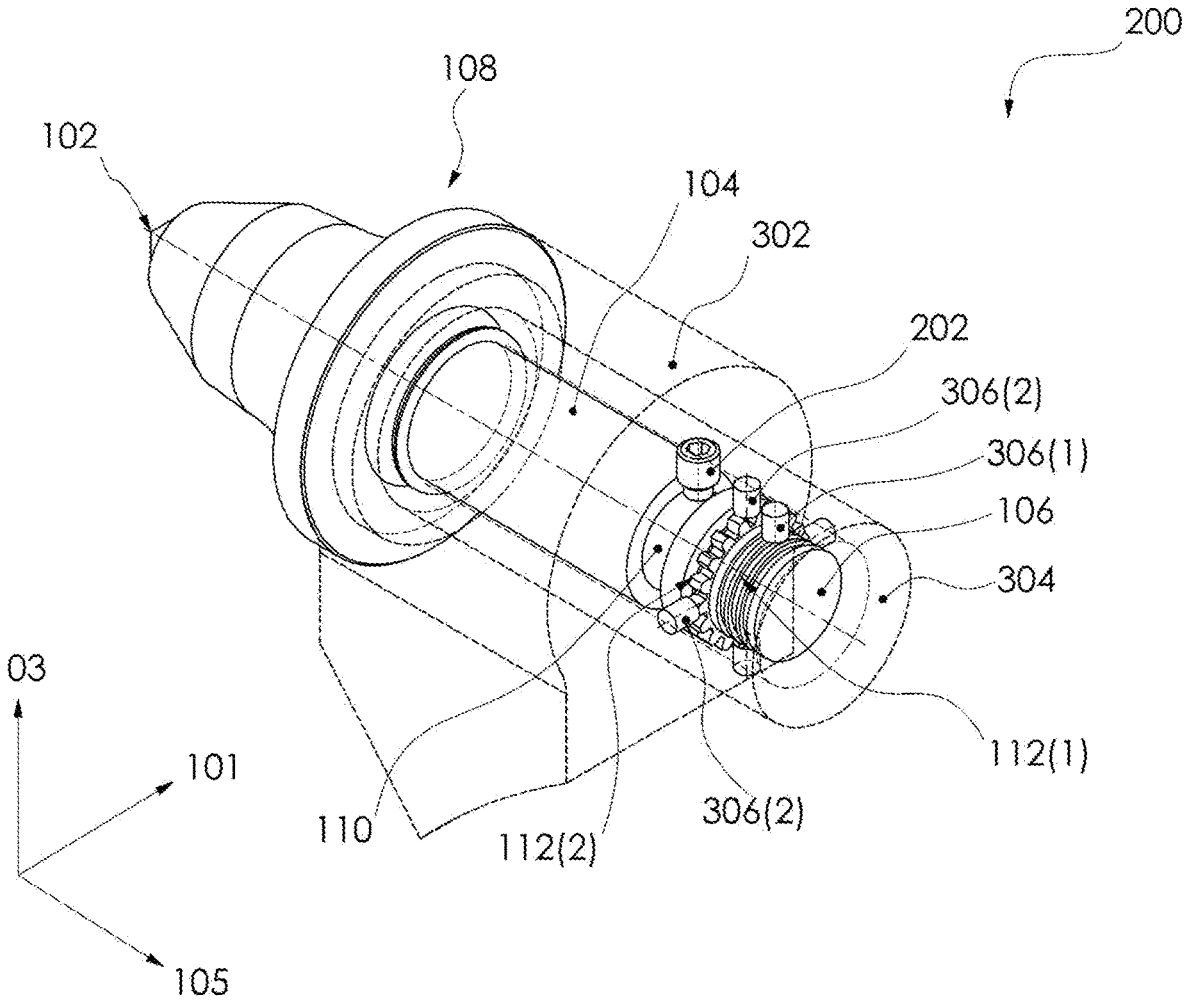
Figure 2E:
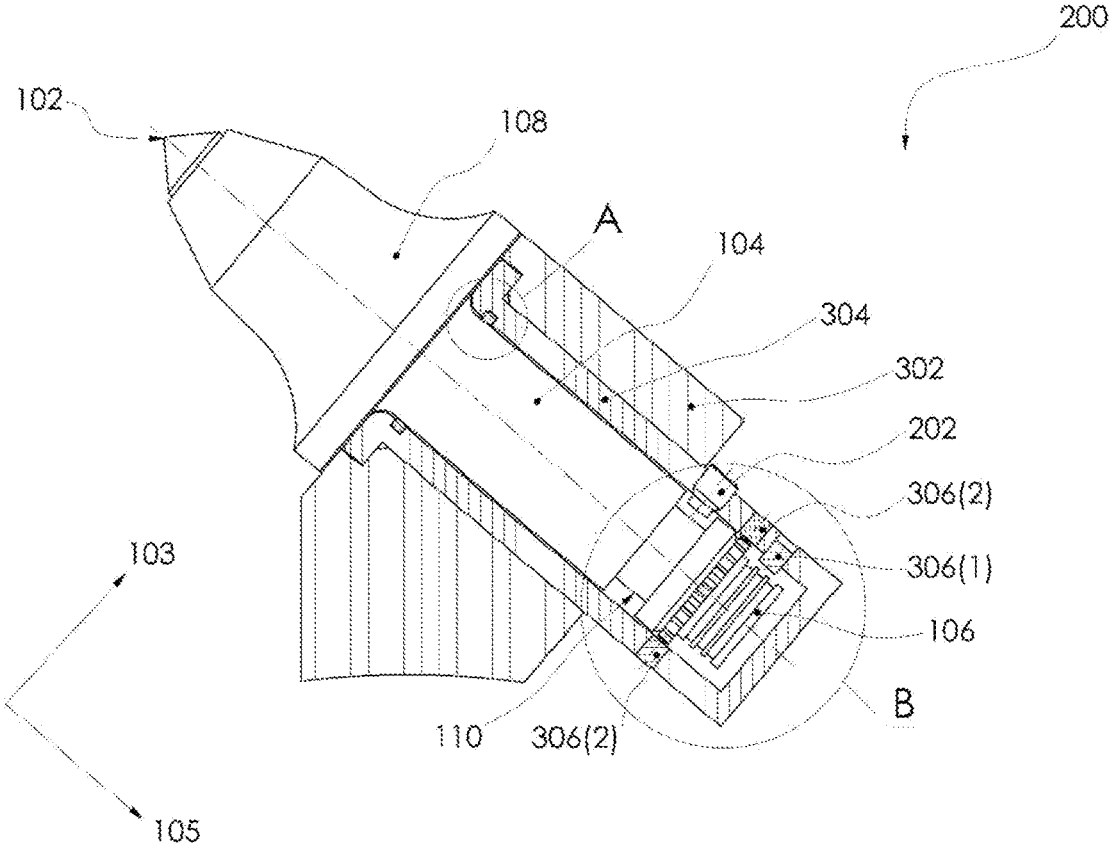
Figure 2F:
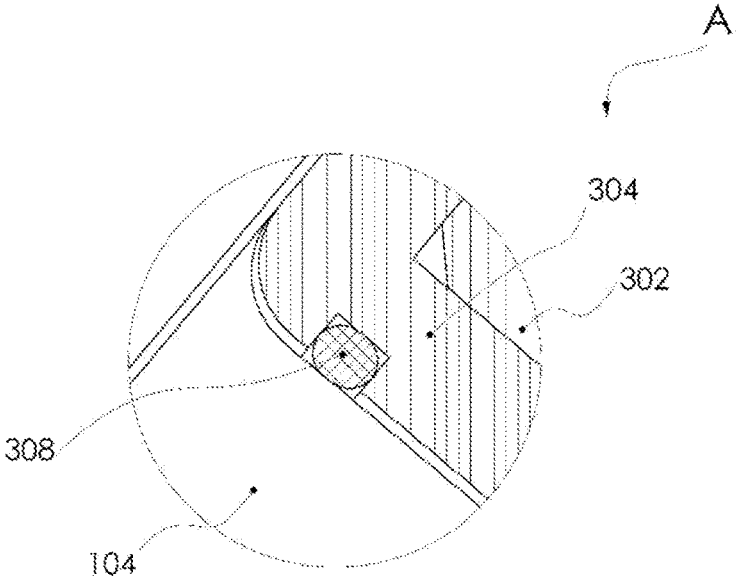
Figure 2G:
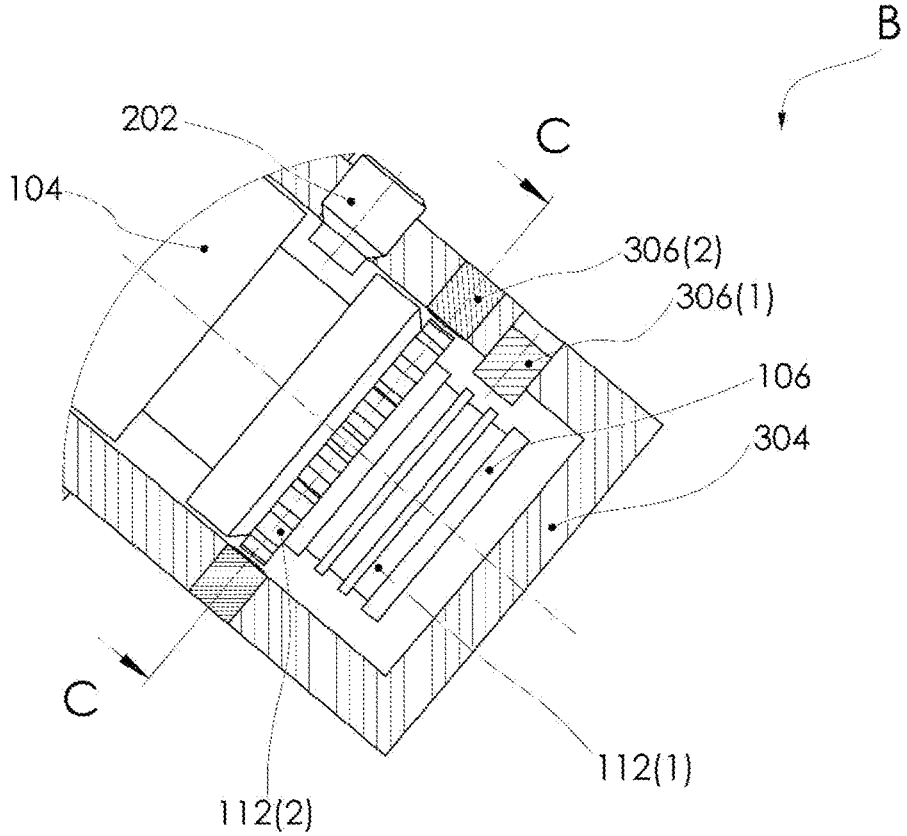
Figure 2H:
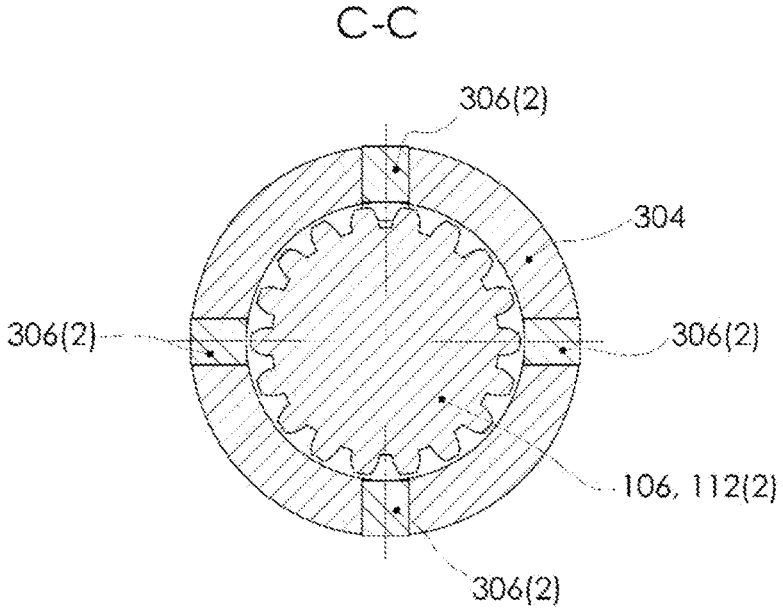

FIG. 2D shows an excavation device 200 with exemplary embodiments of the machine pick 100 and the holding device 300 according to various embodiments. FIG. 2E shows a cross-sectional view of the excavation device 200 shown in FIG. 2D. FIG. 2F and FIG. 2G show enlarged sections of the cross-sectional view and FIG. 2H shows a sectional view with respect to FIG. 2G.

For example, the machine pick 100 may comprise the first sensor-sensible scale 112(1). In this embodiment, the first sensor-sensible scale 112(1) may comprise the plurality of recesses, each forming a closed path around the longitudinal axis 107. For example, the machine pick 100 may comprise the second sensor-sensible scale 112(2). In this embodiment, the second sensor-sensible scale 112(2) may comprise the plurality of recesses, each of which is disposed parallel to the longitudinal axis 107. Clearly, the reference element 106 may comprise a gear-shaped portion forming the second sensor-sensible scale 112(2). The holding device 300 may comprise four second sensors 306(2) disposed perpendicularly (approximately) 90° to each other (see, for example, FIG. 2H).

The holding device 300 may comprise a pick bushing 304. The pick bushing 304 may comprise a greater hardness than the pick holder 302. The pick bushing 304 may be in one piece or in multiple pieces. A one-piece pick bushing 304 may have the shape of a (e.g. cap-shaped) sleeve. The one-piece pick bushing 304 may be at least partially closed along the longitudinal axis 107 (e.g., except for bores and the opening 316). For example, a multi-piece pick bushing 304 may comprise a first portion 304(1) and a second portion 304(2). For example, the first portion 304(1) may comprise the second receptacle area 324. A cavity of the first portion 304(1) of the pick bushing 304 may be set up to receive the shaft 104 of the machine pick 100. The second portion 304(2) may, for example, be cap-shaped. For example, the second portion 304(2) may comprise the first receptacle area 320. A cavity of the second portion 304(2) of the pick bushing 304 may be set up to receive the reference element 106 of the machine pick 100. The second portion 304(2) of the pick bushing 304 may, for example, be attached (e.g., detachably) to the pick holder 302 and/or to the first portion 304(1) of the pick bushing 304. Various embodiments of a multi-part pick bushing 304 are shown, for example, in FIG. 3A through FIG. 3C.

According to various embodiments, the first portion 304(1) of the multi-piece pick bushing 304 may serve as a wear bushing. Clearly, the first portion 304(1) may be a wear part, whereby a service life of the pick holder 302 may be increased.

According to various embodiments, the second portion 304(2) of the multi-piece pick bushing 304 may serve as a cover (e.g., a cap or lid) of the receptacle area (e.g., the first receptacle area 320), whereby the reference element 106 and/or one or more sensors 306 may be protected from external influences.

One or more sensors 306($n$=1 to N) may be disposed (e.g., attached) on the pick bushing 304 (e.g., to the second portion 304(2) in the case of a multi-piece pick bushing). One or more sensors 306($n$=1 to N) may be rigidly connected (e.g., form-fit and/or force-fit) to the pick bushing 304.

The machine pick 100 may comprise the locking structure 110. As described above, the locking structure 110 may be a circumferential recess (e.g., a trench) in the shaft 104 (e.g., around the longitudinal axis 107) or a bore in the shaft 104. The excavation device 200 may comprise a locking device 202 of a first type or a locking device 402 of a second type. The locking device 202, 402 (first type or second type) may also be considered part of the holding device 300.

The respective locking device 202, 402 may be set up to be brought into a first state and a second state, of which the locking device 202, 402, when brought into the first state, locks the machine pick 100 received in the opening 316 in the holding device 300, and, when brought into the second state, releases the detent of the machine pick 100.

If the machine pick 100 is locked by means of the locking device 202 of the first type, its movement along the longitudinal axis 107 may be limited, for example to a maximum displacement 214 (also referred to as maximum displacement distance). For example, the maximum displacement 214 may be less than 10 millimeters (mm) or less than 1 mm. This will be described in more detail later with respect to the elastically deformable element 310. The locking device 202 of the first type of the excavation device 200 or the holding device 300 may be set up to couple with the locking structure 110 of the machine pick 100. The locking device 202 of the first type may, for example, when in the first state, be set up to form an additional form-fit (along the longitudinal axis 107) with the machine pick 100 received in the opening 316, which limits its movement along the longitudinal axis 107.

If the machine pick 100 is locked by means of the second type of locking device 402, this may form a form-fit with the machine pick 100 received in the opening, which rigidly connects the machine pick to the pick holder 302.

As illustrated herein, an embodiment of the machine pick 100 may be set up in such a way that the machine pick 100 may be used (e.g., inserted) in various embodiments of the holding device 300. For example, the machine pick 100 may be used in holding devices 300 with a pick bushing (see, for example, FIG. 2K) as well as in holding devices 300 without a pick bushing (see, for example, FIG. 2Q).

As described above, the locking structure 110 of the machine pick 100 and the locking device 202, 402 may be set up in such a way that, in interaction, they either enable movement of the machine pick 100 in the holding device 300 within the clearance or prevent movement of the machine pick within the holding device (e.g. relative to the holding device 300). In this regard, numerous embodiments of the locking structure 110 and the locking device 202, 402 are possible. For example, the locking structure 110 may be or comprise a slot and the machine pick 100 may be mounted in holding devices 300 that utilize a screw, pin and/or set screw as a first type locking device 202 (see, for example, FIG. 2D to FIG. 2G), as well as in holding devices 300 using a U-shaped clamp as a first type locking device 202 (see, for example, FIG. 2I) or an L-shaped clamp as a first type locking device 202 (see, for example, FIG. 2L and FIG. 2M), to enable movement of the machine pick 100 in the holding device 300 within clearance. However, the locking structure 110 may also comprise or be a drilled hole (e.g., threaded) and the holding device 300 may optionally additionally comprise a screw, a pin and/or a set screw as a second type of locking device 402, wherein in this case a rigid connection (e.g., by screwing) may be created between the holding device 300 and the machine pick 100 (see, for example, FIG. 4B). Clearly, the locking device 202, 402 may be set up, in combination with the locking structure 110 of the machine pick 100, to lock the machine pick 100 (in the locked first state) either with clearance or rigidly in the holding device 300.

The locking device 202 of the first type may be set up in such a way that one or more than one degree of rotational freedom is provided to the machine pick 100 when the form-fit is formed. The locking device 202 of the first type may be set up in such a way that one or more than one degree of freedom of translation is provided to the machine pick 100 when the form-fit is formed. Clearly, the machine pick 100 may be form-fittingly disposed in the holding device 300, wherein the machine pick 100 may comprise at least one rotational degree of freedom and/or at least one translational degree of freedom. According to various embodiments, the movement of the machine pick 100 resulting from at least one degree of rotational freedom and/or at least one degree of translational freedom (e.g. during a removal process) may be sensed by means of one or more sensors. Clearly, the machine pick 100 may, in this case, have standardized clearance in the holding device 300 in order for the sensor system to function.

In contrast, the second type of locking device 402 may be set up in such a way that no degree of freedom is provided to the machine pick 100 when the form-fit is formed. For example, the form-fit may prevent movement in three translational degrees of freedom and in three rotational degrees of freedom (then also referred to as a rigid connection).

Figure 2I:
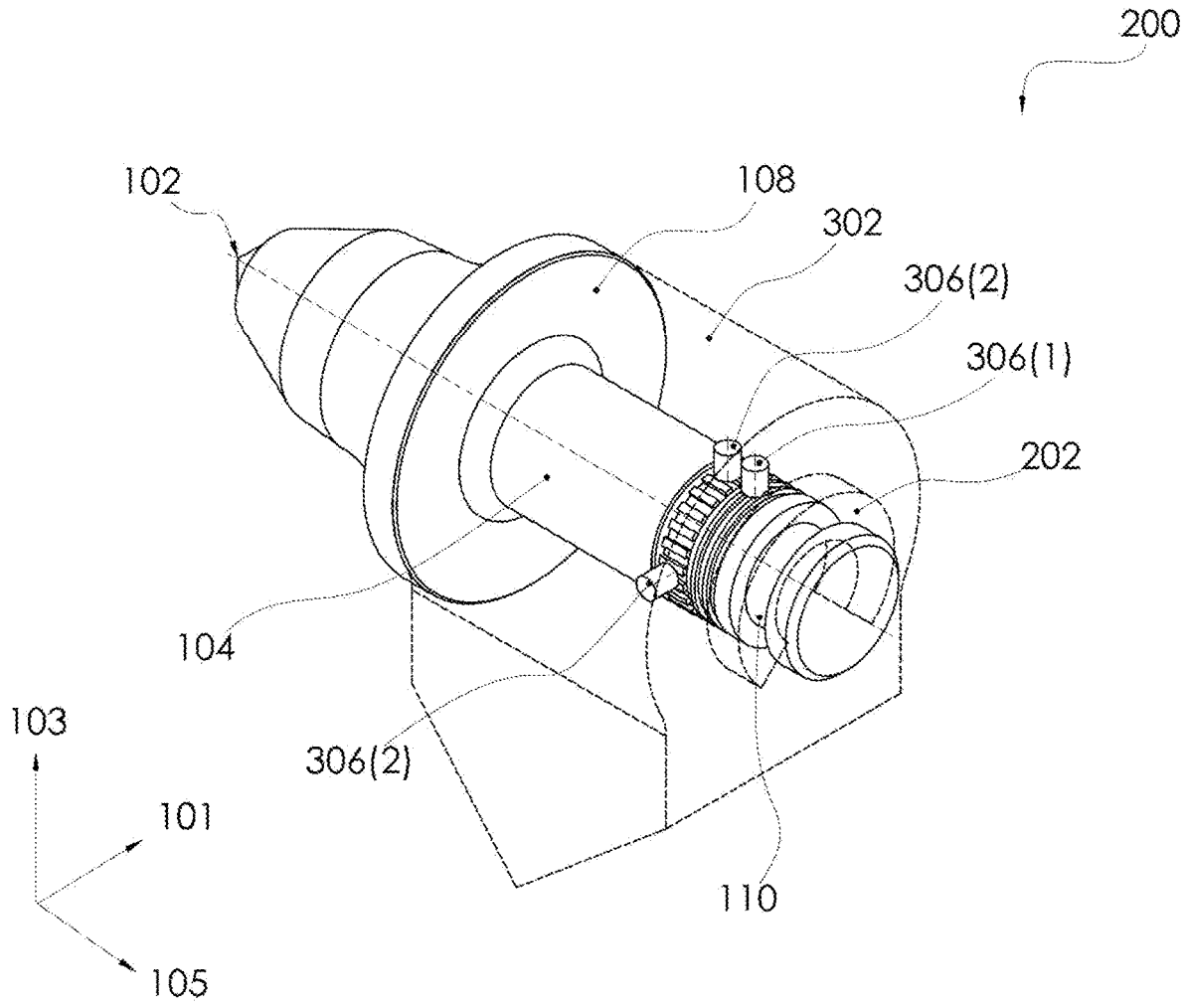
Figure 2J:
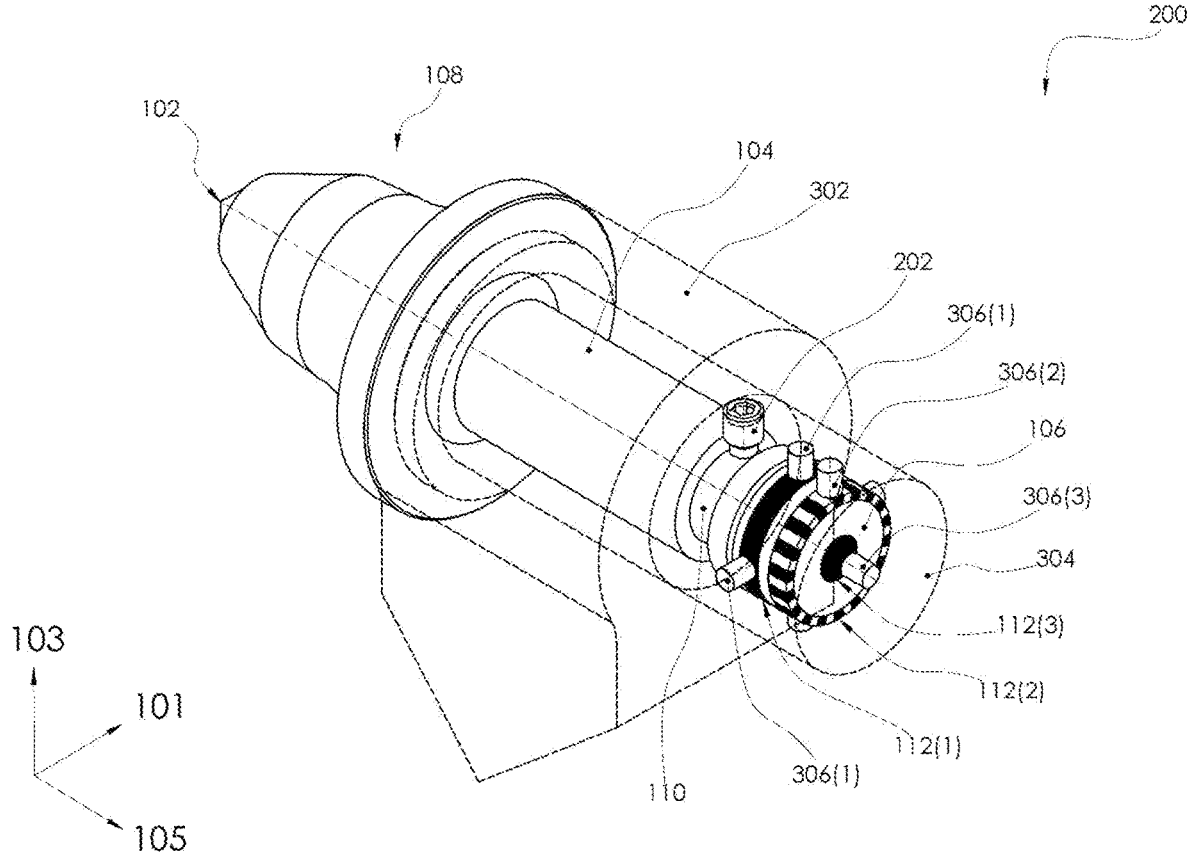
Figure 2K:
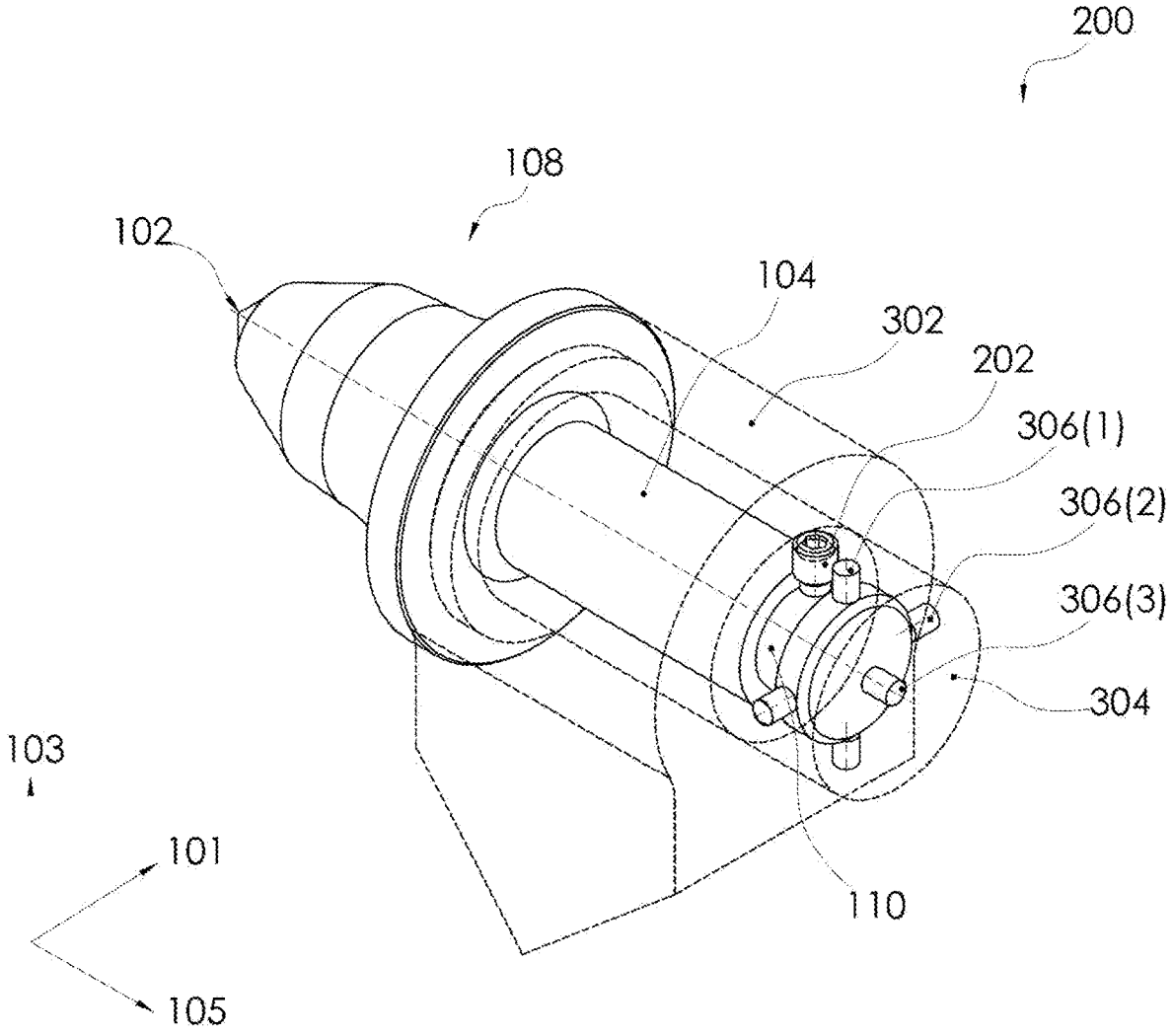
Figure 2L:
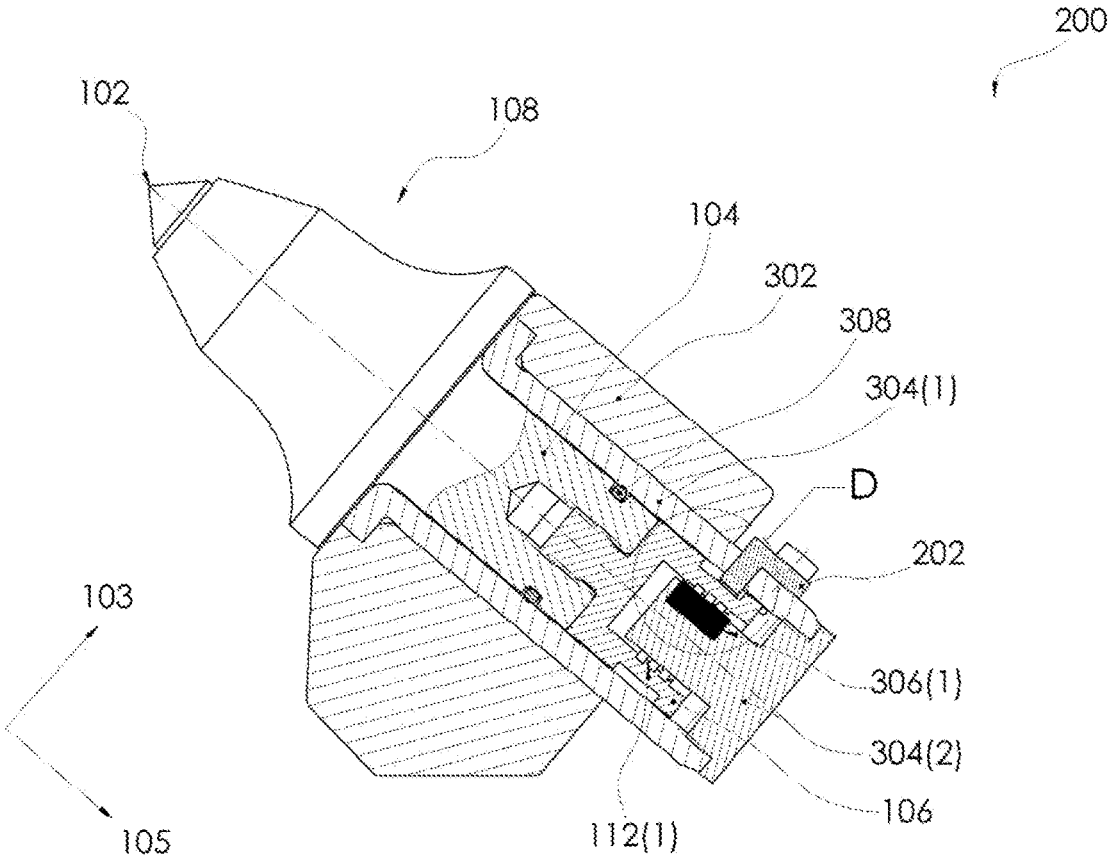
Figure 2M:
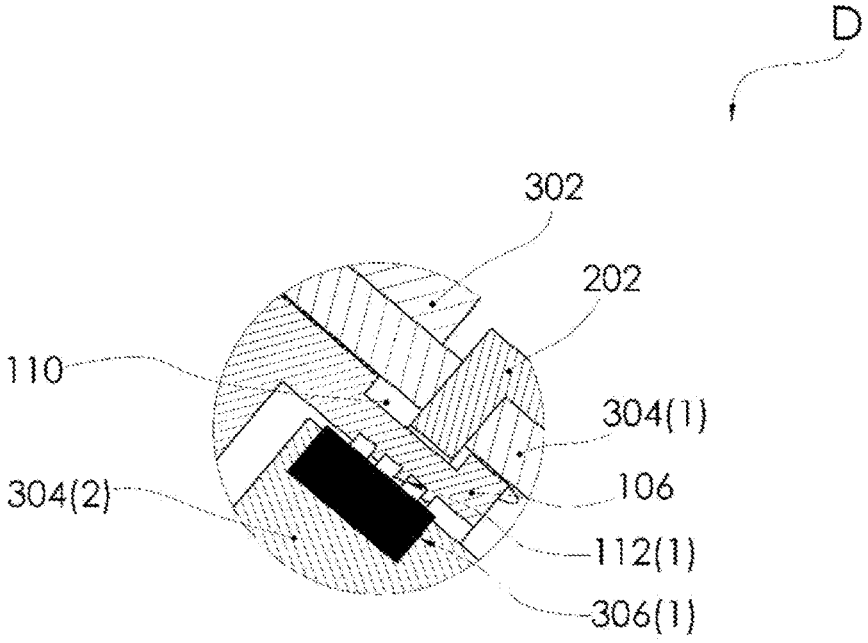
Figure 4A:
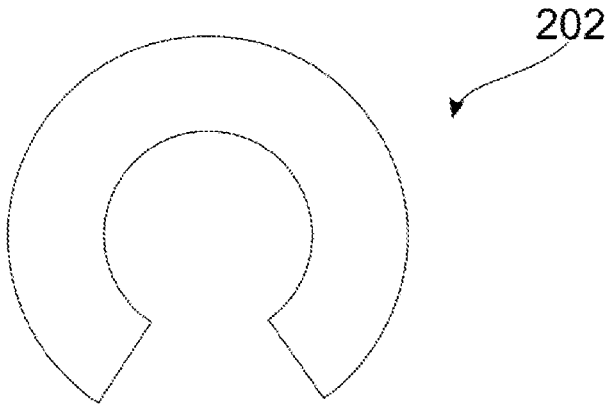
FIG. 4A shows a locking device 202 of the first type according to various embodiments.

According to various embodiments, the locking structure 110 may comprise the closed recess and the locking device 202 of the first type may comprise a screw (see, for example, FIG. 2D to FIG. 2G) or a clamp (e.g., U-shaped or L-shaped). An excavation device 200 having a U-shaped clamp as a first type locking device 202 is shown in FIG. 2I. An example of a U-shaped clamp (also referred to as a retaining clip) in cross-section or plan view is shown in FIG. 4A. An excavation device 200 with an L-shaped clamp as a locking device 202 of the first type is shown in FIG. 2L and FIG. 2M. According to various embodiments, the locking structure 110 may comprise a drilled hole (e.g., comprising a thread) and the second type locking device 402 may comprise a pin (e.g., a grub screw) and/or a screw (see, for example, FIG. 4B).

Optionally, the holding device 300 may comprise a seal 308 (e.g., a sealing ring). The pick bushing 304 (e.g., the first portion 304(1) of the pick bushing 304) or the pick shaft 104 may comprise a recess, and the seal 308 may be disposed in the recess. The seal 308 may optionally be set up to form or at least improve the form-fit between the machine pick 100 and the holding device 300 (e.g., between the shaft 104 and the pick bushing 304). The seal 308 may be set up to limit movement of the machine pick 100 perpendicular to the longitudinal axis 107 (but allow movement along the longitudinal axis 107). According to various embodiments, the seal 308 may prevent particles (e.g., debris) from entering the first receptacle area 320 from the direction of the pick tip 102.

According to various embodiments, the pick holder 302 and the pick bushing 304 may be rigidly (e.g. form-fit and/or force-fit) connected to each other. For example, the pick bushing 304 may be pressed into the pick holder 302 and/or the pick holder 302 may be shrunk onto the pick bushing 304.

Generally, the holding device 300 may comprise no (e.g., one-piece or multi-piece) pick bushing 304 in the opening 316 (then also referred to as a bushingless holding device 300). In the bushingless holding device 300 as used herein, the second portion 304(2) may be designed as an attachment bushing or at least be disposed outside of the pick holder 302. For example, the second portion 304(2) may be designed as a cap or cover that is placed on the pick holder 302. In this case, the pick holder 302 may comprise the second receptacle area 324 (and optionally further comprise the first receptacle area 320). An example of this is shown in FIG. 3B.

A cavity of the pick holder 302 may be set up to receive the shaft 104 and/or the reference element 106 of the machine pick 100. The locking structure 110 and the locking device 202 of the first type may be set up relative to each other in such a way that the machine pick 100, disposed in the holding device 300 (e.g., the pick holder 302), may comprise at least one rotational degree of freedom (e.g., about the longitudinal axis 107) and/or at least one translational degree of freedom (e.g., along the longitudinal axis 107 limited to the maximum displacement 214). Alternatively, the locking structure 110 and the locking device 402 of the second type may be set up relative to each other in such a way that the machine pick 100 is rigidly connected to the holding device 300 (e.g., the pick holder 302).

One or more sensors 306($n$=1 to N) may sense the movement of the machine pick 100 (e.g., during an excavation process) along and/or transverse to or about the longitudinal axis 107. One or more sensors 306($n$=1 to N) may be disposed (e.g., attached) on or in the pick holder 302. One or more sensors 306($n$=1 to N) may be rigidly (e.g., form-fit and/or force-fit) connected to the pick holder 302.

As described above, one or more than one sensor-sensible scales may be disposed in an internal cavity (e.g. in the form of internal recesses, e.g. internal grooves). This protects the sensor system even better against clogging. An example of this is shown in FIG. 2L, which shows a cross-sectional view of an excavation device 200 according to various embodiments. FIG. 2M shows an enlarged section of the cross-sectional view shown in FIG. 2K. In this exemplary embodiment, the pick bushing 304 may be in two parts and the second part 304(2) may be cap-shaped or plug-shaped. The second portion 304(2) of the pick bushing 304 may be set up in such a way that, when the second portion 304(2) is inserted (or pushed) into the internal cavity, the second portion 304(2) and the first portion 304(1) of the pick bushing 304 are rigidly (e.g., force-fit and/or form-fit) connected to each other. The second portion 304(2) of the pick bushing 304 may comprise one or more sensors 306($n$=1 to N). As shown, the reference element 106 may be screwable into the shaft 104. Here, the shaft 104 and the reference element 106 may be rigidly connected (e.g., force-fit and/or form-fit) by screwing the reference element 106 into the shaft 104. The shaft 104 and the reference element 106 may be detached from each other by unscrewing the reference element 106 from the shaft 104.

According to various embodiments, the holding device 300 may comprise an elastically deformable element 310, which makes it possible to determine a stretches of movement of the machine pick 100 and/or force acting on the machine pick 100 in addition to a frequency of movement. An elastically deformable element, as used herein, may be understood as any element (e.g. a structural element) that is capable of elastically changing its shape as a result of a mechanical stress (e.g. compressive force acting on it) against a restoring force, and of returning to its initial shape when the stress is removed (also referred to as elastic deformation). The limit up to which an element is elastically deformable is referred to as the yield point in the case of tensile stress. The elastically deformable element may be selected in such a way that it deforms elastically as a result of the forces generated during an excavation process using the excavation device 200. Clearly, a stiffness, shape and/or size of the elastically deformable element 310 may be application specific. Alternatively or additionally, the elastically deformable element 310 may be replaceable.

Figure 2N:
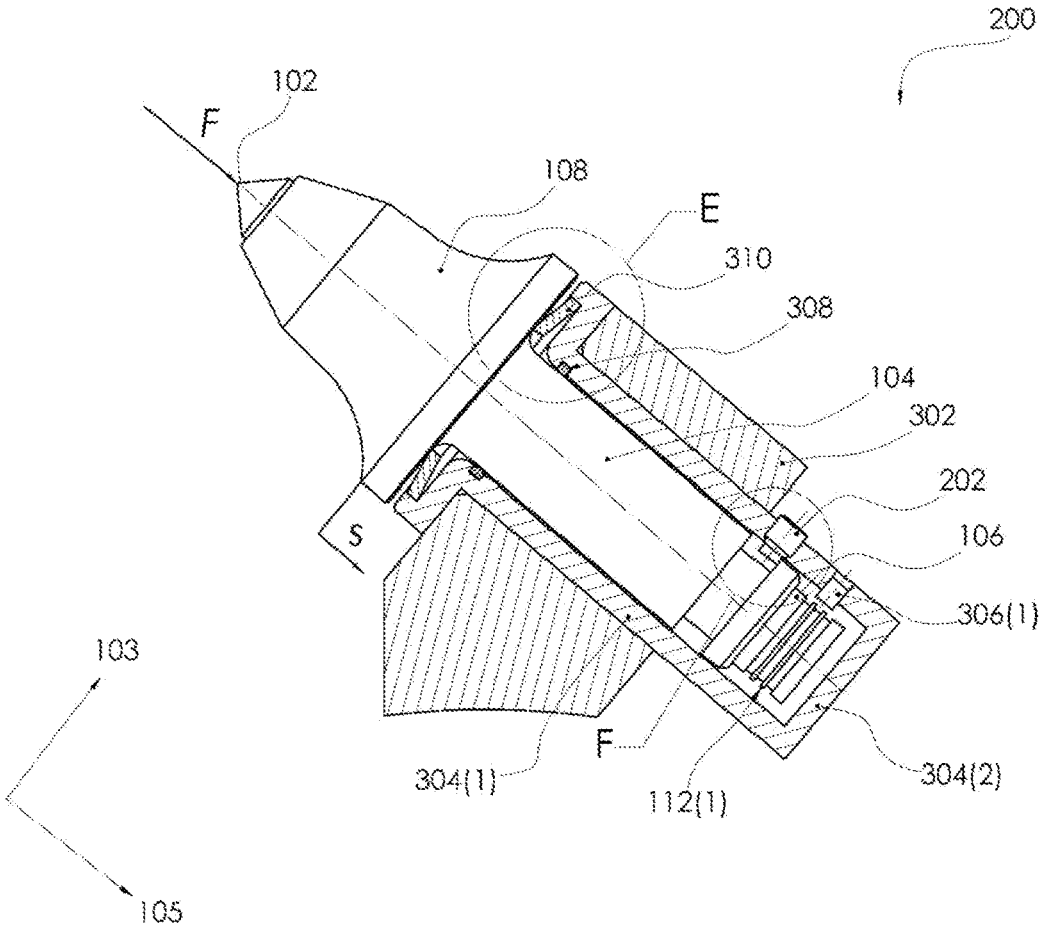
Figure 2O:
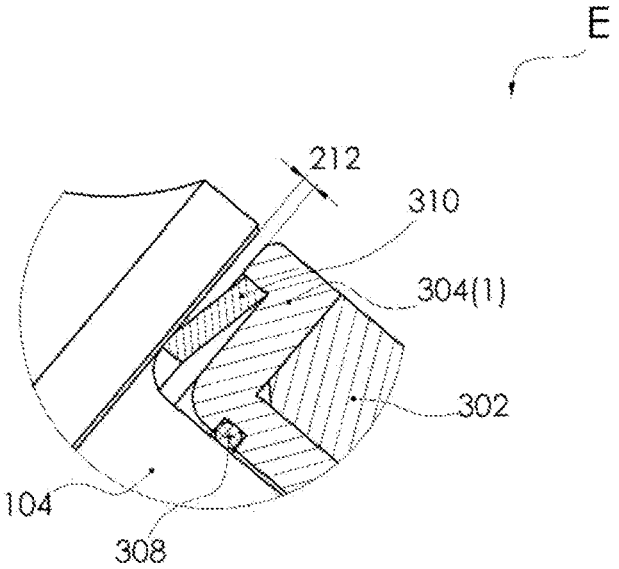
Figure 2P:
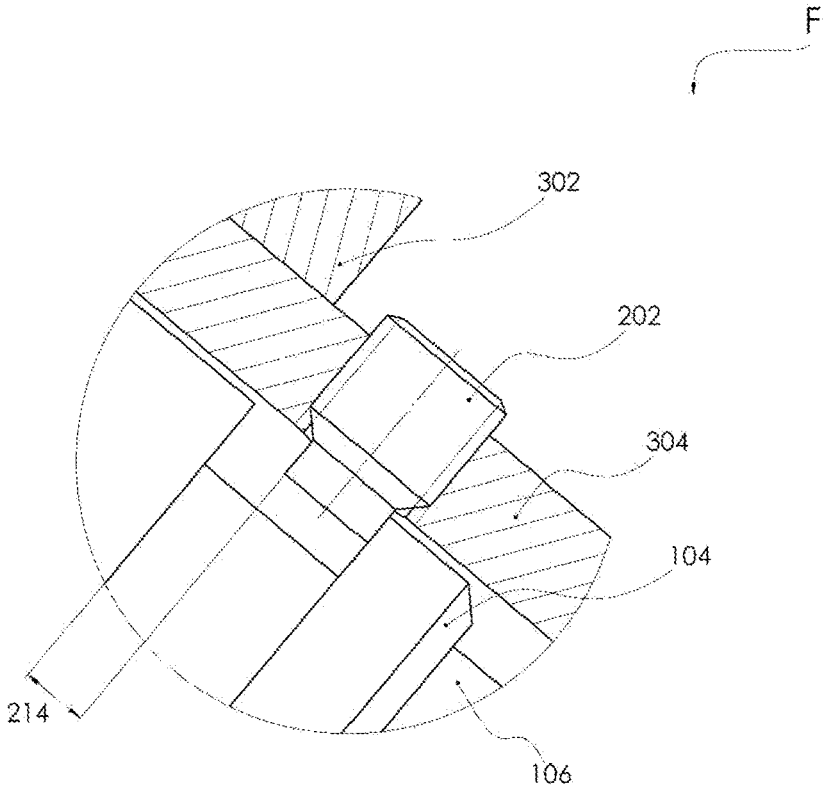
Figure 2Q:
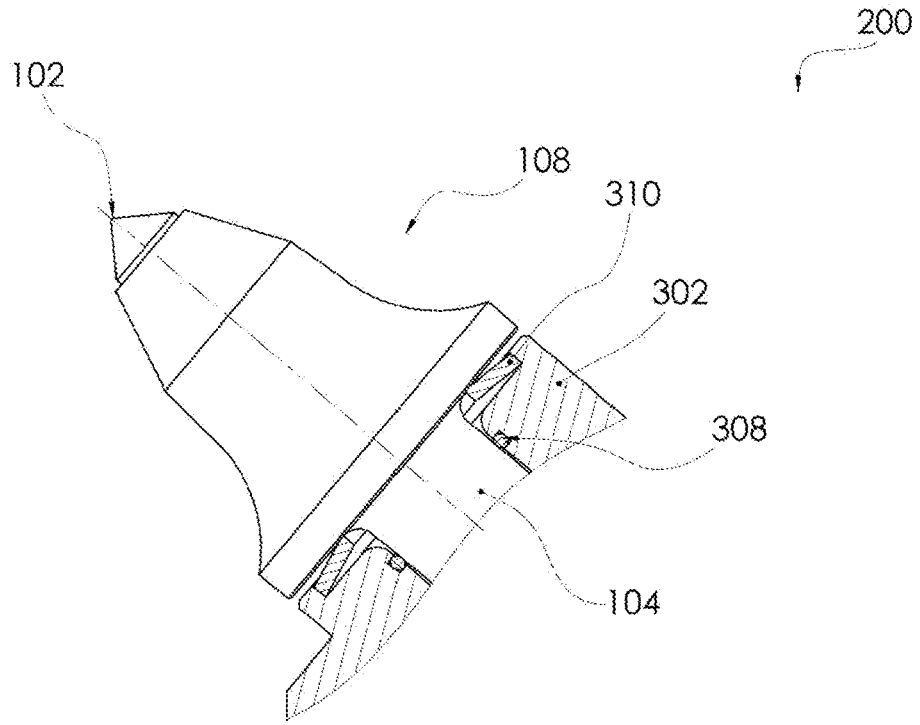

The elastically deformable element 310 may be elastically deformable based on the shape, for example, may be set up as a (e.g., metallic) spring. Examples of this are shown in FIG. 2N to FIG. 2Q. FIG. 2N and FIG. 2 show a holding device 300, which comprises the pick bushing 304. Herein, the elastically deformable element 310 (e.g., spring) may be disposed between (and in direct contact with) the machine pick 100 (e.g., the pick head 108) and the pick bushing 304. FIG. 2N further shows an exemplary embodiment of a one-piece pick bushing 304. For illustration purposes, an enlarged section (E") is shown in FIG. 2P, which shows the one-piece pick bushing 304 in the area of the locking device 202 of the first type. In the embodiment as a one-piece pick bushing 304, the locking device 202 of the first type may, for example, comprise a screw or be made thereof. As described herein, the holding device 300 may be designed without a bushing (i.e. without an internal pick bushing 304 or at least without the first part 304(1) of the pick bushing 304). In this case, the elastically deformable element 310 may be disposed between (and in direct contact with) the machine pick 100 (e.g., the pick head 108) and the pick holder 302. An example of this is shown in FIG. 2Q. The elastically deformable element 310 may define a distance 212 (e.g., in the direction 105) between the holding device 300 (e.g., the pick bushing 304 and/or the pick holder) and the machine pick 100 (e.g., the pick head 108).

Figure 2R:
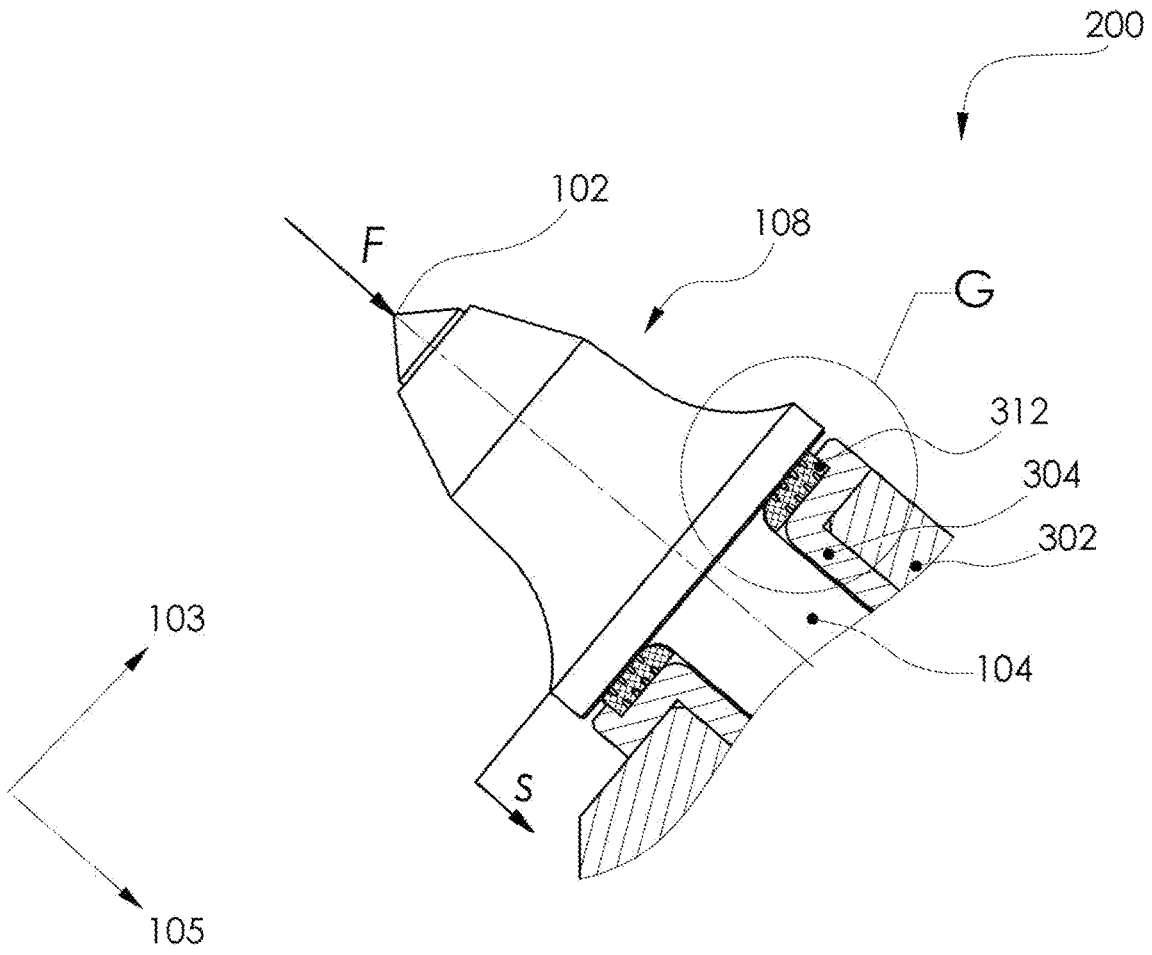
Figure 2S:
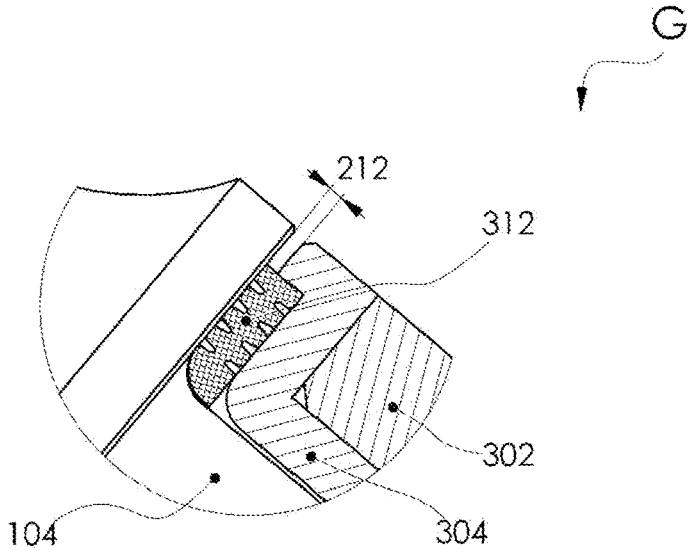

The elastically deformable element 310 may also be elastically deformable due to the material. An exemplary embodiment thereof is shown in FIG. 2R and FIG. 2S. For example, the elastically deformable element 310 may comprise or be made of an elastomer.

According to various embodiments, the elastically deformable element 310 may have a known stiffness, k. A force, F, acting on the machine pick 100 may deform the elastically deformable element 310. The deformation of the elastically deformable element 310 may lead to a movement of the machine pick 100 along the longitudinal axis 107 (e.g. in the direction 105). This movement may result in a displacement, s, of the machine pick 100 along the longitudinal axis 107. According to various embodiments, the force, F, acting on the machine pick 100 may be determined based on the stiffness, k, and the displacement, s, according to $F=k\cdot s$ (see also description of FIG. 5D, FIG. 5E and FIG. 6A). Clearly, the force, F, may be a force acting along the longitudinal axis 107 on the machine pick 100. According to various embodiments, the locking structure 110 of the machine pick 100 may be set up in such a way that allows the machine pick 100 to move in the holding device 300 in the direction 105 (see, for example, FIG. 2P). The movement of the machine pick 100 along the longitudinal axis 107 may be limited (e.g., defining a maximum displacement 214, which is, for example, the maximum spring travel of the machine pick 100) by means of the locking device 202 (e.g., in combination with the locking structure 110) of the first type. Here, the locking device 202 of the first type may, for example, be a screw. According to various embodiments, the distance 212 may be selected in such a way that the maximum displacement 214 may be achieved. For example, the distance 212 may be greater than the maximum displacement 214.

According to various embodiments, the elastically deformable element 310 may absorb a moment and/or a force when the machine pick 100 is rotated. For example, a torque and/or force acting on the machine pick 100 may be determined based on the movement (e.g., rotation) of the machine pick 100 sensed by one or more sensors 306 and the stiffness, k, of the elastically deformable element 310.

Figure 2T:
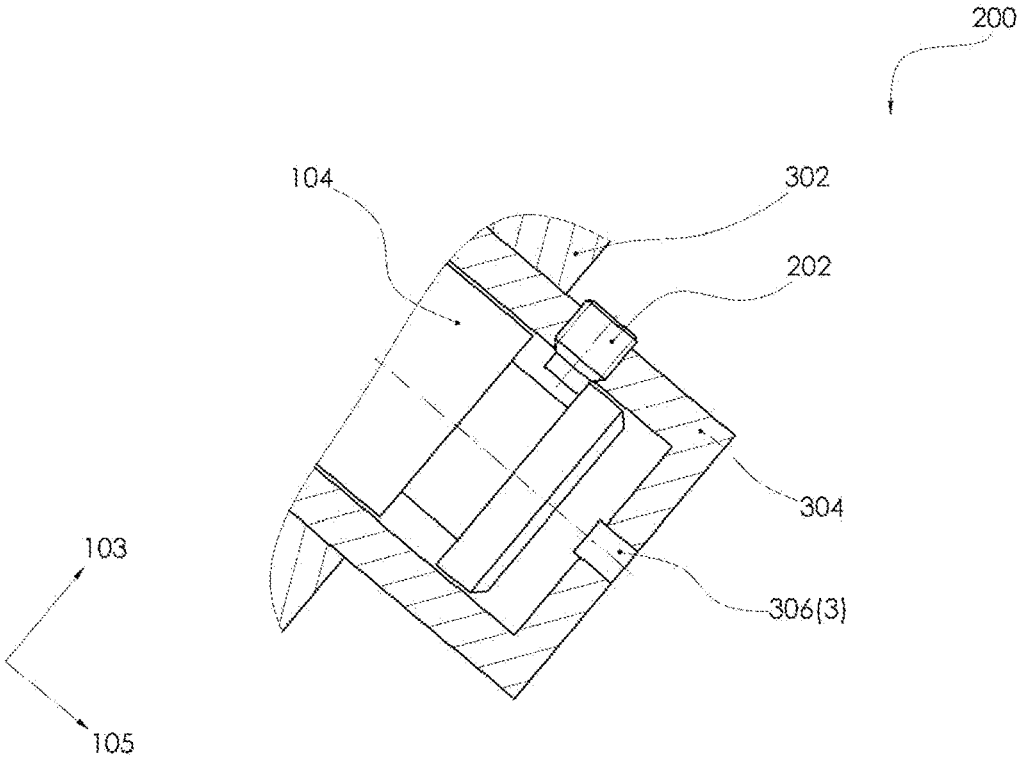
Figure 2U:
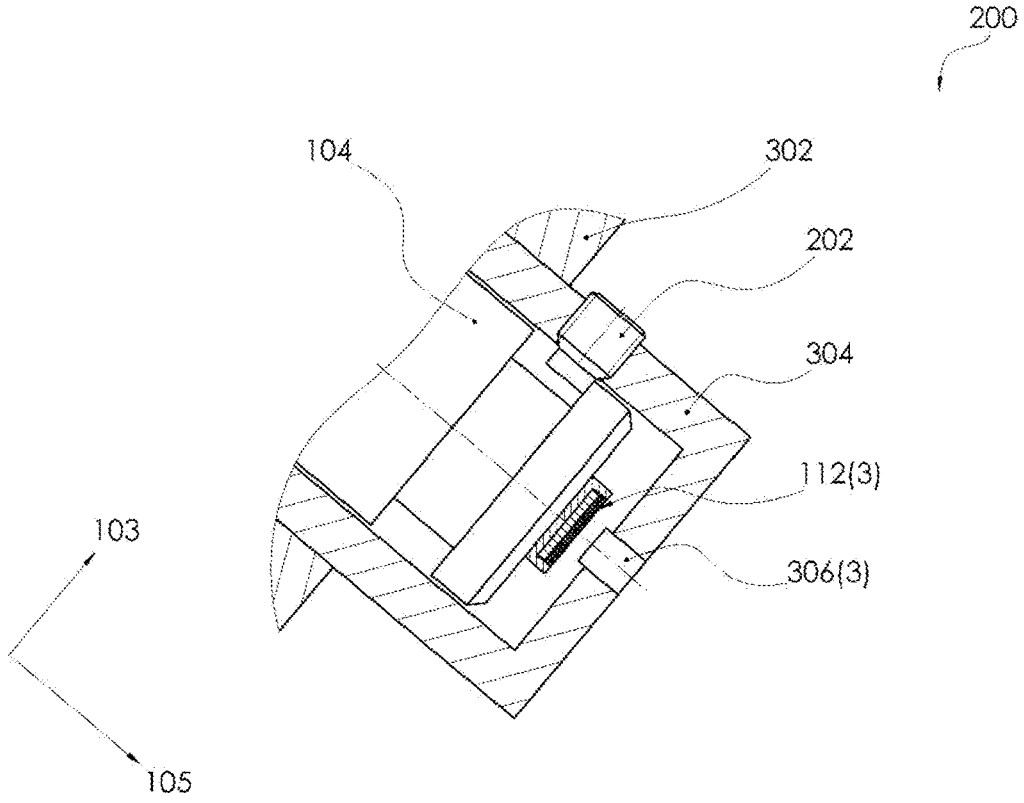

According to various embodiments, at least one sensor of one or more sensors may be set up to sense the displacement (e.g. the spring travel), s, of the machine pick 100 relative to the holding device 300. FIG. 2T and FIG. 2U each show the excavation device 200 according to different embodiments with the elastic element. The pick bushing 304 may be one-piece and the third sensor 306(3) may be disposed (e.g., fixed) on or in the pick bushing 304 at the end face (opposite the opening 316). The third sensor 306(3) may be an inductive sensor (e.g., eddy current sensor) (see, for example, FIG. 2T). The third sensor 306(3) may be a magnetic sensor (e.g., Hall sensor) (see, for example, FIG. 2U). According to various embodiments, the displacement, s, may be sensed by means of the third sensor 306(3). For example, the third sensor 306(3) may sense (detect) a distance from the reference element 106, wherein a relative change in the distance may correspond to the displacement, s. Clearly, the forces acting on the machine pick 100 (e.g. the force F) may be determined directly based on the displacement of the machine pick 100.

Figure 4B:
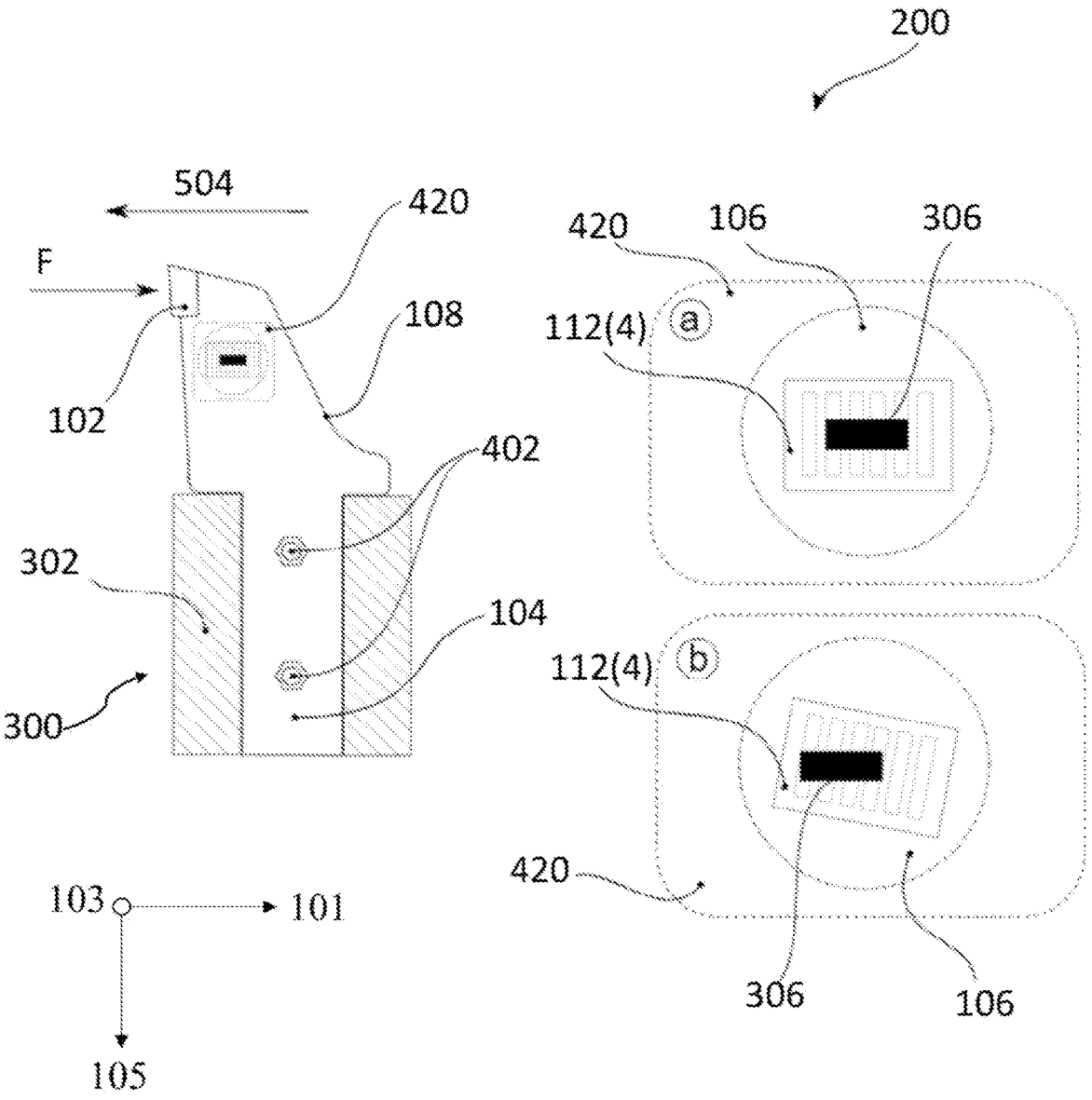
FIG. 4B shows an excavation device 200 with a locking device 402 of the second type according to various embodiments.

Similar to the elastically deformable element 310, forces acting on the machine pick 100 may be determined by sensing the deformation of the machine pick 100 (also referred to as pick deformation) itself, for example the movement of the pick head 108 caused thereby. The sensing of the deformation of the machine pick 100 may be facilitated if the machine pick is rigidly fixed in the holding device 300. A excavation device 200 in this regard according to various embodiments is shown in FIG. 4B.

The machining (e.g. cutting) of a material by means of a machine pick 100 may cause a deformation of the machine pick 100 (also referred to as pick deformation), e.g. of the pick head 108, due to a counterforce acting on the machine pick 100 in the process. The pick deformation may, for example, comprise a deformation of the pick head 108 and/or a deformation of the pick shaft 104. The pick deformation may, for example, comprise a compression and/or a torsion of the machine pick 100. Reference is made herein, i.a., to a deformation of the pick head 108, wherein what is described for this may apply by analogy to a deformation of the entire machine pick 100 or at least of the pick shaft 104.

The pick deformation may, for example, lead to a movement of the entire fourth sensor-sensible scale 112(4) (e.g. against the direction of the acting force, F). The pick deformation may, for example, lead to a compression of the fourth sensor-sensible scale 112(4). In this case, the individual elements of the fourth sensor-sensible scale 112(4) may move relative to one another. The determination (e.g., sensing and/or calculation) of the pick deformation, as used herein, may be performed by means of one or more than one sensor, for example, by sensing a change in the fourth sensor-sensible scale 112(4) (e.g., a movement of the entire fourth sensor-sensible scale 112(4) and/or a compression of the fourth sensor-sensible scale 112(4)) by means of one or more than one sensor.

The excavation device 200 may comprise the machine pick 100 and the holding device 300. The excavation device 200 may comprise the second type locking device 402 for providing the rigid connection between the machine pick 100 and the holding device 300. In the example illustrated in FIG. 4B, the machine pick 100 may comprise a plurality of threaded holes and the second type locking device 402 may comprise an associated screw for each of the plurality of holes such that the machine pick 100 may be rigidly screwed to the holding device 300, thereby preventing movement of the machine pick 100 relative to the holding device 300. One or more sensors 306($n$=1 to N) may be disposed in such a way that they may sense the fourth sensor-sensible scale 112(4) of the reference element 106, which is attached to or part of the pick head 108 (e.g., an upper portion of the pick head 108).

As described herein, the machine pick 100 may be received in the direction 105 in the opening 316 of the holding device 300. According to various embodiments, the opening 316 may be disposed behind the receptacle area 420 with respect to the direction 105.

According to various embodiments, the holding device 300 may be a radial pick holder, which is set up to hold a radial pick. In this case, the machine pick 100 may be, for example, a radial pick as shown in FIG. 1H. In this case, the opening 316 of the pick holder 302 may comprise a rectangular or trapezoidal cross-section corresponding to the cross-section of the radial pick.

The cross-section of the radial pick may be polygonal. For example, the cross-section of the radial pick may comprise an inner circle, which may contact with the inner surface of the opening 316 of the holding device 300 at one or more points, and one or more external structures (e.g., a protrusion) that define the polygonal shape. These one or more external structures may be part of the locking structure 110 and at least impede (e.g., prevent) movement of the machine pick 100 in the holding device 300. For example, the shaft 104 of the machine pick 100 may be a cylinder with a trapezoidal base and the opening 316 may have a corresponding trapezoidal cross-section, wherein the trapezoidal shape may impede rotation of the machine pick 100 about the longitudinal axis 107. For example, the shape of the machine pick 100 may serve as a torque support. Clearly, the polygonal shape of the cross-section of the machine pick 100 may serve as or be part of the locking structure 110.

The elongate structures (e.g., grooves) of the fourth sensor-sensible scale 112(4) may extend along the surface of the reference element 106 (e.g., the surface of the pick head 108). The elongated structures of the fourth sensor-sensible scale 112(4) may extend substantially parallel to the longitudinal axis 107 (e.g., in the direction 105) (see exemplary embodiment (a) in FIG. 4B) or may be disposed in the plane spanned by the directions 103 and 105 at an angle in a range of about 1° to about 45° to the longitudinal axis 107 (see exemplary embodiment (b) in FIG. 4B).

According to various embodiments, one or more sensors 306(*n*=1 to N) may be set up to sense the fourth sensor-sensible scale 112(4). The sensing of the fourth sensor-sensible scale 112(4) by one or more sensors 306(*n*=1 to N) may be performed as described with reference to the holding device 300. According to various embodiments, one or more sensors 306(*n*=1 to N) may sense the fourth sensor-sensible scale 112(4) by means of a magnetic measurement as described herein for the sensor-sensible scales 112(1), 112(2), 112(3).

The radial pick may comprise an angled pick tip 102. A rigidly locked radial pick may be deformed by the counterforce when cutting a material. The sensing of the fourth sensor-sensible scale 112(4) disposed on the pick head 108 in combination with the second type locking device 402, which prevents movement of the machine pick 100 locked in the holding device 300, enables a pick deformation, for example, deformation of the pick head 108, to be determined. As described above, the deformation of the pick head 108 may lead to a compression movement of the fourth sensor-sensible scale (e.g. a movement of the entire fourth sensor-sensible scale and/or a compression of the fourth sensor-sensible scale), which may be sensed and on the basis of which the deformation may be determined. This pick deformation may allow conclusions to be drawn about the counterforce acting. For example, the acting counterforce may be determined using the sensed movement of the fourth sensor-sensible scale. A resistance of the cut material may be clearly sensed. According to various embodiments, the force, F, acting on the machine pick 100 (also referred to herein as counterforce) may be determined based on the movement resulting from the pick deformation (see also description of FIG. 5D, FIG. 5E and FIG. 6A). Clearly, the sensing of the pick deformation may be used alternatively (or additionally) to the sensing of the displacement, s, to determine the force, F, acting on the machine pick 100.

The pick deformation (e.g. change in its extension along the pick axis 107) may be in a range of about 10 μm to about 500 μm. According to various embodiments, the resulting movement of the pick head 108 may be in the same range.

Figure 3A:
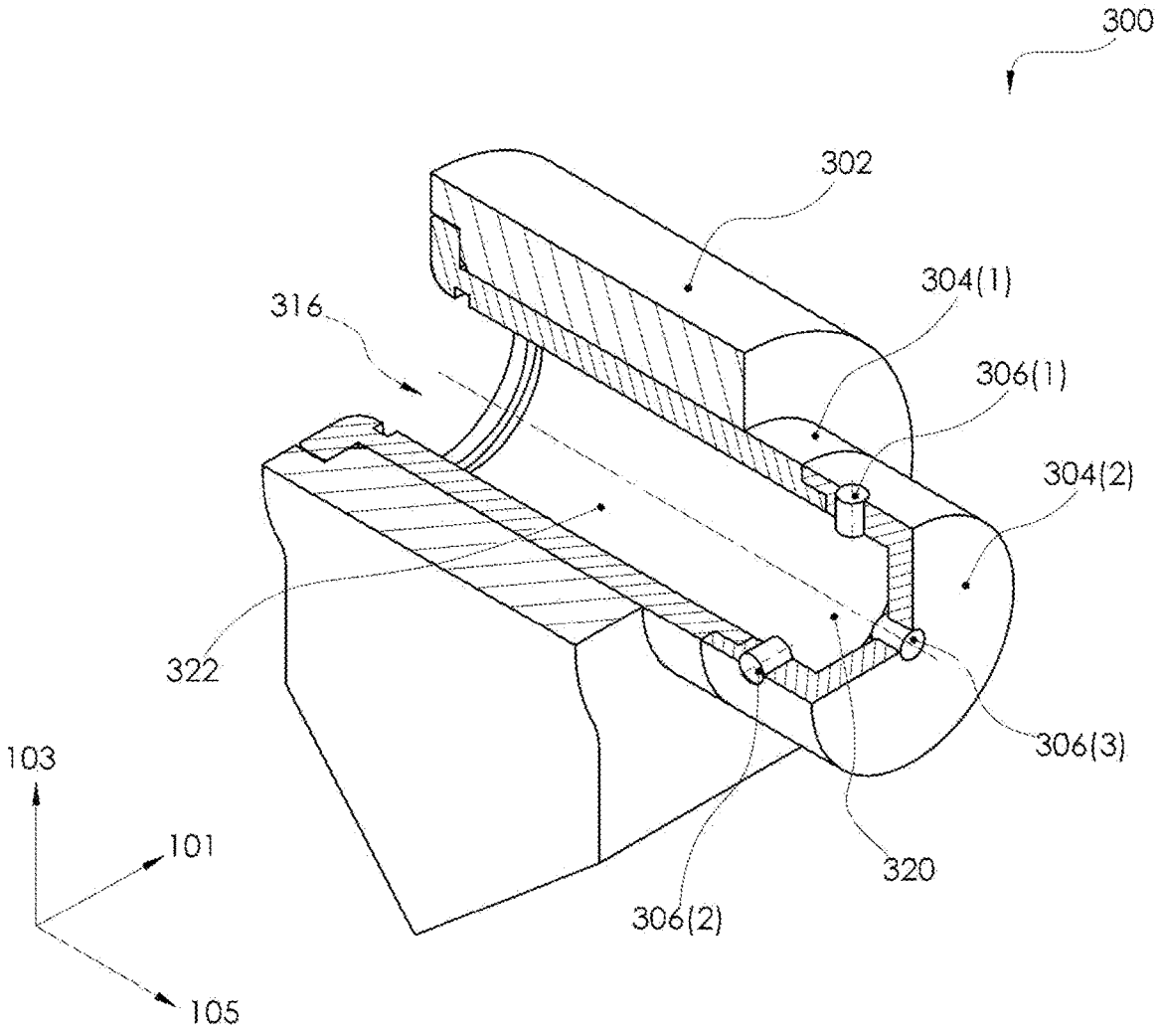
FIGS. 3A to 3C each show a holding device 300 according to various embodiments.
Figure 3B:
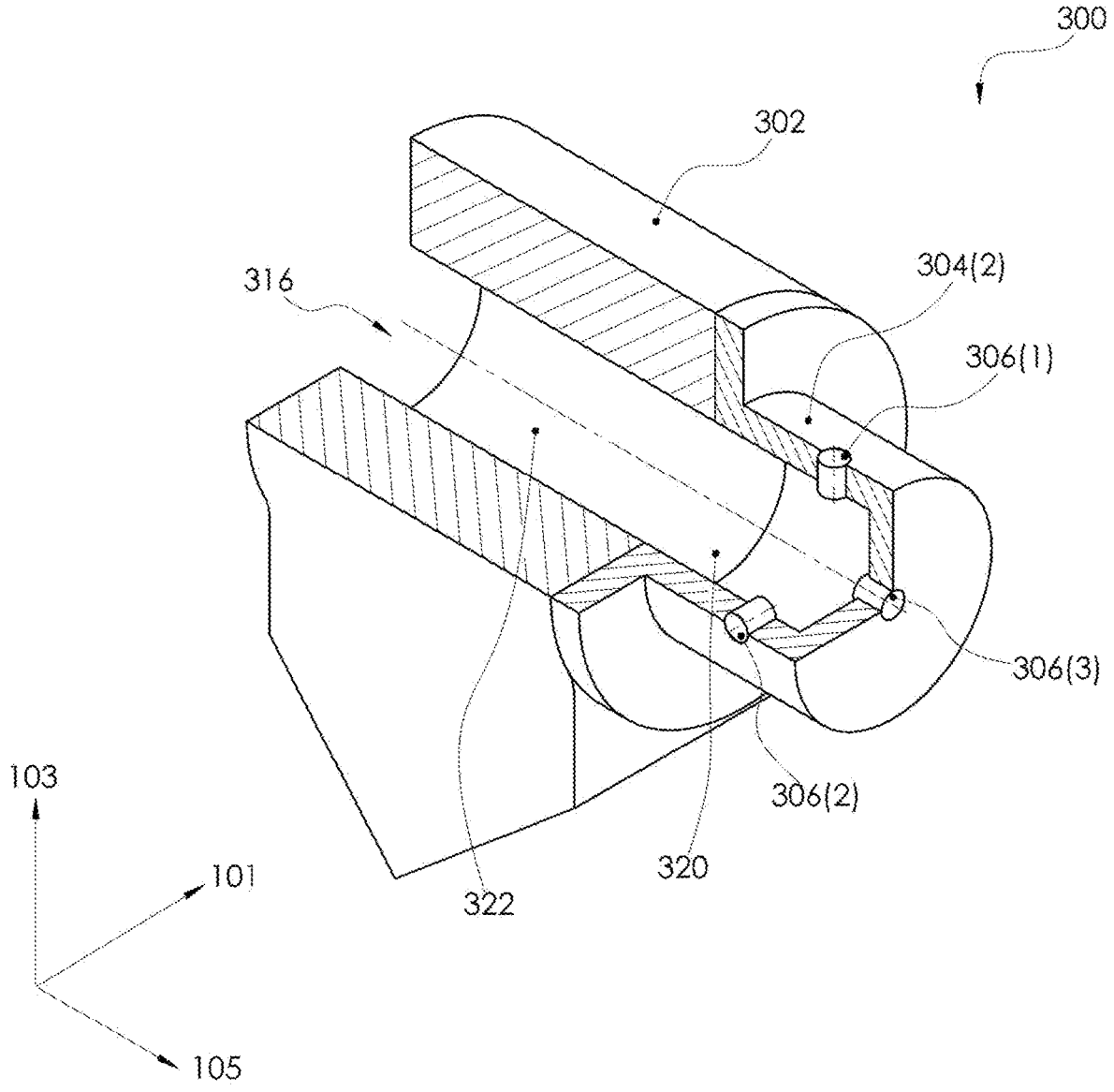
Figure 3C:
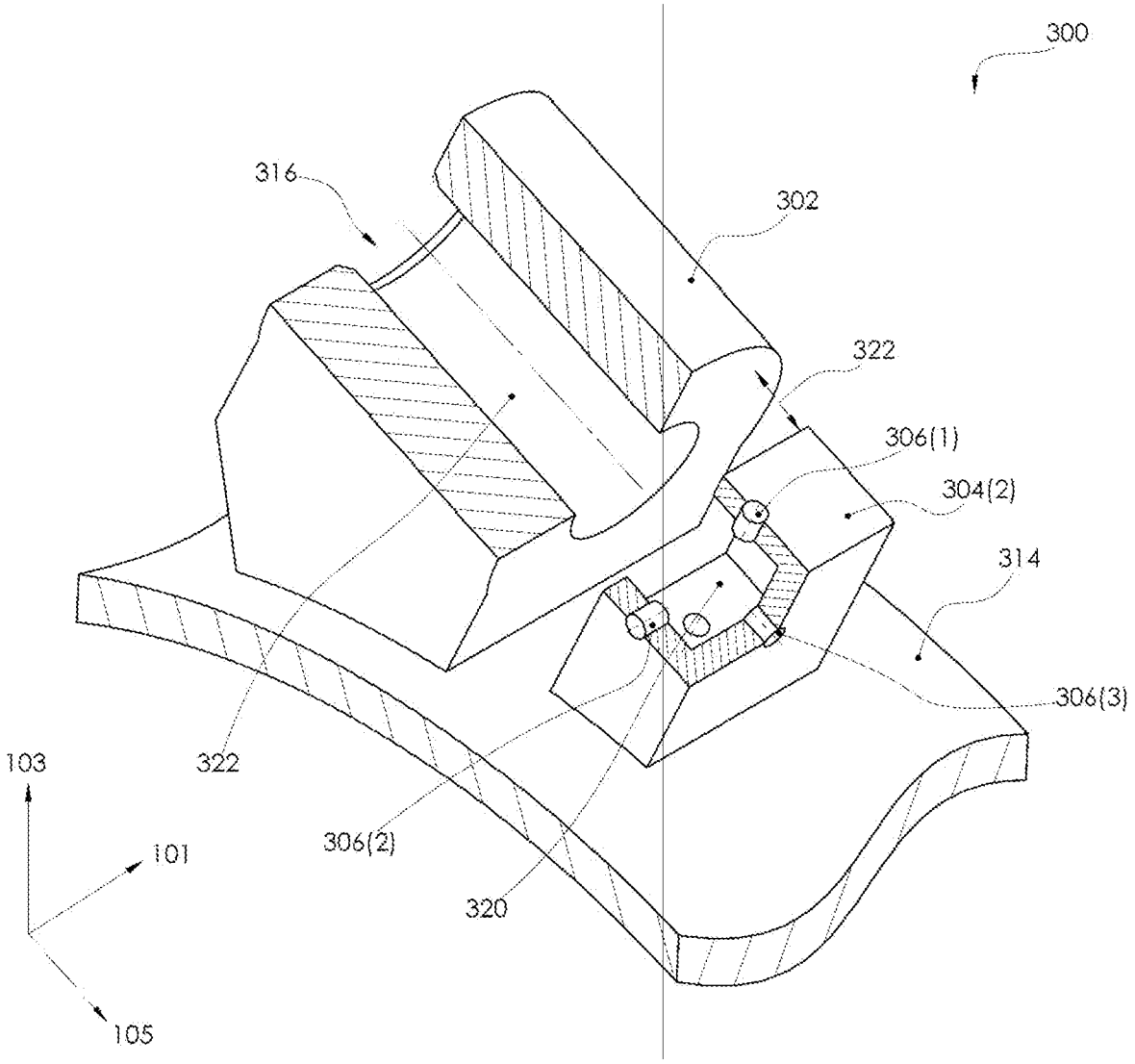

FIG. 3A to FIG. 3C each show a holding device 300 with a pick bushing 304 according to different embodiments. From FIG. 3A to FIG. 3C, one or more sensors 306 are exemplarily disposed at the receptacle area 320 for sensing the first, second and/or third sensor-sensible scale. It will be understood that one or more sensors 306 may also be disposed in the receptacle area 420 for sensing the fourth sensor-sensible scale.

With reference to FIG. 3A, the pick bushing 304 may comprise the first portion 304(1) and the second portion 304(2). For example, the second portion 304(2) of the pick bushing 304 may be cap-shaped. The second portion 304(2) of the pick bushing 304 may be attached (e.g., detachably) to the first portion 304(1) of the pick bushing 304. The second portion 304(2) of the pick bushing 304 may be attached (e.g., detachably) to the first portion 304(1) of the pick bushing 304. The second portion 304(2) of the pick bushing 304 may, for example, be glued or screwed to the first portion 304(1) of the pick bushing 304.

With reference to FIG. 3B, the pick bushing 304 may comprise only the second portion 304(2). The second portion 304(2) of the pick bushing 304 may be cap-shaped. Here, the second portion 304(2) may be attached (e.g., detachably) to the pick holder 302, e.g., bearing against the outside thereof (e.g., in a dust-tight manner). The second part 304(2) of the pick bushing 304 may, for example, be glued or screwed to the pick holder 302.

With reference to FIG. 3C, the second portion 304(2) of the pick bushing 304 may be disposed at a distance 322 (in the direction 105) from the pick holder. The cavity of the second portion 304(2) of the pick bushing 302 may be set up to receive the reference element 106 of the machine pick 100. One or more sensors may be disposed (e.g., fixed) on and/or in the second portion 304(2) of the pick holder 302. When a machine pick 100 is inserted into the holding device 300, the locking structure 110 may be disposed in the region (defined by the distance 322) between the pick holder 302 and the second portion 304(2) of the pick bushing 304. In this regard, the locking device 202 of the first type may comprise or be, for example, the U-shaped clamp shown in FIG. 4A.

According to various embodiments, the holding device 300 may comprise a carrier 314 (see, for example, FIG. 3C). The carrier 314 may be rigidly connected (e.g., by material bonding, force-fit and/or form-fit) to the pick holder 302. In the embodiment shown in FIG. 3C, the carrier 314 may be rigidly (e.g., by material bonding, force-fit, and/or form-fit) connected to the second portion 304(2) of the holding device. The carrier 314 (also referred to as a pick carrier or cutting drum) may be, for example, a machine drum, a cutting wheel or a chain.

Figure 3D:
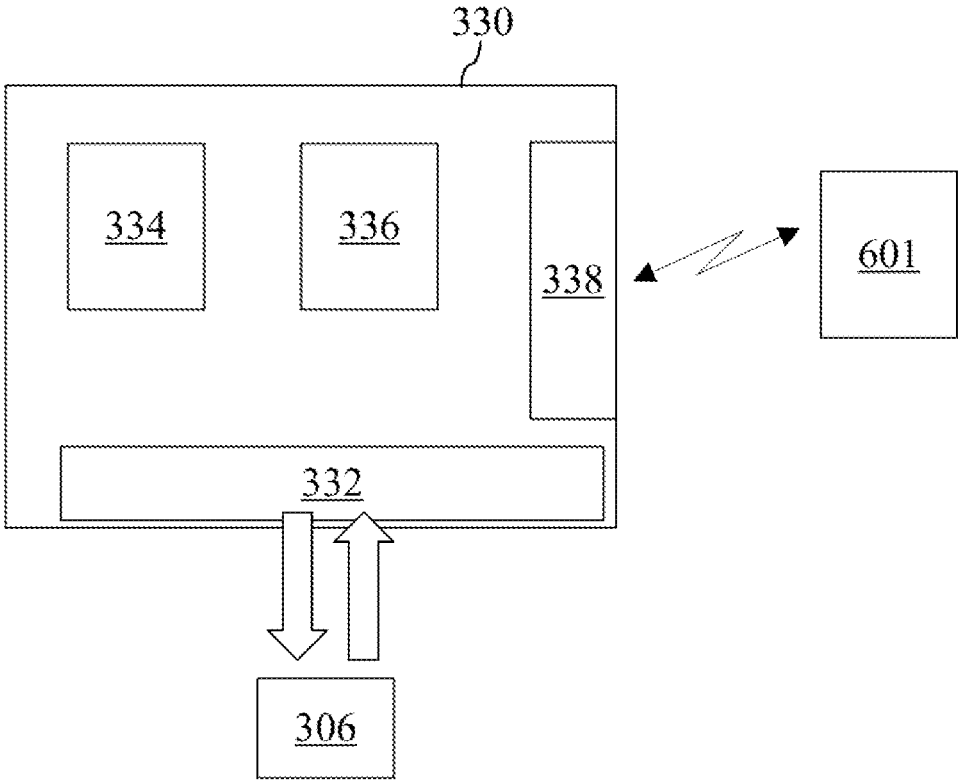
FIG. 3D shows a data processing device 330 according to various embodiments.

According to various embodiments, the holding device 300 may optionally comprise a data processing device 330. For example, the data processing device 330 may also be or may be provided externally from the holding device 300, in whole or in part, such as being connected to the holding device 300 via a (e.g., local or global) network. An exemplary data processing device 330 according to various embodiments is shown in FIG. 3D.

The data processing device 330 may comprise a first communication interface 332. The first communication interface 332 may be set up to receive data (also referred to as sensor data) sensed by one or more sensors 306(*n*=1 to N). The data processing device 330 may optionally be set up to transmit control commands to one or more sensors 306(*n*=1 to N) by means of the first communication interface 332, for example to configure them or instruct them to output data.

The data processing device 330 may comprise a second communication interface 338. The second communication interface 338 may be set up to transmit data to (and optionally receive data from) a signal processing system 601.

A communication interface described herein (e.g., the first communication interface 332 and/or the second communication interface 338) may be a wired interface and/or a wireless interface. A wireless interface may be set up or communicate according to a radio communication protocol or standard. For example, the wireless interface may be set up or communicate according to a short-range radio communication standard, such as Bluetooth, Zigbee, etc. For example, the wireless interface may be set up or communicate according to a medium or long range radio communication standard, such as 3G, 4G and/or 5G according to the 3GPP standard. A wireless interface may operate according to a protocol or standard of a local wireless network (WLAN), such as the IEEE 802.11 standard.

The data processing device 330 may comprise one or more processors 334. One or more processors 334 may be set up to process the data received from one or more sensors 306($n$=1 to N). One or more processors 334 may be set up to transmit the data received from one or more sensors 306($n$=1 to N) to the signal processing system 601 by means of the second communication interface 338. One or more processors 334 may be set up to transmit the data received from one or more sensors 306($n$=1 to N) directly to the signal processing system 601 by means of the second communication interface 338 without intermediate processing.

The term "processor" may be understood as any type of entity that allows the processing of data and/or signals. For example, the data and/or signals may be handled according to at least one (i.e. one or more than one) specific function performed by the processor. A processor may comprise an analog circuit, a digital circuit, a mixed signal circuit, a logic circuit, a microprocessor, a central processing unit (CPU), a graphics processing unit (GPU), a digital signal processor (DSP), a programmable gate array (FPGA), an integrated circuit or any combination thereof or be formed therefrom. Any other type of implementation of the respective functions described in more detail below may also be understood as a processor or logic circuit. It will be understood that one or more of the method steps described in detail herein may be performed (e.g., realized) by a processor, through one or more specific functions performed by the processor. The processor may therefore be set up to perform one of the methods or information processing components thereof described herein.

The data processing device 330 may comprise a memory device 336. According to various embodiments, one or more processors 334 may utilize the memory device 336 in processing data (e.g., data received from one or more sensors) and/or as a cache.

The memory device 336 may comprise at least one memory. The memory may be used, for example, in processing performed by a processor. A memory used in embodiments may be a volatile memory, for example a DRAM (dynamic random access memory), or a non-volatile memory, for example a PROM (programmable read only memory), an EPROM (erasable PROM), an EEPROM (electrically erasable PROM) or a flash memory, such as a floating gate memory device, a charge intercepting memory device, an MRAM (magnetoresistive random access memory) or a PCRAM (phase change random access memory).

FIG. 5A to FIG. 5E show aspects of a process 500 of material excavation (e.g., rock cutting).

Figure 5A:
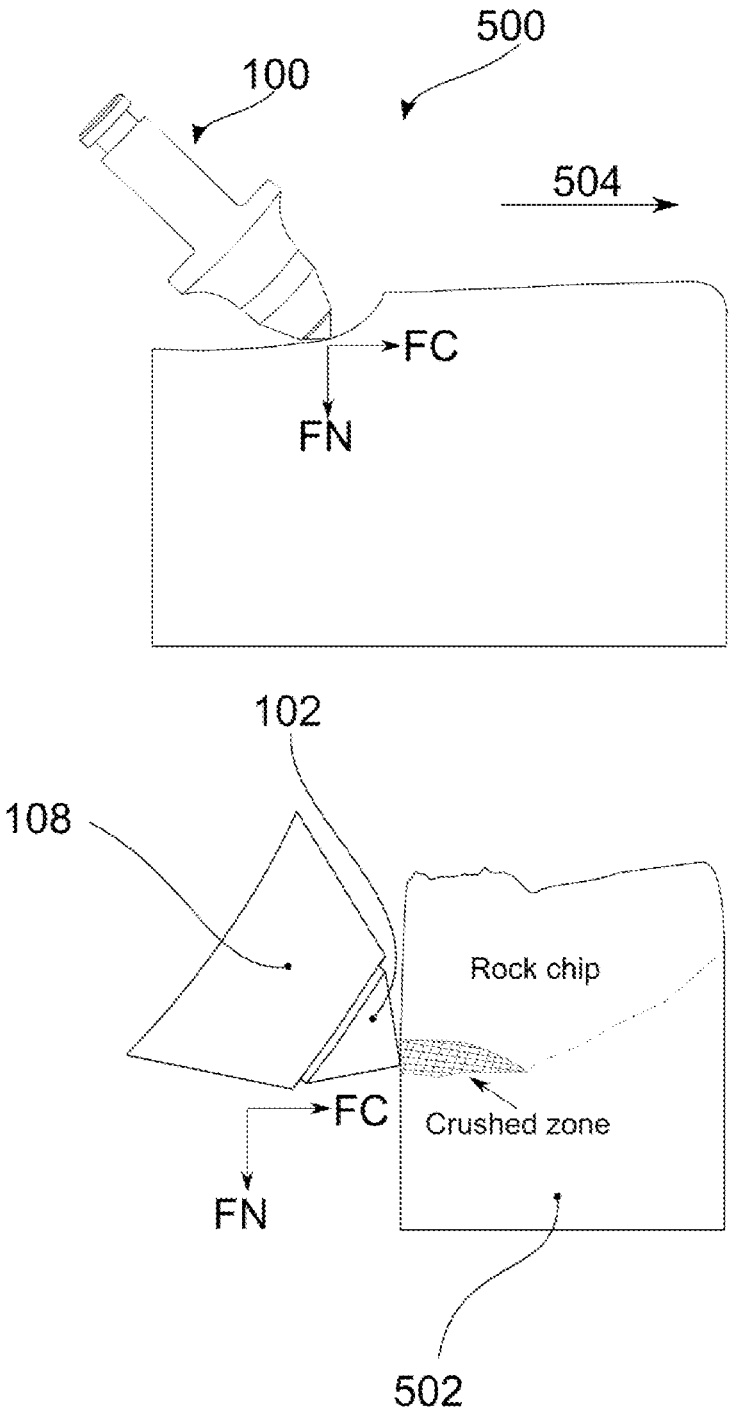
FIGS. 5A to 5E show aspects of a material excavation process.

As used herein, excavation of a material 502 may be understood as a mechanical disintegration of material parts from the material composite. A continuous, temporarily uninterrupted excavation of a rock is also referred to as cutting of the rock or rock cutting. FIG. 5A illustrates the components, forces and terms involved.

Figure 5B:
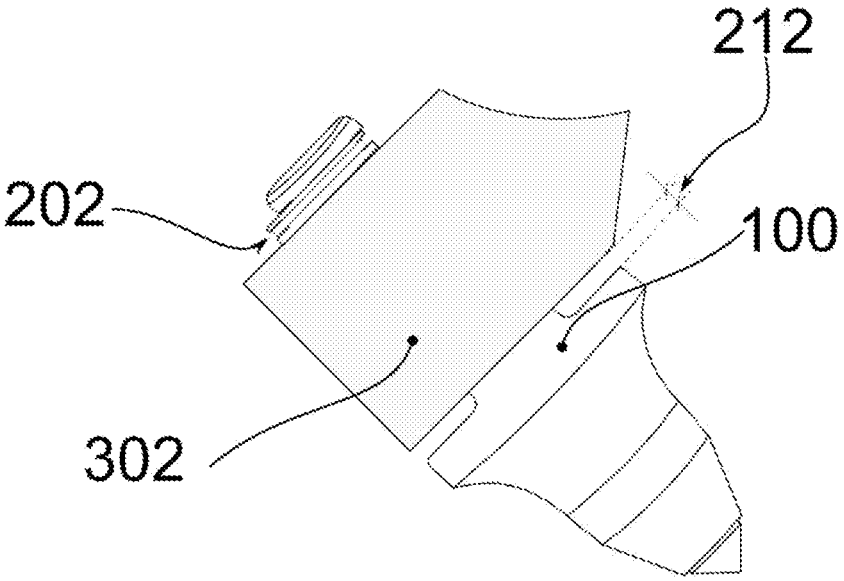

According to various embodiments, the holding device 300 may comprise the elastically deformable element 310 (see, for example, FIG. 2N to FIG. 2S). FIG. 5B shows an example of the distance 212 between the machine pick 100 and the holding device 300 along its longitudinal axis over the cutting length. A change in the distance 212 corresponds to the displacement s.

Figure 5C:
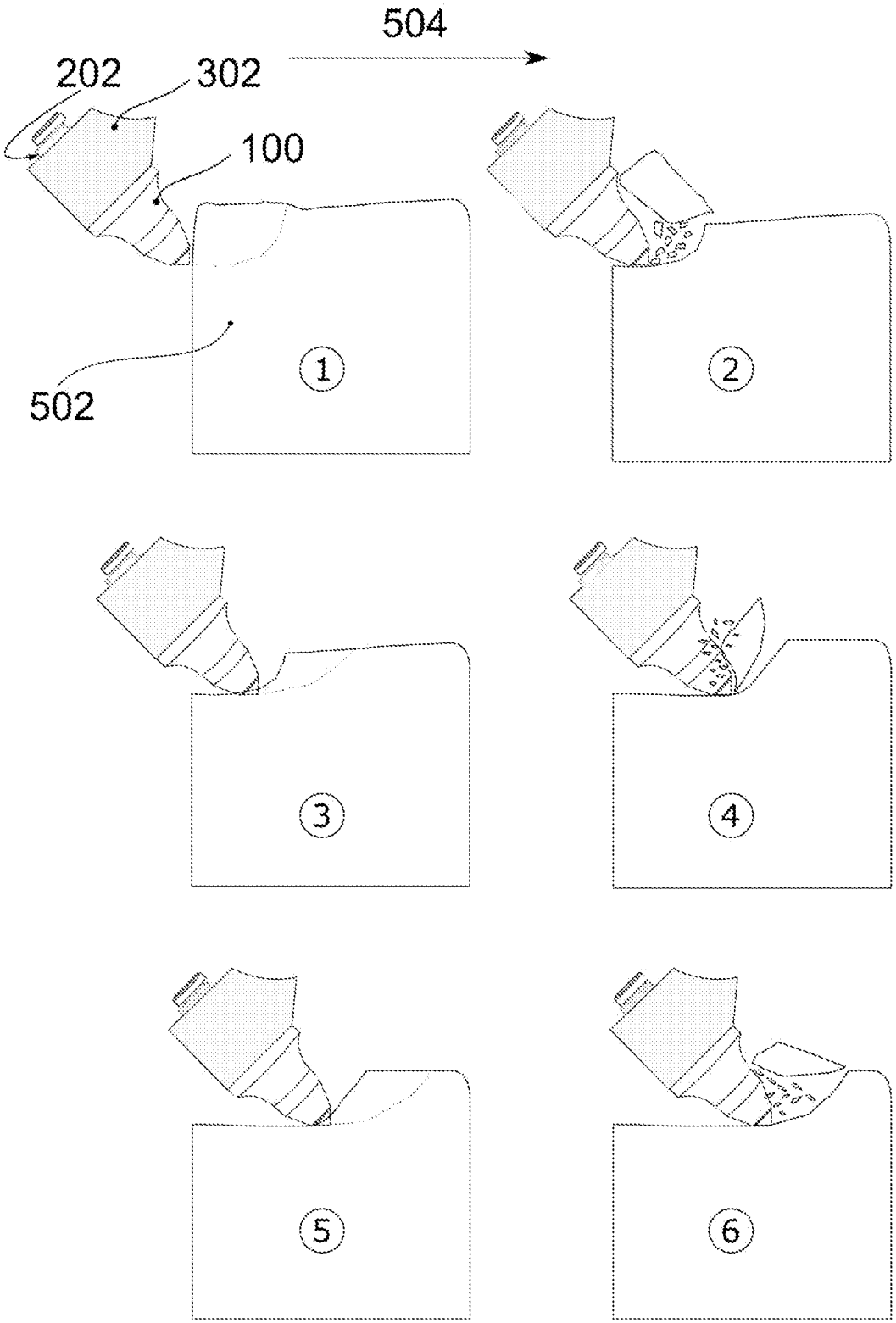

FIG. 5C illustrates the cyclic process of pressure build-up, cracking and loosening during rock cutting. Accordingly, a material excavation operation may comprise a contact phase (① in FIG. 5C) in which the machine pick 100 comes into contact with the surface of the material 502. The machine pick 100 may be moved in the direction 504, thereby building up pressure in the material. Further contact may then result in discontinuous fracture zone formation (see FIG. 5A below) and detachment of chips (②-⑥ in FIG. 5C), wherein chips of different sizes may occur, the size of the chips and thus the frequency of the macroscopic fracture events being influenced, among other things, by the compressive strength of the material 502 and the cutting speed of the machine pick 100, but also significantly by the shape of the pick tip 102. An orientation of the machine pick 100 (e.g., an angle between the machine pick 100 and the material engagement surface) may remain substantially constant during cutting. According to various embodiments, the machine pick 100 may move and/or deform in one or more degrees of freedom in the holding device 300 during these phases. This movement and/or deformation may depend on the properties of the material 502, as described herein.

Figure 5D:
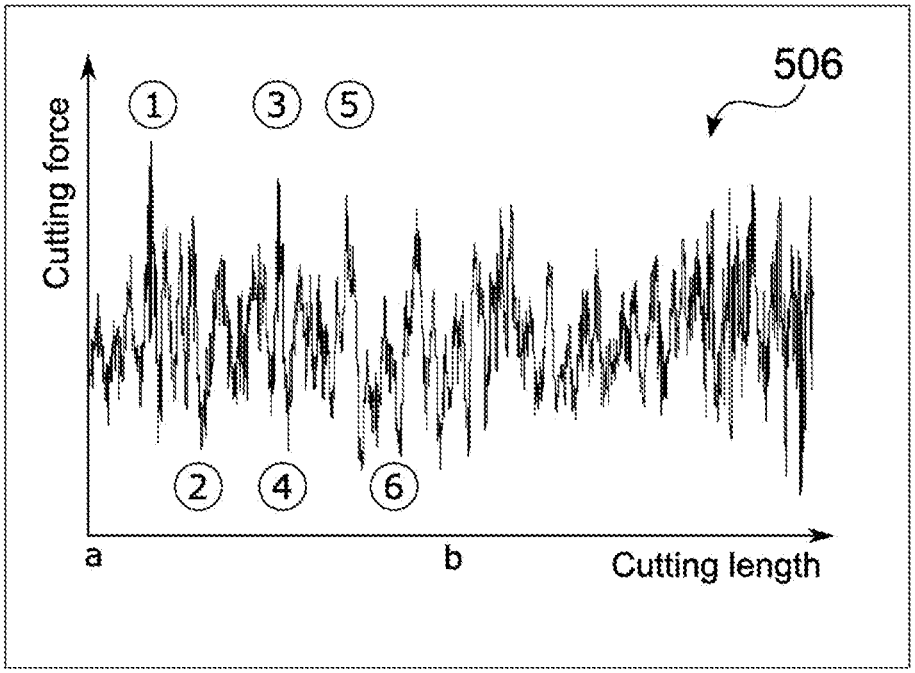
Figure 5D:
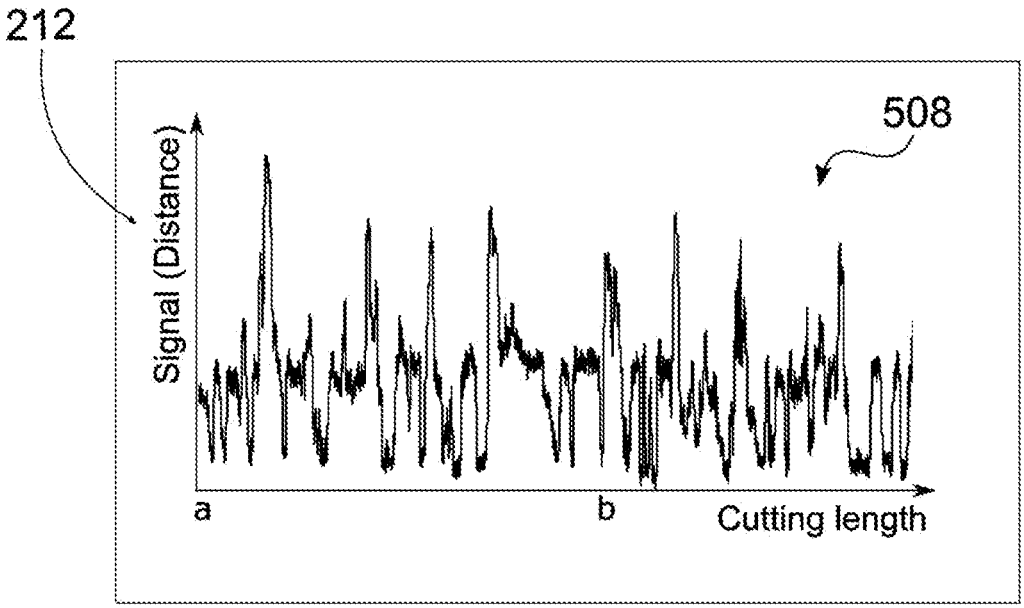

During material excavation, the machine pick 100 may be pressed against the material 502. A normal force FN (also referred to as contact pressure) may act here. A cutting force, FC, may act at an angle (e.g. perpendicular) to the normal force FN. FIG. 5D shows above the cutting force, FC, over the cutting length in a material 502 that is homogeneous in terms of strength, and below a possible signal from a sensor 306 that sensed the variable distance 212, s, between the machine pick 100 and the pick holder 302 over the cutting length. It may be seen clearly that high cutting forces, FC, e.g. in ①, ③ and ⑤ lead to a strong deformation of the elastic element 310, i.e. to a large displacement, s, and thus a comparatively small distance 212. Consequently, the cutting force, FC, correlates with the displacement, s. It will be understood that in the case of an excavation device 200 with a radial pick as machine pick 100 (e.g., a machine pick 100 according to FIG. 1H), the sensed pick deformation (e.g., deformation of the pick head 108) may represent the cutting forces.

The machine pick 100 may attack (e.g. by the normal force FN) on the material to be excavated (e.g. rock, soil, ore, concrete, asphalt, etc.) parallel to the longitudinal axis 107. According to various embodiments, the longitudinal axis 107 of the machine pick 100 may define a direction of attack (e.g., in the direction 504) of the machine pick 100 on the material to be excavated. However, the machine pick 100 may also be disposed such that cutting action takes place (e.g. with a deviation of approximately) 5° or that (e.g. when the pick carrier, such as the cutting drum of a mounted milling machine, is moved laterally) the machine pick 100 also acts in a pressing manner on the material to be excavated.

Figure 5E:
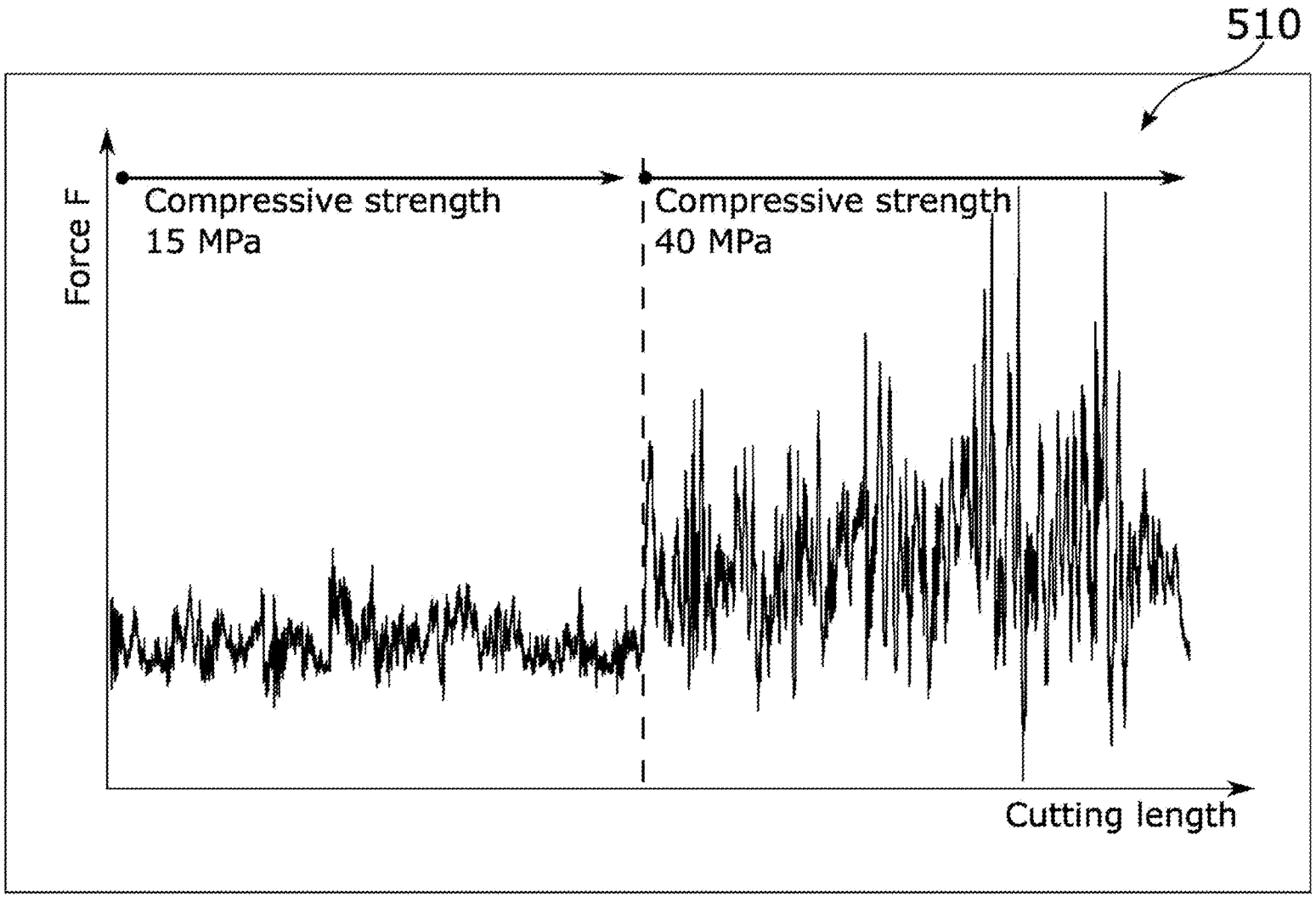

FIG. 5E shows an exemplary cutting process, wherein the rock that is being cut initially has a less compressive strength material, for example limestone, and then a rock with a higher compressive strength, for example granite.

Three-dimensional forces act on a machine pick 100 during a cutting process, which may be described, for example, as cutting force FC, normal force FN and side force. FIG. 5A shows these forces symbolically. As described herein, the force, F, acting on the machine pick 100 may be determined based on the stiffness, k, and the displacement, s, according to F=k·s. The force, F, may be a combination of other forces, such as the normal force FN and/or the cutting force FC. The force, F, may therefore also be referred to as the resultant force or resultant. Clearly, FIG. 5E shows that the course of the force, F, has information relating to the material being cut (e.g. the strength of the material). According to various embodiments, the displacement, s, may be a direct indicator of the force acting on the machine pick 100.

Figure 6A:
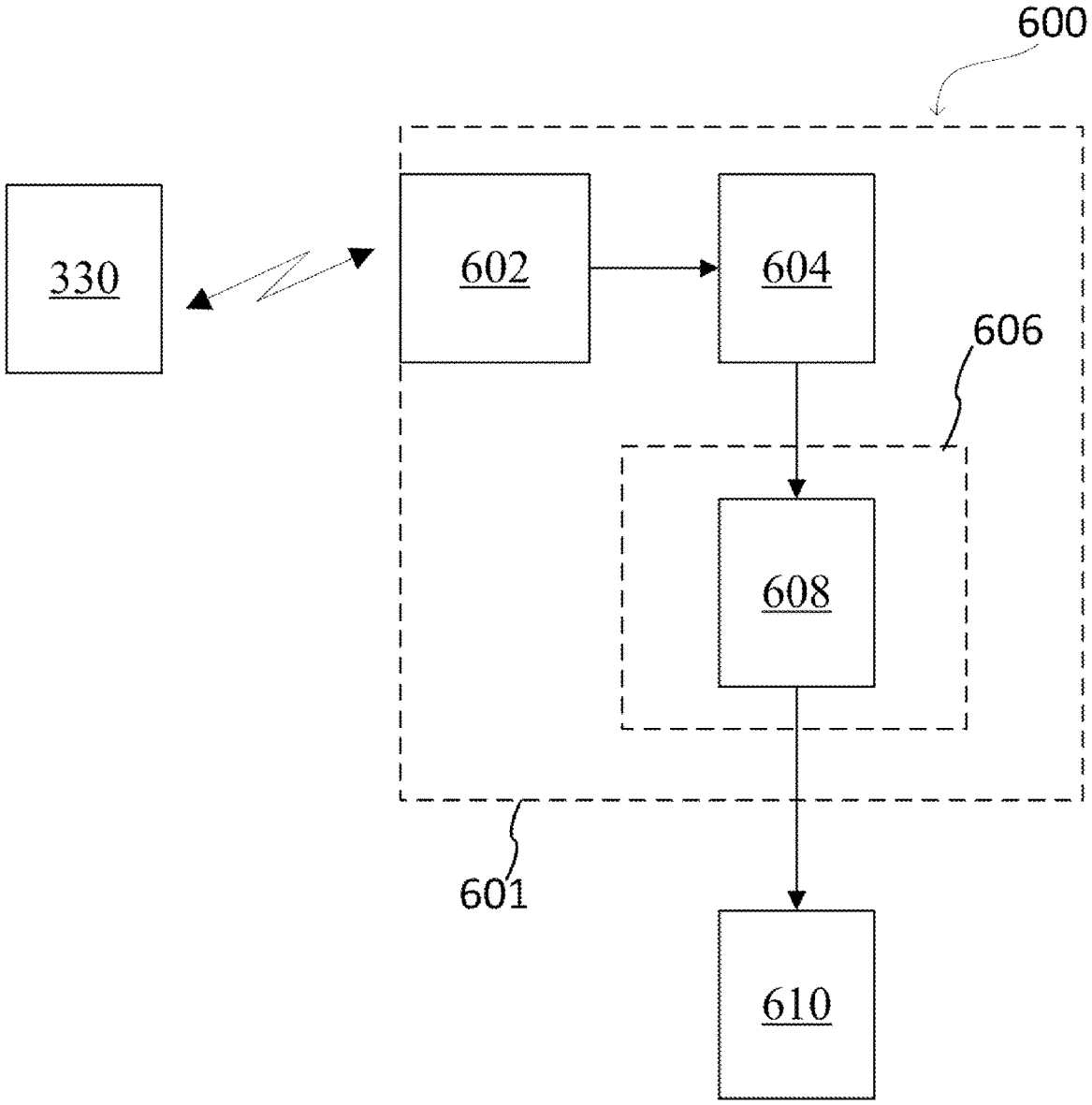
FIGS. 6A to 6C each show an excavation system according to different embodiments.
Figure 6B:
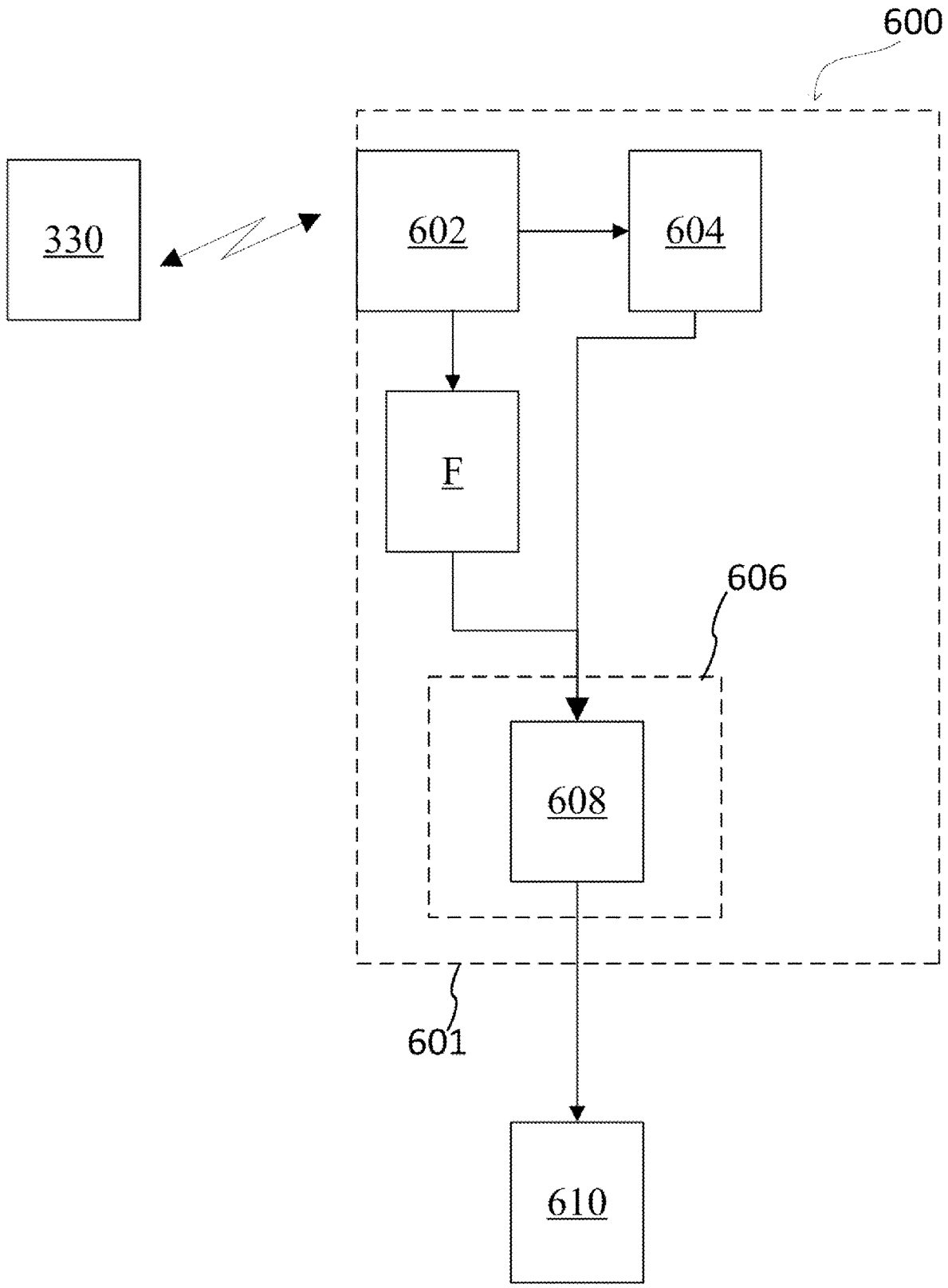
Figure 6C:
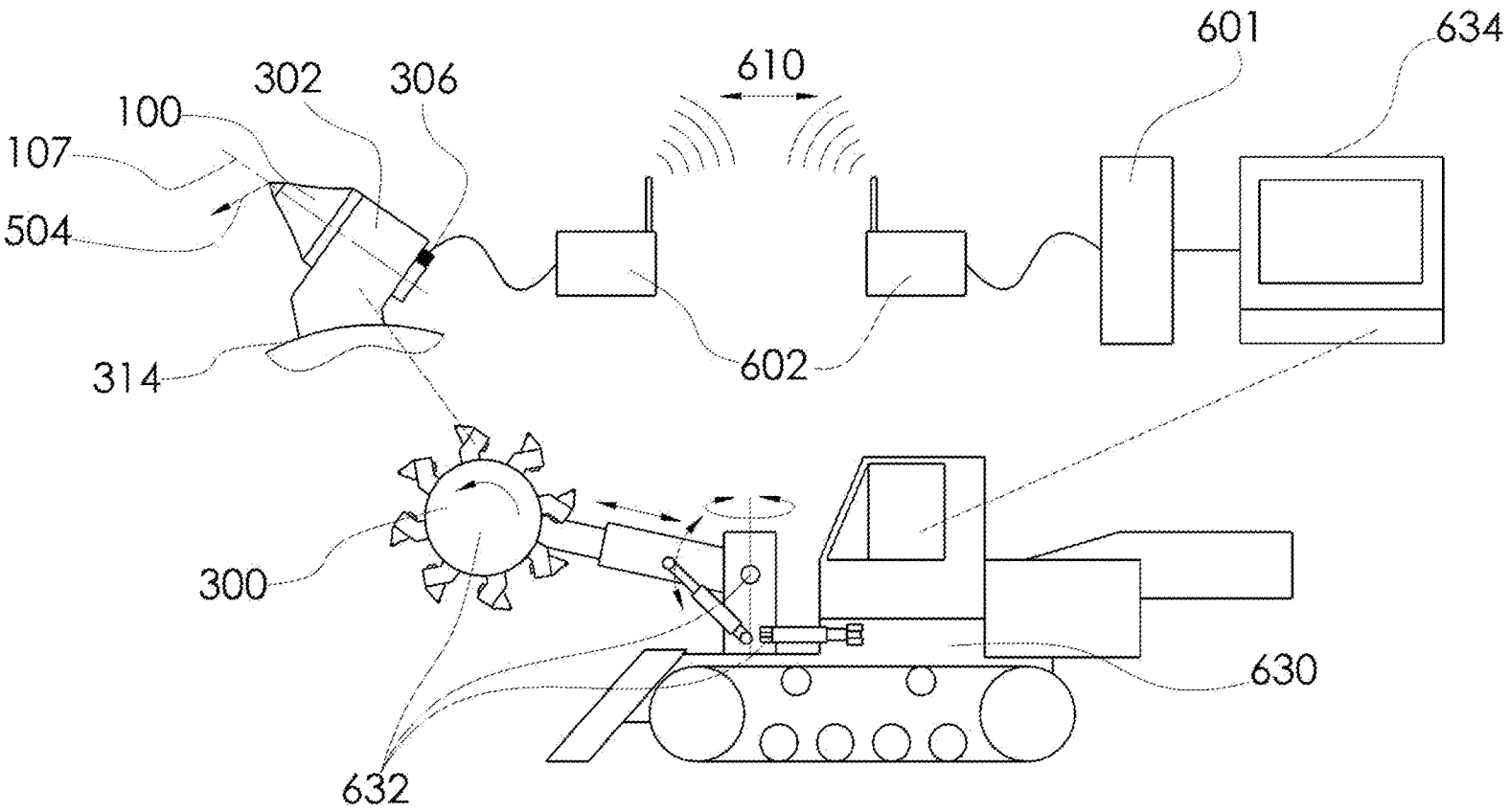

FIG. 6A to FIG. 6C each show a excavation system 600 according to different embodiments. The excavation system 600 may comprise at least one (e.g., exactly one or more than one) holding device 300. The excavation system 600 may comprise the signal processing system 601.

The holding device 300 may comprise the data processing device 330. A machine pick 100 may be inserted in the holding device 300. The material excavation system 600 may, for example, comprise the material excavation device 200. One or more sensors 306(*n*=1 to N) of the holding device 300 may be set up to sense the sensor-sensible scale 112 of the machine pick 100. The data processing device 330 may be set up to receive the data sensed by one or more sensors 306(*n*=1 to N) and transmit it to the signal processing system 601.

The signal processing system 601 may comprise a third communication interface 602. The third communication interface 602 may be set up to communicate with the second communication interface 338 according to a communication standard. For example, the third communication interface 602 may be a wireless interface and may communicate with the second communication interface 338 according to one of the standards described herein (e.g., Bluetooth, Zigbee, 3G, 4G, 5G, WLAN, etc.). Clearly, the signal processing system 601 may receive the data 604 sensed by one or more sensors 306(*n*=1 to N).

The signal processing system 601 may optionally comprise one or more than one additional communication interface. This communication interface may be set up to communicate with sensors on the pick carrier or in the drive of the same in accordance with a communication standard. The signals from the additional sensors may be used to assign the measured values determined by the data processing device 330 to a spatial cutting point and/or to obtain supplementary information on the operating parameters of the material excavation system 600, on the basis of which the measured values may, for example, be compensated or classified. For example, the signal processing system 601 may comprise one or more sensors for determining a (e.g., global or local) position of the excavation system 600. For example, one or more than one additional sensor may comprise one or more sensors for sensing a rotational speed (e.g., of the bearing device 632), a hydraulic and/or electrical pressure output, acoustic signals, optical signals, and/or digital document management (DMS) information.

Optionally, the signal processing system 601 may be a cloud-based processing system. For example, the signal processing system 601 may be implemented in a cloud. Clearly, the data processing device 330 may be set up to transmit the data sensed by one or more sensors to a cloud for data processing.

According to various embodiments, the signal processing system 601 may be a local processing system (e.g., as part of a material excavation machine, such as a rock excavation machine). For example, the signal processing system 601 may be implemented in a remote control and/or a control unit of the excavation system 600.

According to various embodiments, the signal processing system 601 may be set up to output a signal 610 based on the machine pick 100 sensed by at least one sensor of one or more sensors 306(*n*=1 to N). The signal processing system 601 may be set up to output the signal 610 based on the data 604 sensed by one or more sensors 306(*n*=1 to N). Clearly, one or more sensors 306(*n*=1 to N) may sense a movement of the machine pick 100 relative to the pick holder 302 by means of the sensor-sensible scale 112 or the sensor-sensible scales 112(1), 112(2), 112(3), 112(4) and the signal processing system 601 may determine the signal 610 based on this sensed movement. The movement of the machine pick 100 may be a movement of the machine pick 100 relative to the pick holder 302 or a deformation of the pick.

The signal 610 may represent a quality of an object excavated by the machine pick 100. The quality of the excavated object may, for example, be a property of the excavated object. A property of the excavated object may be, for example, a (Mohs) hardness, a tensile or compressive strength, a grain size or a conglomerate distribution, a cleavage, a water content, an abrasiveness, etc.

The quality of the excavated object may comprise a change in one or more material properties (e.g. a change in hardness, a change in strength, fissure, water content, etc.).

The properties of a material may influence the fracture characteristics of the material. These material-specific fracture characteristics (e.g. brittle fracture or ductile fracture, chip shape and/or chip size, influence of the grain size distribution, etc.) may lead to a material-specific movement pattern of the machine pick 100.

Clearly, the material properties of the excavated object may influence a mechanical excitation of the machine pick 100, wherein the response of the machine pick 100 to the excitation may be sensed. The sensing of the response of the machine pick 100 may comprise sensing a movement (e.g. a translation and/or a rotation) of the reference element 106 or the scale, sensing a deformation (e.g. elongation or compression) of the reference element 106 or the scale, e.g. sensing a frequency thereof. For example, a frequency (e.g. of the translation and/or rotation) at which the reference element is moved and/or deformed may be sensed in response to the excitation of the machine pick 100. Based on the sensed response, these material properties may be inferred (e.g. they may be calculated or classified).

The signal 610 may alternatively or additionally represent a state of the machine pick 100. The state of the machine pick 100 may, for example, be a wear state of the machine pick 100. If the pick tip 102 is no longer pointed (e.g. rounded) and/or partially broken off, this may lead to a sensible change in the fracture characteristic. In illustrative terms, wear of the machine pick 100 may change a movement (e.g. a translation, a rotation, a frequency of a translation and/or rotation, etc.) of the machine pick 100 when excavating an object, so that the wear state of the machine pick 100 may be inferred on the basis of the sensed movement of the machine pick 100. In one example, the material excavation system 600 may comprise a plurality of machine picks set up according to the machine pick 100, wherein the signal 610 output for one machine pick 100 of the plurality of machine picks has deviations from the signals 610 output for the other machine picks of the plurality of machine picks. These deviations may be indicative of wear of the machine pick 100. In another example, the material excavation system 600 may store in a memory (e.g., upper and/or lower) limit values for the signal 610 and a signal 610 outside (e.g., below or above) the range defined by the limit values may indicate or at least suggest wear of the machine pick 100.

The signal processing system 601 may be coupled to one or more processors 606. For example, the signal processing system 601 may comprise one or more processors 606 (see, for example, FIG. 6A and FIG. 6B). However, the signal processing system 601 may also be connected to a server (e.g., a cloud) as a local processing system using a corresponding communication interface. In this case, the server may additionally or alternatively comprise one or more processors for data processing as well as interfaces to further sensors that provide additional information about the excavation system, for example for a data fusion analysis. In this case, the signal processing system 601 may receive the determined information described herein (e.g. the signal 610, e.g. an indication of a movement of the machine pick 100) from the server by means of the communication interface.

As described herein, the data 604 sensed by one or more sensors 306($n$=1 to N) may represent a distance of the reference element 106 from the respective sensor 306($n$), a distance (e.g., an amplitude) by which the reference element 106 moves relative to the sensor 306($n$), a frequency at which the reference element 106 moves (e.g., a frequency of a translation and/or a frequency of a rotation and/or a frequency of movement of the cutterhead 108 due to a pick deformation).

One or more processors 606 may be set up to implement a model 608. The model 608 may be stored in a local memory of the signal processing system 601 and/or in a cloud storage. The model 608 may be set up to perform one or more than one of the following processes: a data correction (comprising, for example, a normalization, a drift correction, a noise suppression, an outlier identification and/or a filtering), an (evolution) spectral analysis, a statistical time series analysis, a classification (for example, by means of a histogram analysis and/or by means of one or more neural networks), a pattern recognition, etc.

The model 608 may be set up to output the signal 610 in response to an entry of input data. The input data may comprise data 604 sensed by one or more sensors 306($n$=1 to N). Optionally, the input data of the model 608 may further comprise one or more of the following group of data: Geodesics (geo-coordinates, reference values, parameters), reference values for signal amplitudes, spectral characteristics, reference patterns (for example as pattern time series, pattern spectra, pattern images), digitized and/or pre-processed sensor data, processed sensor data (e.g. displacements, accelerations, frequencies), operating data of the working machine.

The signal 610 may, for example, comprise classification values related to geodata (e.g. material strength classes 1 . . . K) and/or status values related to geodata (e.g. wear states 1 . . . N).

According to various embodiments, the sensed data 604 may comprise (e.g., among other things) or at least represent the displacement, s. Consequently, the displacement, s, (at least as part of the sensed data 604) may be provided to the model 608. Alternatively, the sensed data 604 may (e.g., among other things) represent (e.g., have information about) the pick deformation, e.g., the movement of the pick head 108. In this case, the deformation may be provided to the model 608 as at least a portion of the sensed data 604.

Additionally or alternatively, one or more processors 606 may be set up to determine the force, F, acting on the machine pick 100 based on the displacement, s, (e.g. according to F=k·s) or the pick deformation. For example, the model 608 may be set up to output the signal 610 based on the determined force, F. The model 608 may clearly map the force, F, to a condition of the object excavated by means of the machine pick 100 and/or a condition of the machine pick 100.

Additionally or alternatively, one or more processors 334 of the data processing device 330 may be set up to determine the force, F, acting on the machine pick 100 based on the displacement, s, or the pick deformation (e.g. according to F=k·s). Here, the data processing device 330 may be set up to transmit the determined force, F, to the signal processing system 601 in addition (or as an alternative) to the sensed data 604. According to various embodiments, the model 608 may be set up to output the signal 610 based on the determined force, F, and/or on the sensed data 604 (see, for example, FIG. 6B). Clearly, the force, F, may be determined based on the translation of the machine pick 100 along the longitudinal axis 107 and the nature of the object excavated by means of the machine pick 100 and/or the nature of the machine pick 100 (i.e. the signal 610) may be determined based on the other translations and/or rotations of the machine pick 100 described herein in combination with the acting force, F (e.g. by means of the model 608). Alternatively, the force, F, may be determined on the basis of the pick deformation, which allows conclusions to be drawn about the nature of the object excavated by means of the machine pick 100 and/or the nature of the machine pick 100 (i.e. the signal 610).

Clearly, the signal processing system 601 may distinguish (differentiate) between materials to be excavated or excavated (e.g. automatically) or classify them based on patterns in measured values (the sensed data 604).

The model 608 may be specific to a particular material excavation process. For example, the model 608 may be a deposit model that maps the data 604 sensed during a rock cutting operation to material properties of the rock being cut or to be cut.

The model 608 may be a machine learning based model. For example, the model 608 may comprise a reinforcement learning algorithm. According to various embodiments, at least a portion of the model 608 may be implemented using a neural network. A neural network may comprise or be any type of neural network, such as an autoencoder network, a convolutional neural network (CNN), a variational autoencoder network (VAE), a sparse autoencoder network (SAE), a recurrent neural network (RNN), a deconvolutional neural network (DNN), a generative adversarial network (GAN), a forward-thinking neural network, a sum-product neural network, etc. The neural network may comprise any number of layers and the trained neural network may have been trained using any type of supervised or unsupervised learning method. These methods may include, for example, elastic or classical backpropagation.

According to various embodiments, the machine learning based model 608 may be trained. Training the model 608 may comprise determining a plurality of data sets, wherein determining each data set may comprise: analyzing (e.g., measuring) the properties of the material to be excavated and assigning them to a material class, sensing movements of the machine pick 100 in the excavation system 600 using one or more sensors 306, optionally sensing and assigning operational data when using the excavation system 600, and determining unique characteristic values or characteristics of these movements for the analyzed material class and the sensed operational data. Subsequently, the model 608 may be trained using the determined plurality of data sets in such a way that the trained model maps from movements of the machine pick 100 to properties of the excavated material, taking the operating state of the excavation system 600 into account.

According to various embodiments, one or more processors 606 may be set up to determine an indication of a movement and/or deformation of the machine pick 100. One or more processors 606 may be set up to determine the movement and/or deformation of the machine pick 100 based on the sensed data 604. For example, the model 608 may be set up to output the signal 610 in response to an input of the determined movement and/or deformation of the machine pick 100.

According to various embodiments, one or more processors 606 may be set up to determine an indication of a force acting on the machine pick 100. One or more processors 606 may be set up to determine the force acting on the machine pick 100 based on the sensed data 604. For example, the model 608 may be set up to output the signal 610 in response to an input of the determined force acting on the machine pick 100.

According to various embodiments, one or more processors 606 may use additional data to determine the signal 610. For example, the additional data may also be input to the model 608 to determine the signal 610. For example, the additional data may comprise operational data of one or more components of the material excavation system 600 or, for example, the working machine that drives and controls the material excavation system.

FIG. 6C shows the material excavation system 600 according to various embodiments with an exemplary cutting machine 630.

The cutting machine 630 may, for example, comprise or be a rock cutting machine used in mining, a rock cutting machine used in underground construction or a rock cutting machine used in surface construction. A cutting machine used in undergreound construction may, for example, be used to construct or demolish foundations or to excavate or repair a tunnel. A cutting machine in surface construction may, for example, be used to construct or demolish buildings. A rock cutting machine used in mining may, for example, be a roadheader, a surface miner, a continuous miner, a shaft boring machine, a shearer-loader, a road milling machine, a trench cutter, a hydraulic excavator with a drum cutter or a comparable device. According to various embodiments, the machine pick 100 may be a conical pick or a radial pick. A drum cutter may, for example, comprise a longitudinal cutting head or a transverse cutting head or a cutting wheel or a cutting chain.

According to various embodiments, the excavation system 600 may comprise at least bearing device 632. Optionally, the bearing device 632 may be part of the holding device 300. The bearing device 632 may be set up to provide at least one degree of freedom to the carrier 314 of the holding device 300 in such a way that the pick holder 302 (and optionally the machine pick 100) may be moved in a direction 504 oblique to the longitudinal axis 107 and/or may be pressed against a surface along the longitudinal axis 107. This enables, for example, the material excavation described in FIG. 5A to FIG. 5C.

According to various embodiments, attack forces may be transmitted to the machine pick 100 by means of the carrier 314.

The signal processing system 601 may receive the data 604 sensed by one or more sensors 306($n$=1 to N) by means of the communication interface 602. According to various embodiments, the excavation system 600 may comprise a visualization device 634. The visualization device 634 may be suitable for conveying instructions to operator (e.g., an operator of the cutting machine 630) for operating the material excavation system 600 based on the output signal 610. For example, a material property of the excavated rock may be visually displayed to the operator as a signal 610 (e.g. as a strength value, as a classification value, as a color indication, such as a first color for "hard" and a second color for "soft", etc.). The visualization device 634 may, for example, be disposed in a driver's cab of the cutting machine 630. An operator of the excavation system 600 may be able to adjust the excavation process (e.g. the rock cutting process) by means of the signal 610. It is not necessary for the operator to be able to see the material to be excavated or the excavated material.

According to various embodiments, for example, the normal force FN may be adapted (e.g. to the strength of the material being excavated). A normal force that is not adapted to the material excavation process may lead to significantly increased wear of the machine pick 100. Clearly, adapting the normal force FN to the output signal 610, which characterizes properties of the material excavated and presumably to be further excavated, may reduce wear of the machine pick 100. Optimum operational management may, for example, comprise a maximum normal force FN with simultaneously low wear of the machine pick 100.

Furthermore, wear of the machine pick 100 may lead to wear of the pick holder 302. Consequently, adjusting the normal force FN may also reduce wear of the holding device 300. A damaged (e.g. worn) holding device 300 would require replacement of the holding device 300, e.g. by welding another holding device 300 to the carrier 314. This would result in high costs for material and working time as well as the costs of downtime. In addition, such a replacement would never reach the original durability of the holding device 300, thus reducing the practical value of the cutting machine 630—which may be avoided by adjusting the normal force made possible by the excavation system 600.

According to various embodiments, the speed of movement (also referred to as cutting speed) in the direction 504 and/or the contact area during cutting (also referred to as cutting depth) may be adjusted as an alternative or in addition to the normal force FN.

The material excavation system 600 may comprise a plurality of machine picks. The embodiments described herein enable a determination of an optimal normal force FN for each individual machine pick 100 of the plurality of machine picks.

According to various embodiments, the material excavation system 600 may comprise at least one actuator. The actuator may be set up to influence a movement of the machine pick 100. The actuator may be set up to influence a movement of the machine pick 100 based on the signal 610. For example, the actuator may change (e.g. adjust) the speed of movement of the machine pick 100 (in direction 504) and/or the normal force FN depending on a determined strength (as signal 610) of the material being excavated. Clearly, the excavation system 600 may automatically (or at least semi-automatically) adjust the excavation process (e.g., the rock cutting process) based on the signal 610 by means of the actuator. No operator is required for this purpose.

According to various embodiments, sensing the reference element 106 of the machine pick 100 by one or more sensors 306 of the holding device 300 may provide real-time feedback on the movement of the machine pick 100. Real-time, as used herein, may be understood to mean less than 1 minute (e.g., less than 30 seconds, e.g., less than 10 seconds, e.g., less than 1 second) between the excavation of a layer of rock and the output of the associated signal 610.

As a result, the excavation process (e.g. cutting process) no longer needs to be interrupted regularly to visually inspect the newly exposed excavation surface (also known as the face). This reduces the time required for excavation and therefore also the operating costs. This enables selective cutting with continuous feedback, which does not have to be interrupted due to dust formation, overburden or pick clogging. With regard to a rock cutting process, the real-time feedback enables selective cutting, which reduces the proportion of accessory minerals, inclusions and/or waste rock in the cut rock. This also makes it possible to reduce expenses for the subsequent processing of the raw minerals, for example transportation costs, storage costs, investment costs and process costs.

The feedback on the material to be excavated (e.g. rock, earth, ore, concrete, asphalt, etc.) enables process optimization (e.g. by means of selective cutting) in various industries, such as underground construction, tunnel construction, demolition, etc. The detection of wear of the machine pick 100 described herein may lead to an additional cost reduction (e.g. visual inspection of the machine pick 100 is no longer necessary).

According to various embodiments, the excavation system 600 may comprise at least one other communication interface. The at least one other communication interface may be a wired interface or a wireless interface. According to various embodiments, the signal processing system 601 may be set up to transmit (e.g., integrate into) the generated signals 610 and/or the data 604 to a higher-level data processing system by means of the communication interface 602 and/or by means of the at least one other communication interface. The higher-level data processing system may be set up for updating the model 608 (e.g. the deposit model), for operational documentation and/or for maintenance planning. For example, maintenance may be planned based on the determined wear state of the machine pick 100. According to various embodiments, geological data relating to the object to be excavated (e.g., a deposit, a structure, and/or a construction site) may be determined by the higher-level data processing system based on the data 604 and/or the signal 610. According to various embodiments, the additional data may be used for maintenance and/or repair planning.

Figure 7:
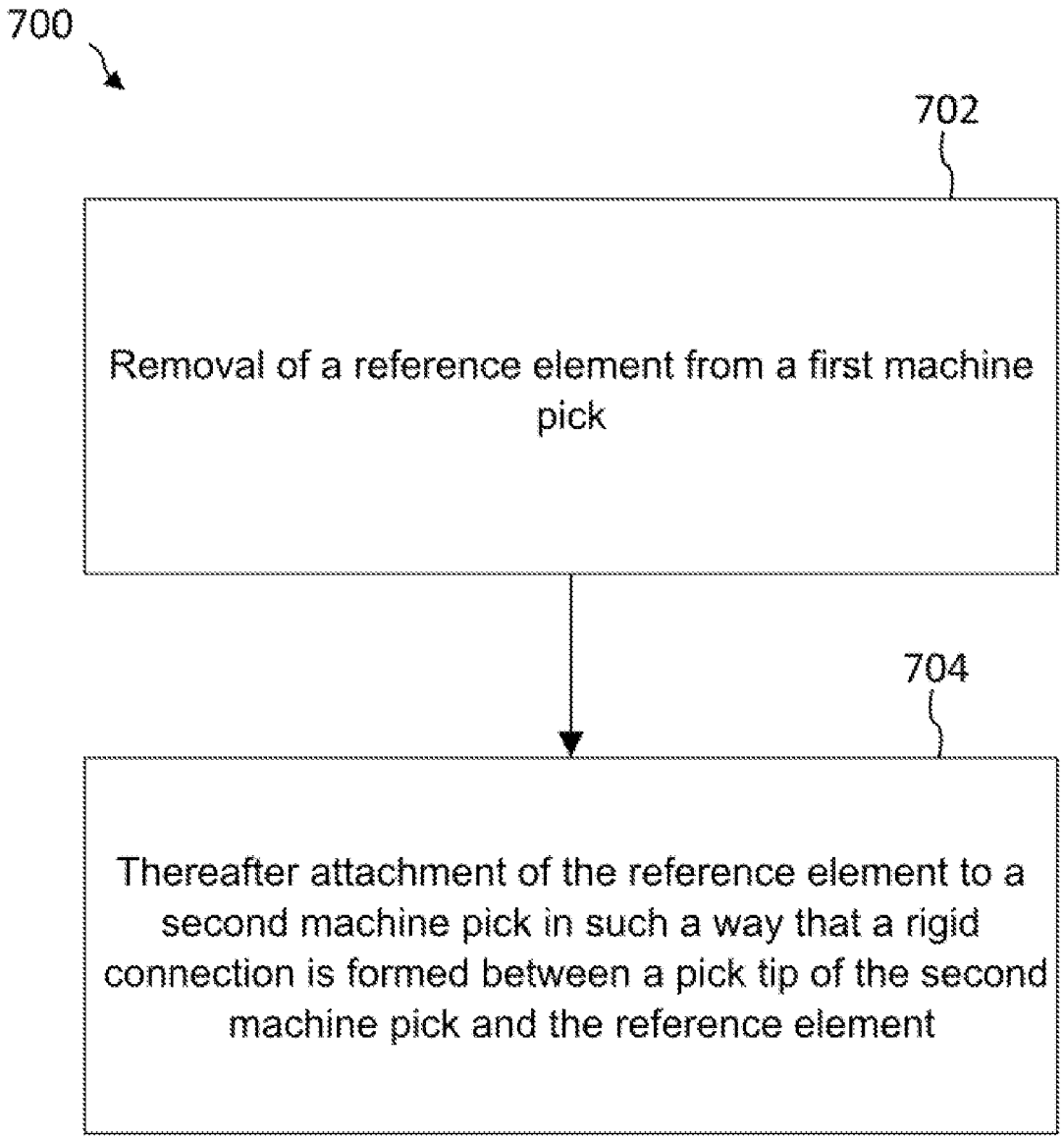
FIGS. 7 to 11 each show a flow chart of a method according to various embodiments.

FIG. 7 shows a flowchart of a method 700 according to various embodiments.

The method 700 may comprise removing a reference element from a first machine pick (in 702). For example, the reference element may be detached from the first machine pick by releasing a rigid (e.g., form-fit and/or force-fit) connection between the reference element and the first machine pick. The reference element may comprise a magnetizable material that forms a sensor-sensible scale.

The first machine pick may, for example, be set up in accordance with the machine pick 100, which comprises the reference element 106.

The method 700 may comprise subsequently adding the reference element to a second machine pick (in 704). According to various embodiments, the reference element may be added to the second machine pick in such a way that a rigid (e.g., form-fit and/or force-fit) connection is formed between a pick tip of the second machine pick and the reference element. For example, after adding the reference element, the second machine pick may be set up according to the machine pick 100.

Clearly, a reference element may be used in succession for different machine picks by means of the method 700. Clearly, a reference element of a machine pick (e.g. the reference element 106 of the machine pick 100) may be replaceable. This may, for example, reduce operating costs of a device that uses, for example, machine picks 100.

Figure 8:
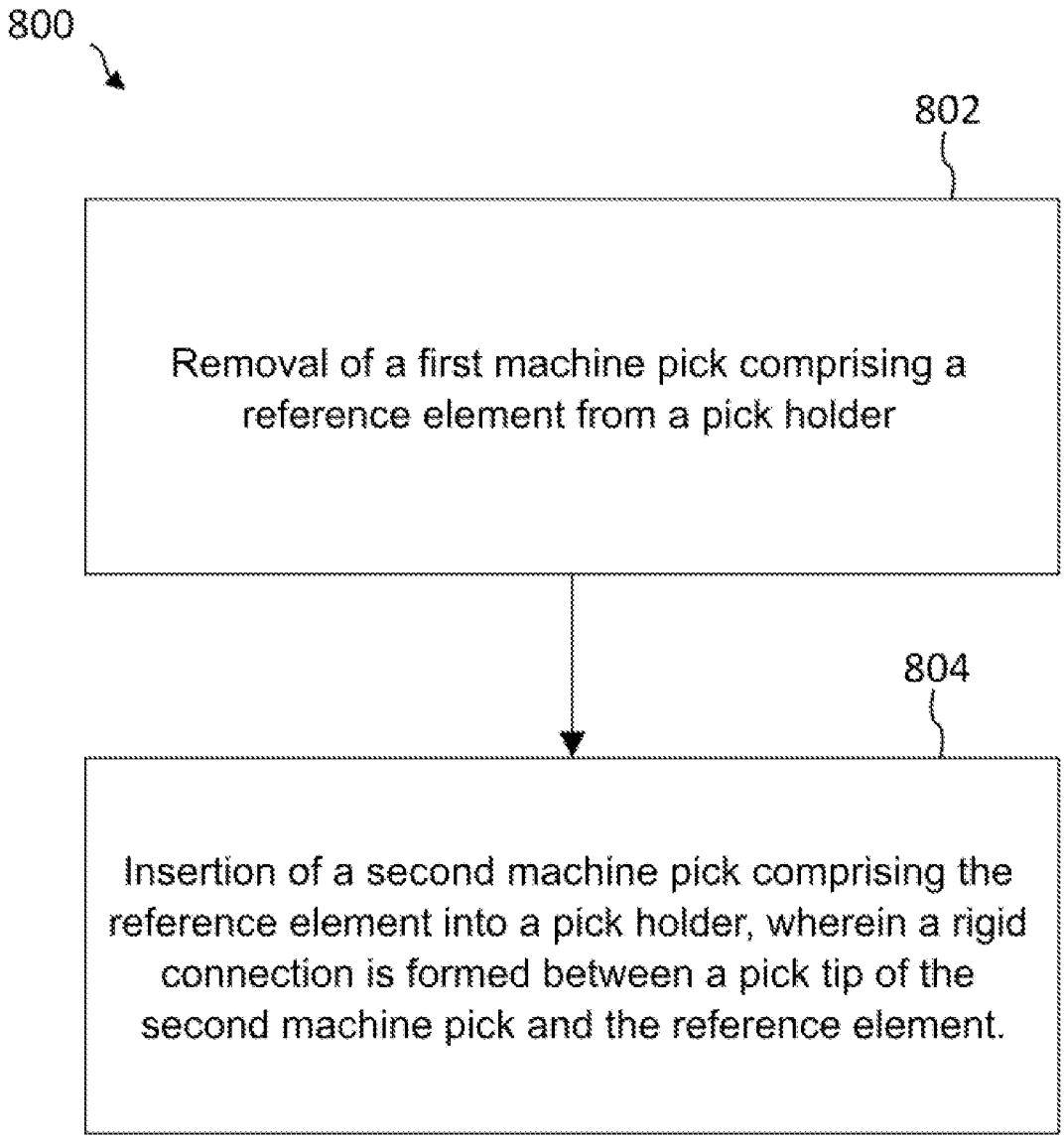

FIG. 8 shows a flowchart of a method 800 according to various embodiments.

The method 800 may comprise removing a first machine pick, comprising a reference element, from a pick holder (in 802). The reference element may comprise a magnetizable material that forms a sensor-sensible scale.

The first machine pick may, for example, be set up in accordance with the machine pick 100, which comprises the reference element 106. The pick holder may, for example, be part of the holding device 300 (as pick holder 302).

The method 800 may comprise inserting a second machine pick, comprising the reference element, into a pick holder (in 804). According to various embodiments, the second machine pick may be inserted into the pick holder in such a way that a rigid (e.g., form-fit and/or force-fit) connection is formed or is between a pick tip of the second machine pick and the reference element. The first machine pick may, for example, be set up in accordance with the machine pick 100. The second machine pick may be inserted into the same pick holder or another pick holder.

For example, the pick holders may be part of the holding device 300. The first machine pick may be removed from a pick holder 302 of the holding device 300 (in 802), the reference element may be removed from the first machine pick and added to the second machine pick (e.g., according to the method 700), and the second machine pick may be inserted into the pick holder 302 or another pick holder.

Figure 9:
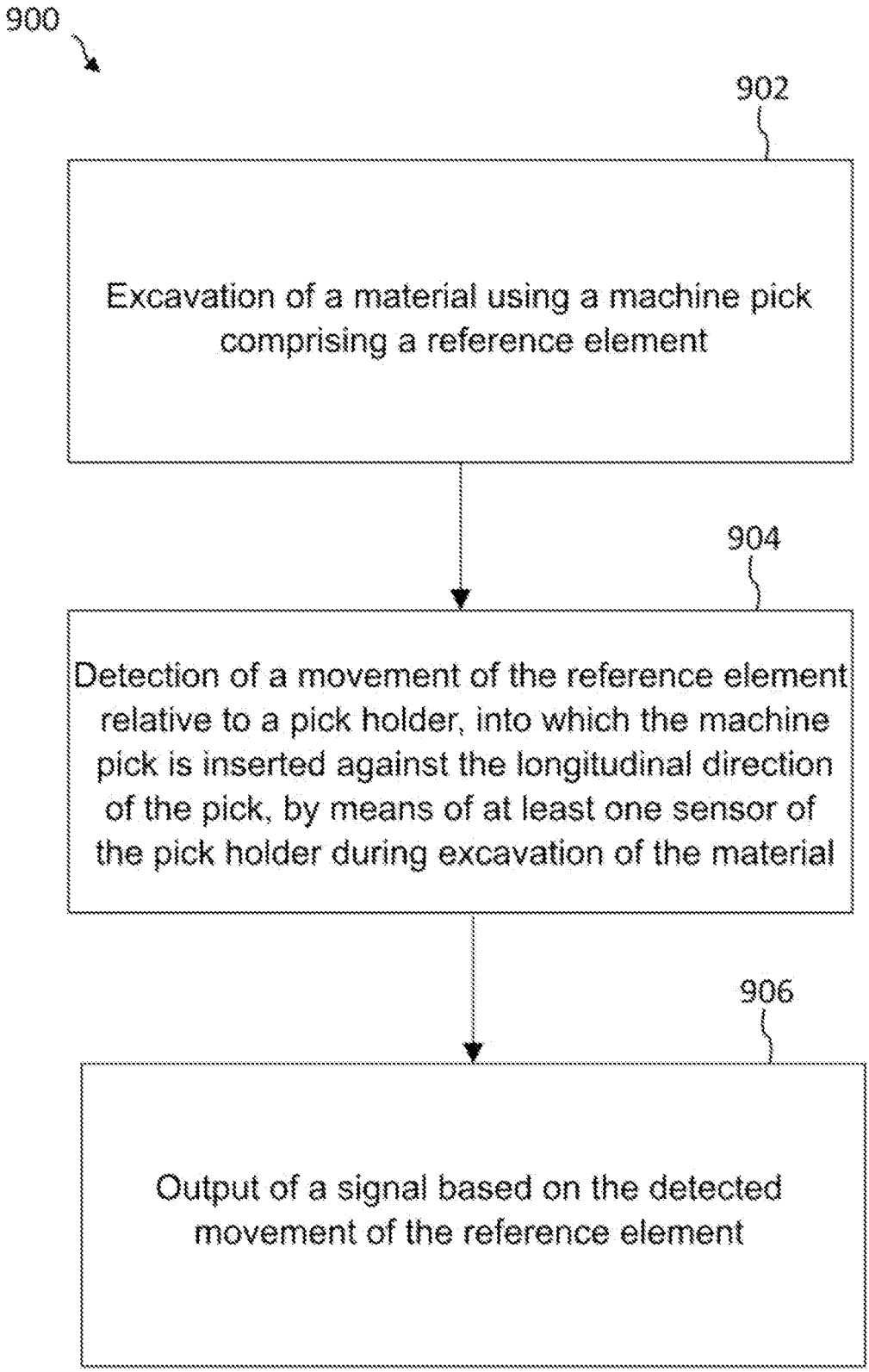

FIG. 9 shows a flowchart of a method 900 according to various embodiments.

The method 900 may comprise excavation of a material (e.g., cutting a rock) using a machine pick comprising a reference element (in 902). An exemplary excavation of material is described with reference to FIG. 5A through FIG. 5C.

The method 900 may comprise sensing a movement of the reference element relative to a pick holder, into which the machine pick is inserted against the longitudinal direction of the pick, by means of at least one sensor of the pick holder during excavation of the material (in 904).

The machine pick may be set up in accordance with the machine pick 100. The pick holder may be part of the holding device 300 (as pick holder 302). For example, the machine pick 100 may be inserted into the pick holder 302 against the longitudinal direction 107. Here, at least one sensor of one or more sensors 306 may sense the movement of the machine pick 100 relative to the pick holder 302 during excavation of the material.

The method 900 may comprise outputting a signal based on the sensed movement of the reference element (in 906). The output signal may be, for example, a sensor signal. The output signal may comprise or at least represent detected data of the at least one sensor.

According to various embodiments, the method 900 may further comprise determination of a parameter representing a force acting on the machine pick based on the output signal.

Clearly, the method 900 may be a material differentiation method.

Figure 10:
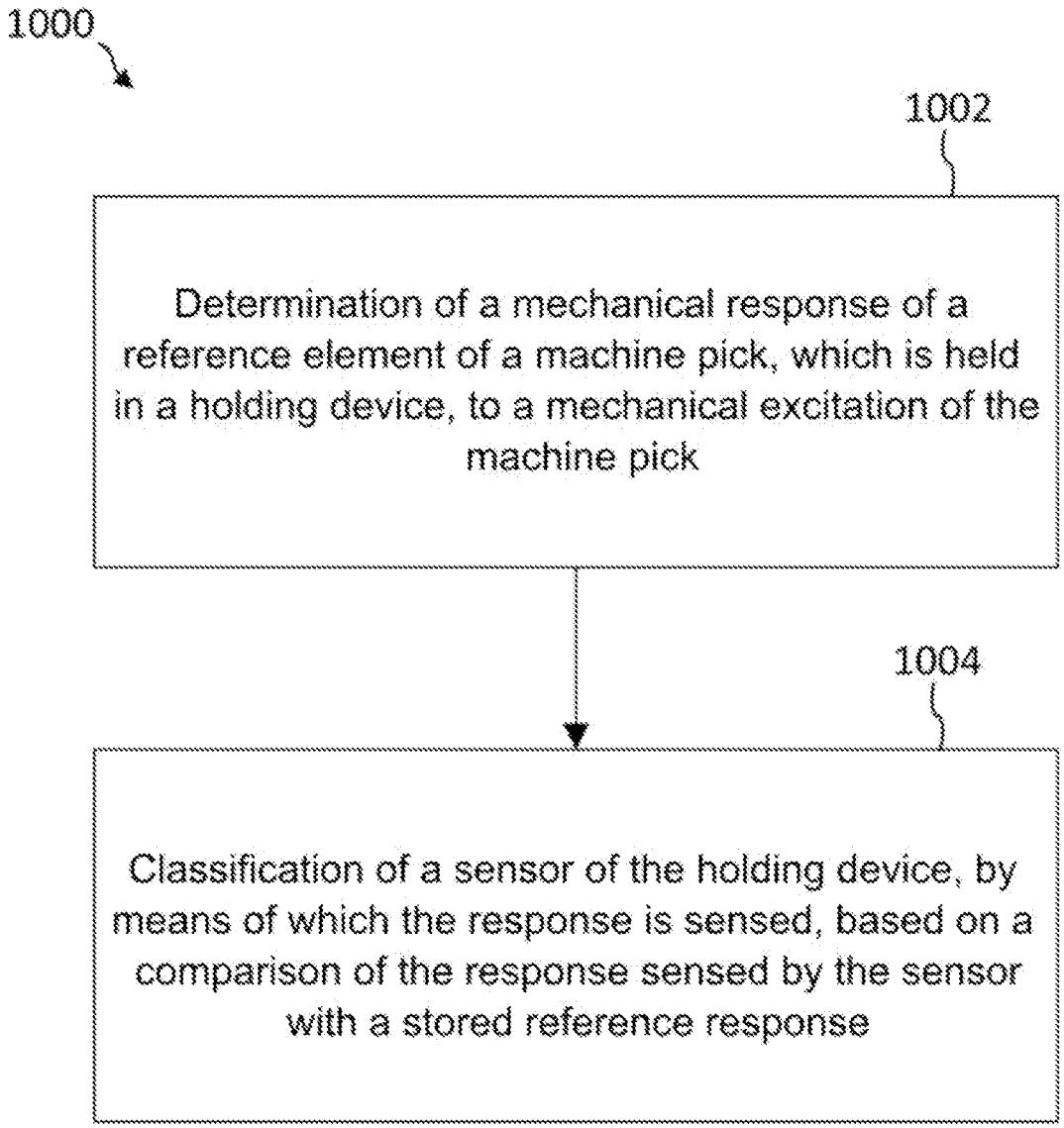

FIG. 10 shows a flowchart of a method 1000 according to various embodiments.

The method 1000 may comprise determination of a mechanical response of a reference element (e.g., its change or the frequency of the change) of a machine pick received in a holding device to a mechanical excitation of the machine pick (in 1002).

The mechanical excitation of the machine pick may result in a deflection of the machine pick relative to the holding device and/or from a reference position. The method 1000 may comprise, for example, generating instructions to excite the deflection of the machine pick. The response of a reference element may comprise, for example, a movement (e.g., a vibration) and/or a deformation of the reference element that is sensed (e.g., its frequency).

The method 1000 may comprise classifying a sensor of the holding device, by means of which the response is sensed, based on a comparison of the response sensed by means of the sensor with a stored reference response (in 1004). The method 1000 may optionally further comprise generating a signal indicating a result of the classifying. The signal may indicate whether the response of the machine pick fulfills a stored criterion. The criterion may be fulfilled if a deviation of the response of the machine pick from a stored reference response is smaller than a (e.g. stored) threshold value.

The method makes it possible, for example, to sense impurities in the receptacle area, on the reference element (e.g. on the sensor-sensible scale) and/or on the sensor. The method may enable the sensor to be calibrated. The method may enable a functional test of a sensor.

By moving the machine pick in the holding device in a targeted manner and comparing the measured values with target values, the method may provide indications or criteria that rock or metal dust has accumulated in the sensor area and is hindering the detection of the movement of the machine pick or increasing the risk of premature wear.

According to various embodiments, the machine pick may be moved to defined impact points, the signal from at least one sensor may be sensed and the sensed signal may be compared with a stored reference response (e.g. a previously determined, stored calibration signal).

The machine pick may be deflected mechanically, for example manually. According to various embodiments, the machine pick may be deflected semi-mechanically using a deflection device. The deflection device may be set up in such a way that the machine pick is moved by the deflection device into the predefined impact positions by selecting the corresponding parameters. The sensor may sense the associated measured values and the sensed measured values may be compared (e.g. by means of the data processing device 330) with the reference response. For example, the measured values sensed by a plurality of sensors may be compared in summary with the reference response and/or a respective reference response associated with one of the plurality of sensors.

The reference response may be a result of a qualitative and/or quantitative dual or gradual assessment of the clogging and/or wear state.

Figure 11:
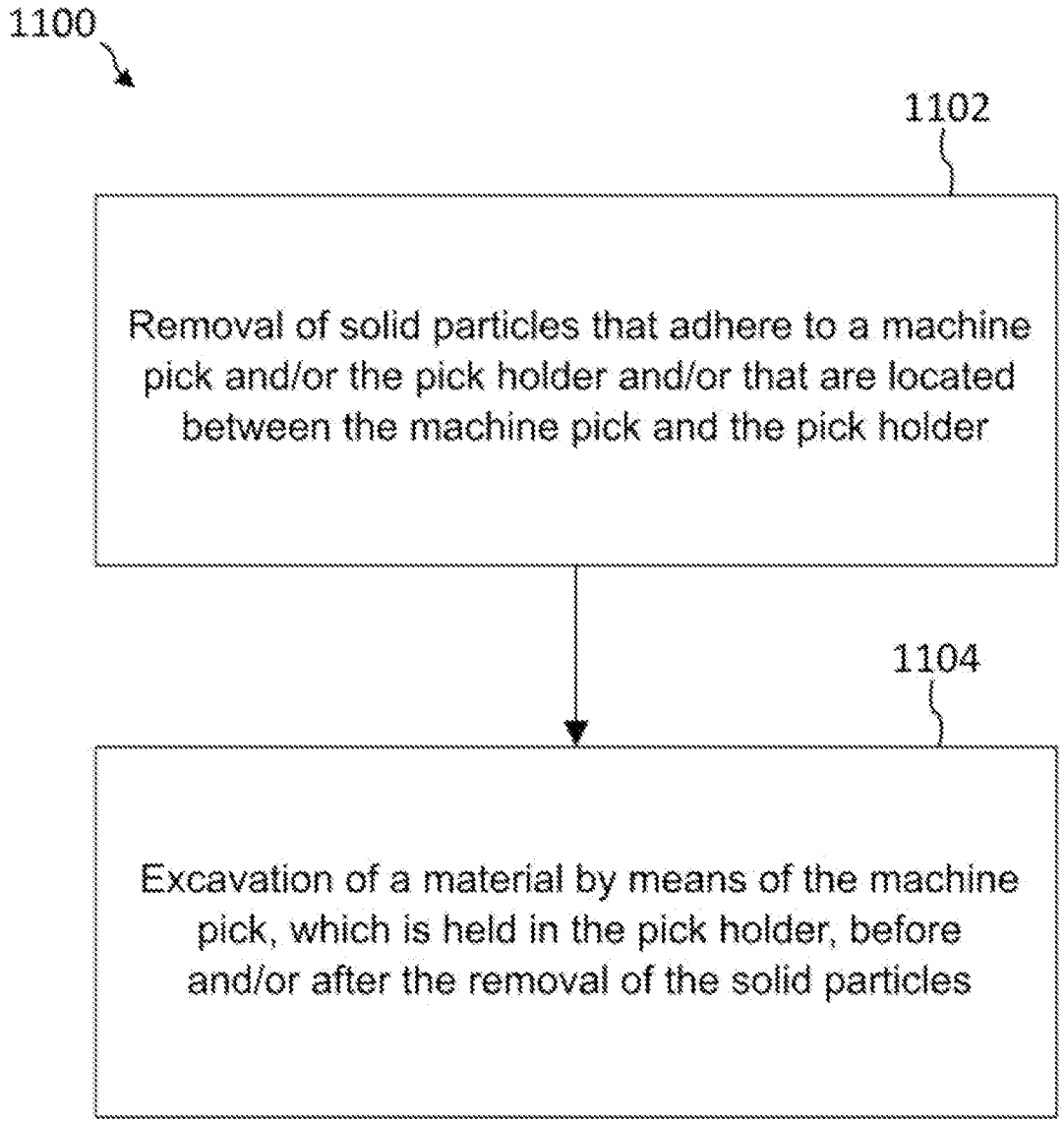

FIG. 11 illustrates a flowchart of a method 1100 for operating an excavation device according to various embodiments. For example, the method 1100 may be a method for restoring and/or maintaining function of a sensor of the excavation device.

The excavation device may comprise the holding device 300. The excavation device may be set up according to the excavation device 200.

The method 1100 may comprise removing solid particles adhering to a machine pick and/or the pick holder and/or disposed between the machine pick and the pick holder (in 1102). The solid particles may, for example, be removed by means of erosion and/or magnetic binding (e.g. capture).

Here, for example, an area in the vicinity of the sensor may be cleaned from rock and/or metal dust that has penetrated.

The solid particles may, for example, be removed using compressed air. The process may use compressed air, for example, to keep the sensor system dust-free or to make it dust-free again after a certain period of time. Magnetic solid particles may, for example, be removed using a fishing magnet. The fishing magnet (or optionally several catch magnets) may collect metal chips before they may reach the sensor-sensible scale and/or the bias magnets of the sensor. These metal chips are produced almost exclusively at the pick tip and at the front impact surface of the pick holder by the impact of the machine pick on these and by the attack on the rock. Steel chips that accumulate on the bias magnets may distort its signal in the form of a level attenuation and/or level shift proportional to the deposit mass. If the material is not removed, this corresponds to sensor wear.

The process is used to prevent wear on the reference element and/or one or more sensors and to continuously maintain the specified detection quality during operation of the excavation system. The process may be automated by using certain patterns in the measured values to automatically detect contamination of the sensor area.

The method 1100 may comprise excavation of a material by means of the machine pick received in the pick holder before and/or after removing the solid particles (in 1104).

Figure 12A:
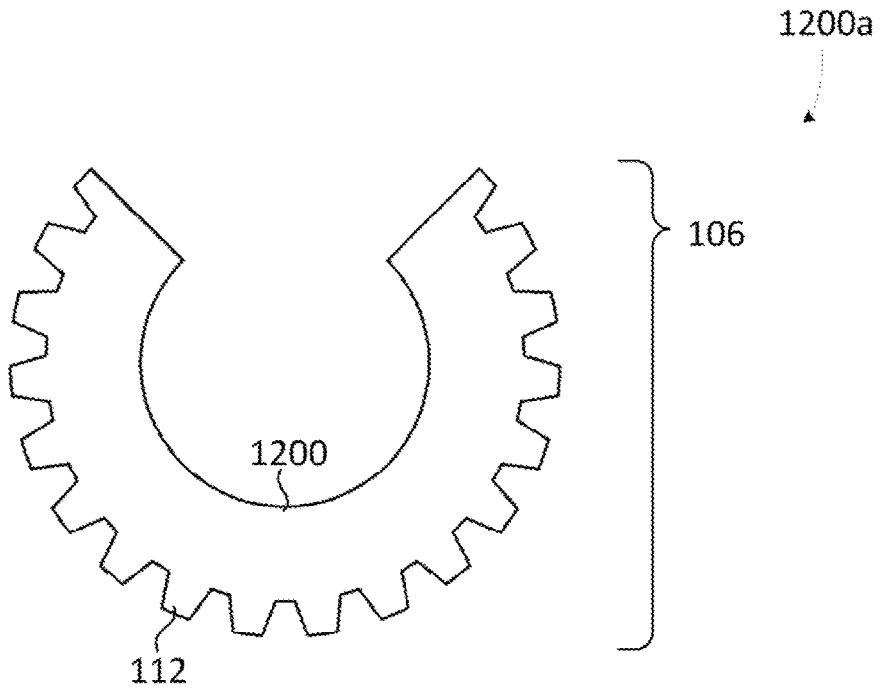
FIGS. 12A to 12C each show different embodiments in which the locking device comprises the reference element.

FIG. 12A shows the locking device 202, 204 according to various embodiments 1200*a*, in which the locking device 202, 402 comprises the reference element (then also referred to as the locking device 1200) or is formed therefrom. This locking device 1200 simplifies the construction and/or makes it easier to modify an existing construction.

For example, the locking device 1200 may be set up as a retaining device (e.g., retaining ring) that is set up to be inserted into a recess (e.g., groove or bore) of the locking structure 110 (e.g., the shaft 104) or otherwise in a form-fit connected with the shaft 104. For example, such a retaining device may be set up as an impact retaining device, i.e. set up to be impacted the recess.

In the exemplary implementation of embodiments 1200 shown here, a (e.g., open) retaining ring serves as the locking device 1200, which may be inserted into a circumferential groove 110 of the shaft 104. What is described in this regard may apply by analogy to any other geometry of the locking device 1200 (e.g., if it includes a locking pin) or to any other component that may be in form-fit connected to the shaft (e.g., interlocking). In this regard, it should be noted that the connection between the shaft 104 and the locking device 1200 need not necessarily be rigid, but may optionally have some clearance. This may still be sufficient, for example, to sense a rotation of the pick 100 by sensors.

The (e.g., toothed) retaining ring may comprise (or be formed therefrom) one or more than one (e.g., tooth-shaped) scale 112 of the magnetizable material, which may, for example, be spaced apart from one another. As described above, the sensor-sensible scale of the retaining ring may comprise elongated structures 112 (e.g., profiles, e.g., teeth) that extend along a surface (e.g., lateral surface) of the retaining ring substantially parallel to the longitudinal axis 107 (e.g., in the direction 105) or are concentrically disposed.

Figure 12B:
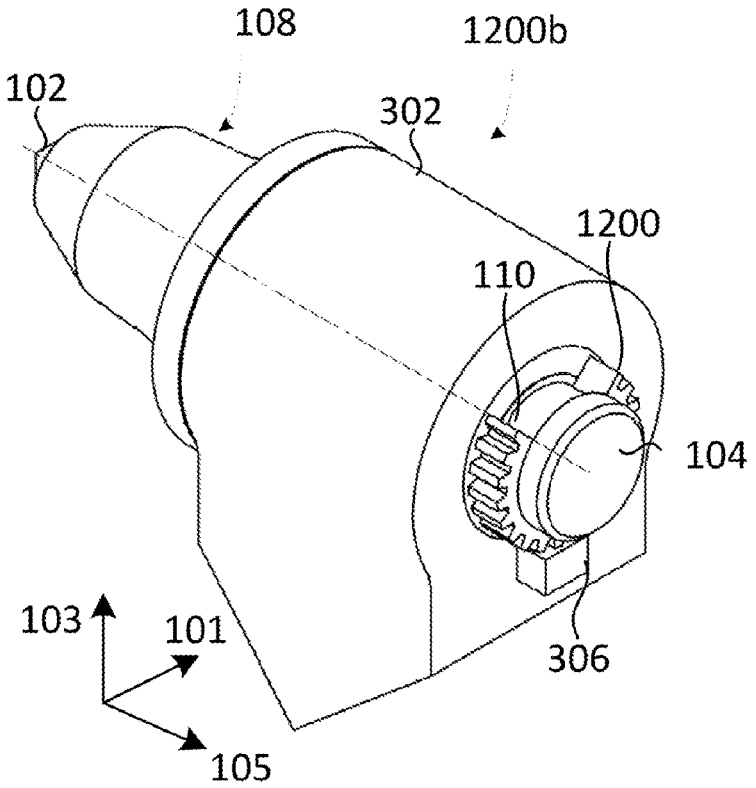
Figure 12C:
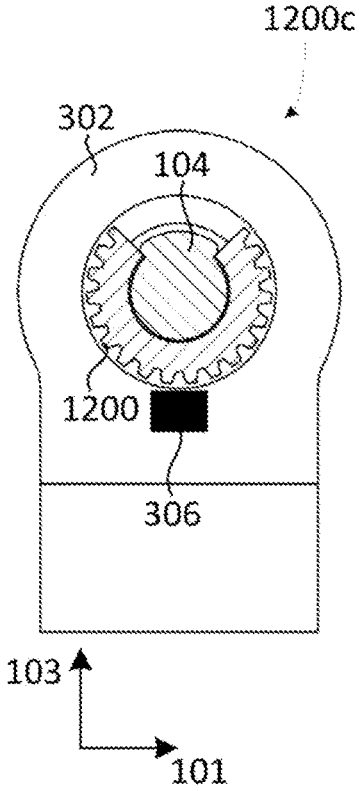

FIG. 12B shows an excavation device 200 according to various embodiments, which comprises the machine pick 100 and the holding device 300 with the locking device 1200, according to various embodiments 1200*b* in a schematic perspective view and FIG. 12B shows the excavation device 200 in a schematic cross-sectional view 1200*c* from direction 105. In the exemplary implementation shown, the shaft may be removed from the receptacle space.

Various examples are described below that relate to what is described above and shown in the figures.

Example 1 is a machine pick comprising: a pick tip, a shaft extending, e.g. at an angle (e.g. 0° or more, e.g. 5° or more, e.g. 10° or more) away from the pick tip along a longitudinal axis of the machine pick; a reference element comprising at least one (i.e. one or more than one) sensor-sensible scale (e.g. made of a magnetizable material or comprising the magnetizable material); wherein the reference element, the shaft and the pick tip are connected rigidly (e.g. form-fit or material-fit) with each other; and/or wherein the reference element is connected (e.g. interlocking) in form-fit with the shaft or is at least set up for this purpose.

Example 2 is set up according to example 1, wherein the pick tip is disposed on a first end face of the shaft and/or is rigidly connected to it.

Example 3 is set up according to example 1 or 2, wherein the reference element is disposed on and/or rigidly connected to a second end face of the shaft, which is preferably opposite the first end face.

Example 4 is set up according to one of examples 1 to 3, wherein the at least one scale is disposed at least partially in a (e.g. internal or external) cavity (e.g. extending along the longitudinal axis into the shaft) of the reference element.

Example 5 is set up according to one of examples 1 to 4, wherein the magnetizable material comprises one or more than one permanent magnet, by means of which the sensor-sensible scale is formed.

Example 6 is set up according to one of examples 1 to 5, wherein sensor-sensible scale is formed from a magnetizable but not permanently magnetic material.

Example 7 is set up according to any one of examples 1 to 6, wherein at least one scale comprises one or more than one magnetic pole, each magnetic pole being provided by means of the magnetizable material and/or providing a scale element of the scale.

Example 8 is set up according to one of examples 1 to 7, wherein the reference element comprises one or more than one recess, each recess providing a scale element of the scale.

Example 9 is set up according to one of examples 1 to 8, wherein at least one scale comprises: a first scale comprising a plurality of recesses, the spacing and/or extent of which spans a dimension of the scale along a closed path, and/or a second scale comprising a plurality of recesses, the spacing and/or extent of which spans a dimension of the scale towards the shaft.

Example 10 is set up according to Example 9, wherein each of the recesses of the second scale forms a trench extending along the longitudinal axis and/or towards the pick tip, and/or wherein each of the recesses of the first scale forms a trench extending along the closed path.

Example 11 is set up according to one of examples 1 to 10, wherein at least one scale comprises: a third scale which comprises a plurality of (e.g. concentric or radial) recesses, the spacing and/or extent of which span a dimension of the scale transverse to the longitudinal axis.

Example 12 is set up according to example 11, wherein each of the recesses of the third scale forms a trench running around the longitudinal axis, and/or wherein each of the recesses of the third scale forms a trench running towards the longitudinal axis.

Example 13 is set up according to one of examples 1 to 12, wherein the reference element and the shaft are detachably connected to one another (e.g. by means of a form-fit).

Example 14 is set up according to one of examples 1 to 13, wherein the shaft is a round shaft.

In example 15, the machine pick according to any one of examples 1 to 14 may optionally further comprise: a pick head extending away from the pick tip along the longitudinal axis towards the shaft, wherein the pick head and the shaft are materially bonded.

Example 16 is a holding device comprising: a pick holder with an opening for receiving a machine pick (e.g. a machine pick according to one of examples 1 to 15), a locking device (e.g. a first type or a second type) which is set up to form a form-fit with the machine pick received in the opening, which limits movement of the machine pick along a longitudinal axis of the machine pick, a receptacle area (e.g. a cavity) to receive a portion (e.g. comprising a reference element) of the machine pick, which is exposed towards the opening (e.g. along the longitudinal axis); at least one sensor, which is disposed at the receptacle area and is set up to sense without contact the portion extending into the receptacle area (e.g. its sensor-sensible scale), wherein preferably the (e.g. ring-shaped or ring-segment-shaped) locking device (e.g. its locking ring or locking pin) having (or is formed therefrom) a (e.g. ring-shaped or ring-segment-shaped) reference element, which comprises (or is formed therefrom) at least one sensor-sensbile scale made of a magnetizable material.

Example 17 is set up according to example 16, wherein at least one sensor is set up: to sense a distance of the reference element from the sensor and/or a distance (e.g. amplitude) by which the reference element moves relative to the pick holder and/or a frequency at which the reference element moves.

Example 18 is set up according to one of the examples 16 or 17, wherein the sensor is rigidly connected to the pick holder.

Example 19 is set up according to any one of examples 16 to 18, wherein at least one sensor comprises: one or more than one magnetoresistive sensor; one or more than one Hall sensor; one or more than one capacitive sensor; and/or one or more than one inductive sensor (e.g. an eddy current sensor).

Example 20 is set up according to one of examples 16 to 19, wherein at least one sensor is set up to sense a field emanating from and/or influenced by the machine pick, wherein the field preferably being a magnetic field and/or an electric field.

In example 21, the holding device according to any one of examples 16 to 20 may further comprise: a pick bushing disposed in the opening and carrying the sensor.

Example 22 is set up according to example 21, wherein the pick bushing has a greater hardness than the pick holder.

Example 23 is set up according to example 21 or 22, wherein the pick bushing: is in one piece (e.g. in the form of a sleeve, e.g. in the form of a cap) and/or is at least partially closed along the longitudinal axis (e.g. except for bores), or is in several pieces (e.g. in the form of a sleeve consisting of several parts), of which one (e.g. (e.g. second) part of the pick bushing comprises the receptacle area and may preferably be fastened to another (e.g. first) part of the pick bushing or the pick holder, wherein the at least one sensor is preferably disposed on the part which comprises the receptacle area.

Example 24 is set up according to one of examples 16 to 23, wherein at least one sensor is set up to sense a translation of the machine pick parallel to the pick axis and/or a translation of the machine pick transverse to the pick axis and/or a rotation of the machine pick about the longitudinal axis of the machine pick and/or a rotation of the machine pick perpendicular to the longitudinal axis of the machine pick.

Example 25 is set up according to any one of examples 16 to 24, wherein the locking device is set up in such a way that one or more than one degree of freedom of rotation is provided to the machine pick when the form-fit is formed.

Example 26 is set up according to any one of examples 16 to 25, wherein the locking device is set up in such a way that one or more than one degree of freedom of translation is provided to the machine pick when the form-fit is formed.

Example 27 is set up according to any one of examples 16 to 20, wherein the opening is extended along a direction into the pick holder and wherein the opening is disposed behind the receptacle area with respect to the direction; and wherein the locking device is set up to form a form-fit with the machine pick received in the opening, rigidly connecting the machine pick (e.g. a shaft of the machine pick) to the pick holder (e.g. limiting 3 degrees of translational freedom and 3 degrees of rotational freedom of the machine pick). According to various embodiments, the machine pick may be a radial pick.

Example 28 is set up according to example 27, wherein the sensor is set up to sense a pick head of the machine pick extending into the receptacle area as a portion without contact.

Example 29 is set up according to example 27 or 28, wherein at least one sensor is set up to sense a mechanical change (e.g. movement and/or deformation) of the machine pick. For example, at least one sensor may be set up to sense a movement of the sensor-sensible scale resulting from the deformation of the machine pick. For example, at least one sensor may be set up to sense a movement of the entire sensor-sensible scale and/or a compression of the sensor-sensible scale (e.g. a relative movement of individual elements of the sensor-sensible scale with respect to one another). Since the movement of the machine pick may result from a deformation of the machine pick, at least one sensor may be set up to sense a deformation of the machine pick (e.g. of the pick head).

Example 30 is set up according to examples 28 and 29, wherein at least one sensor is set up to sense a deformation of the pick head (e.g. a movement of the sensor-sensible scale due to a deformation of the pick head).

In example 31, the holding device according to any one of examples 16 to 30 may optionally further comprise: a cleaning device set up to remove (e.g. erode and/or magnetically bind) solid particles adhering to the machine pick and/or the pick holder and/or disposed between the machine pick and the pick holder.

Example 32 is an excavation system, comprising: a holding device according to any one of examples 16 to 31, optionally the machine pick (e.g. set up according to any one of examples 1 to 15), and optionally a signal processing system (e.g. implemented in a cloud or a remote control) set up to output a signal based on the machine pick sensed by at least one sensor.

Example 33 is set up according to example 32, wherein the signal processing system is set up to determine an indication of a mechanical change (e.g. movement and/or deformation) of the machine pick based on the machine pick sensed by the at least one sensor, wherein the signal is based on the specification.

Example 34 is set up according to example 32 or 33, wherein the signal processing system is set up to determine an indication of a force acting on the machine pick based on a parameter (e.g. the displacement, s, or the spring travel of the machine pick relative to the pick holder) which represents a spring force acting on the machine pick, wherein the signal is based on the specification. The parameter may, for example, be determined based on the machine pick sensed by at least one sensor or stored in a data memory.

Example 35 is set up according to one of examples 32 to 33, wherein the signal processing system is set up to determine the signal based on a mechanical change (e.g. movement and/or deformation) of the machine pick relative to the pick holder sensed by means of at least one sensor.

Example 36 is set up according to any one of examples 32 to 35, wherein the signal represents a condition of an object excavated by means of the machine pick.

Example 37 is set up according to one of examples 32 to 36, wherein the signal represents a state of the machine pick, preferably a wear state of the machine pick.

In example 38, the excavation system according to any one of examples 32 to 37 may optionally further comprise: an actuator set up to influence a movement of the pick holder based on the signal.

Example 39 is a method (e.g., a method of transferring a reference element), comprising: removing a reference element from a first machine pick (e.g. by releasing a rigid connection between a pick tip of the first machine pick and the reference element), and subsequently adding the reference element to a second machine pick in such a way that a rigid connection is formed between a pick tip of the second machine pick and the reference element, wherein the reference element comprises a magnetizable material which forms a sensor-sensible scale, wherein the machine pick is set up, for example, according to one of examples 1 to 15.

Example 40 is a method (e.g. a method for changing a machine pick), comprising removing a first machine pick comprising a reference element, from a pick holder, inserting a second machine pick, comprising the reference element, into a pick holder, wherein a rigid connection is formed between a pick tip of the second machine pick and the reference element; wherein the reference element comprises a magnetizable material which forms a sensor-sensible scale, wherein the machine pick is set up, for example, according to one of examples 1 to 15 and/or wherein the pick holder is set up, for example, according to one of examples 16 to 31.

Example 41 is a method comprising: excavation of a material by means of a machine pick comprising a reference element; sensing of a mechanical change (e.g. movement and/or deformation) of the reference element (e.g. due to a movement of the machine pick as a whole and/or a deformation of the machine pick) relative to a pick holder, into which the machine pick is inserted against a longitudinal direction of the machine pick, by means of at least one sensor of the pick holder during excavation of the material; outputting a signal based on the sensed mechanical change (e.g. movement and/or deformation) of the reference element, wherein the machine pick is set up, for example, in accordance with one of examples 1 to 15 and/or wherein the pick holder is set up, for example, in accordance with one of examples 16 to 31, wherein the signal is determined or set up, for example, in accordance with one of examples 32 to 38.

Example 42 is a method (e.g. a method for functional testing of a sensor), comprising: determination of a mechanical response of a reference element of a machine pick, which is received in a holding device, to a mechanical excitation of the machine pick (e.g. relative to the holding device and/or from a reference position); and classifying a sensor of the holding device, by means of which the response is sensed, based on a comparison of the response sensed by means of the sensor with a stored reference response.

Example 43 is set up according to example 42, further comprising: generating instructions for stimulating a deflection of the machine pick received in a holding device.

Example 44 is set up according to example 42 or 43, further comprising: generating a signal indicating a result of the classification, preferably whether the response of the machine pick fulfils a stored criterion, wherein the criterion is preferably fulfilled if a deviation of the response of the machine pick from a stored reference response is smaller than a (e.g. stored) threshold value.

The method according to one or more of examples 42 to 44 enables detection of contamination in the receptacle area, on the scale and/or on the at least one sensor.

Example 45 is a method for operating an excavation device (e.g. for restoring and/or maintaining the function of a sensor of the excavation device), comprising a machine pick disposed in a holding device according to one of examples 16 to 31 (e.g. a machine pick according to any one of examples 1 to 15), the method comprising: removing solid particles adhering to a machine pick and/or the pick holder and/or disposed between the machine pick and the pick holder, preferably by erosion and/or magnetic binding (e.g. catching) of the solid particles; and excavation of a material by means of the machine pick received in the pick holder before and/or after removal of the solid particles.

In example 46, which is preferably set up according to any one of examples 1 to 45, the reference element is attached to the pick shaft at an end of the pick shaft opposite the pick head, embedded in the pick shaft or part of the pick shaft (e.g. attached to the rear of the pick or part of the pick shaft).

In example 47, which is preferably set up according to one of examples 1 to 46, the scale is adjacent to a convex outer surface of the pick shaft and/or reference element (for example disposed on the outside); or the scale is adjacent to a concave inner surface of the pick shaft and/or reference element (for example disposed on the inside), for example if the reference element comprises a cavity (for example disposed at an end of the pick shaft opposite the pick head) which is bounded by the concave inner surface. The cavity may, for example, be set up to receive the at least one sensor, e.g. if this extends at least partially into the cavity during operation.

In example 48, which is preferably set up according to one of examples 1 to 47, at least one sensor is attached to the pick bushing and/or disposed below the opening for receiving the machine pick.

In example 49, which is preferably set up according to one of examples 1 to 48, at least one sensor is disposed in the pick bushing or at least attached thereto. Preferably, the pick bushing is penetrated by an opening (e.g. forming a passage extending transversely to the pick axis), into which at least one sensor extends, and/or through which at least one sensor senses the pick, and/or which exposes the receptacle area to at least one sensor. Alternatively or additionally, at least one sensor may be exposed to the outside.

In example 50, which is preferably set up according to any one of examples 1 to 49, at least one sensor is disposed in such a way that a distance from the sensor to the machine pick, when received in the opening of the holding device, is less than about 1 cm (centimetre), e.g. than about 0.5 cm, e.g. than about 0.2 cm, e.g. than about 0.1 cm.

In example 51, which is preferably set up according to one of examples 1 to 50, at least one sensor is disposed in such a way that it is at a distance from (e.g. not touching) the machine pick when it is received in the opening of the holding device.

In example 52, which is preferably set up according to one of examples 1 to 51, the scale has one or more than one edge (preferably formed by means of the magnetizable material), of which, for example, one edge is adjacent to a (e.g. rear) end face of the pick and/or of which, for example, one edge is adjacent to a recess (e.g. slot or chamfer) of the pick. Preferably, the scale may be formed by means of exactly one edge of the magnetizable material, which may, for example, be sensed by the at least one.

The invention claimed is:

1. A holding device comprising:

a pick holder having an opening for receiving a machine pick;

a locking device configured to form a form-fit with the machine pick received in the opening, wherein the locking device limits movement of the machine pick along a longitudinal axis of the machine pick;

a receptacle area for receiving a portion of the machine pick, wherein the receptacle area comprises the opening of the pick holder; and at least one sensor delimiting the receptacle area, wherein there is a gap arranged between the at least one sensor and the portion of the machine pick, and wherein the at least one sensor is configured to contactlessly sense a movement of the portion of the machine pick.

2. The holding device according to claim 1, further comprising a pick bushing disposed in the opening and carrying the at least one sensor.

3. The holding device according to claim 2, wherein the pick bushing:

is in one piece and/or is at least partially closed along the longitudinal axis; or is multi-part, of which one part of the pick bushing comprises the receptacle area.

4. The holding device according to claim 1, wherein the at least one sensor is configured to sense:

a translation of the machine pick parallel to the pick axis;

a translation of the machine pick transverse to the pick axis;

a rotation of the machine pick around the longitudinal axis of the machine pick;

a rotation of the machine pick perpendicular to the longitudinal axis of the machine pick; or combinations thereof.

5. The holding device according to claim 1, wherein the opening extends along a direction into the pick holder and wherein the opening is disposed behind the receptacle area with respect to the direction;

wherein the locking device is configured to form a form-fit connection with the machine pick received in the opening, which rigidly connects the machine pick to the pick holder.

6. The holding device according to claim 5, wherein the at least one sensor is configured to sense a deformation of the machine pick.

7. The holding device of claim 6, wherein the at least one sensor is configured to sense the deformation of the machine pick resulting from interaction of the machine pick with material excavated.

8. An excavation system comprising:

a holding device according to claim 1;

a signal processing system configured to output a signal based on the machine pick sensed by the at least one sensor.

9. The excavation system according to claim 8, wherein the signal represents a condition of an object excavated by the machine pick; and/or wherein the signal represents a condition of the machine pick.

10. The excavation system of claim 9, wherein the signal represents a physical property of the excavated material.

11. The holding device of claim 1, wherein the portion of the machine pick received in the receptacle area comprises a reference element, wherein the reference element comprises at least one sensor-sensible scale comprising a magnetizable material detectable by the at least one sensor.

12. The holding device of claim 1, wherein the at least one sensor comprises a sensor configured to contactlessly sense a change of a magnetic or electrical field induced by the portion of the pick extending into the receptacle area.

13. The holding device of claim 1, wherein the at least one sensor comprises a magnetoresistive sensor configured to contactlessly sense the portion extending into the receptacle area.

14. The holding device of claim 1, wherein the at least one sensor comprises an inductive sensor configured to contactlessly sense the portion extending into the receptacle area.

15. The holding device of claim 1, wherein the at least one sensor comprises a capacitive sensor or hall sensor configured to contactlessly sense the portion extending into the receptacle area.

16. The holding device of claim 1, wherein the at least one sensor is configured to contactlessly sense a movement of the portion extending into the receptacle area.

17. The holding device of claim 16, wherein the at least one sensor is configured to contactlessly sense a distance or a pattern of the movement of the portion extending into the receptacle area.

18. The holding device of claim 1, wherein the at least one sensor provides for a sampling rate ranging from about 0.5 kHz to about 20 kHz.

* * * * *